US007771007B2

(12) United States Patent
Hibbard et al.

(10) Patent No.: US 7,771,007 B2
(45) Date of Patent: Aug. 10, 2010

(54) PRINTHEAD MAINTENANCE FACILITY WITH MULTIPLE INDEPENDENT DRIVES

(75) Inventors: Christopher Hibbard, Balmain (AU); Paul Ian Mackey, Balmain (AU); Makomo Tsubono, Balmain (AU); Saminda Jayatileke, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 310 days.

(21) Appl. No.: 12/014,796

(22) Filed: Jan. 16, 2008

(65) Prior Publication Data

US 2009/0179959 A1 Jul. 16, 2009

(51) Int. Cl.
*B41J 2/165* (2006.01)

(52) U.S. Cl. ..... 347/33

(58) Field of Classification Search ..... 347/29, 347/30, 32, 33

See application file for complete search history.

(56) References Cited

U.S. PATENT DOCUMENTS

| | | | | |
|---|---|---|---|---|
| 6,585,351 | B2 * | 7/2003 | Nakagawa et al. | 347/33 |
| 6,692,101 | B2 * | 2/2004 | Lodal et al. | 347/33 |
| 6,824,242 | B1 * | 11/2004 | Silverbrook | 347/32 |
| 6,966,625 | B2 * | 11/2005 | Silverbrook | 347/29 |
| 7,011,388 | B2 * | 3/2006 | Lodal et al. | 347/33 |
| 7,097,291 | B2 | 8/2006 | Silverbrook | |
| 7,114,868 | B2 * | 10/2006 | Silverbrook | 400/649 |
| 2005/0264601 | A1 * | 12/2005 | Park | 347/33 |
| 2006/0238570 | A1 | 10/2006 | Silverbrook | |
| 2007/0019030 | A1 * | 1/2007 | Jeong | 347/33 |
| 2007/0126820 | A1 | 6/2007 | Silverbrook | |

* cited by examiner

*Primary Examiner*—Huan H Tran

(57) ABSTRACT

A printhead maintenance facility for an inkjet printer having a pagewidth printhead and a media path for feeding sheets of media substrate in a media feed direction wherein the pagewidth printhead has a nozzle face defining an elongate array of nozzles extending the printing width of the media substrate. The printhead maintenance facility has a wiper member extending the length of the nozzle array, a chassis for supporting the wiper member and a maintenance drive. The maintenance drive has a first actuator for moving the wiper member towards or away from the nozzle face, and a second actuator for rotating wiper member about an axis extending transverse to the media feed direction, wherein the first actuator and the second actuator are independently operable.

20 Claims, 37 Drawing Sheets

PRINTHEAD MAINTENANCE FACILITY WITH MULTIPLE INDEPENDENT DRIVES

FIELD OF THE INVENTION

The present invention relates to be field of printers and in particular pagewidth inkjet printers.

CO-PENDING APPLICATIONS

The following applications have been filed by the Applicant simultaneously with the present application:

| | | | | | |
|---|---|---|---|---|---|
| 12/014,767 | 12/014,768 | 12/014,769 | 12/014,770 | 12/014,771 | 12/014,772 |
| 12/014,773 | 12/014,774 | 12/014,775 | 12/014,776 | 12/014,777 | 12/014,778 |
| 12/014,779 | 12/014,780 | 12/014,781 | 12/014,782 | 12/014,783 | 12/014,784 |
| 12/014,785 | 12/014,787 | 12/014,788 | 12/014,789 | 12/014,790 | 12/014,791 |
| 12/014,792 | 12/014,793 | 12/014,794 | 12/014,798 | 12/014,801 | 12/014,803 |
| 12/014,804 | 12/014,805 | 12/014,806 | 12/014,807 | | |

The disclosures of these co-pending applications are incorporated herein by reference.

CROSS REFERENCES

The following patents or patent applications filed by the applicant or assignee of the present invention are hereby incorporated by cross-reference.

| | | | | |
|---|---|---|---|---|
| 6,276,850 | 6,520,631 | 6,158,907 | 6,539,180 | 6,270,177 |
| 6,405,055 | 6,628,430 | 6,835,135 | 6,626,529 | 6,981,769 |
| 7,125,338 | 7,125,337 | 7,136,186 | 7,286,260 | 7,145,689 |
| 7,130,075 | 7,081,974 | 7,177,055 | 7,209,257 | 6,443,555 |
| 7,161,715 | 7,154,632 | 7,158,258 | 7,148,993 | 7,075,684 |
| 10/943,905 | 10/943,906 | 10/943,904 | 10/943,903 | 10/943,902 |
| 6,966,659 | 6,988,841 | 7,077,748 | 7,255,646 | 7,070,270 |
| 7,014,307 | 7,158,809 | 7,217,048 | 11/225,172 | 11/255,942 |
| 11/329,039 | 11/329,040 | 7,271,829 | 11/442,189 | 11/474,280 |
| 11/483,061 | 11/503,078 | 11/520,735 | 11/505,858 | 11/525,850 |
| 11/583,870 | 11/592,983 | 11/592,208 | 11/601,828 | 11/635,482 |
| 11/635,526 | 10/466,440 | 7,215,441 | 11/650,545 | 11/653,241 |
| 11/653,240 | 7,056,040 | 6,942,334 | 11/706,300 | 11/740,265 |
| 11/737,720 | 11/739,056 | 11/740,204 | 11/740,223 | 11/753,557 |
| 11/750,285 | 11/758,648 | 11/778,559 | 11/834,634 | 11/838,878 |
| 11/845,669 | 6,799,853 | 7,237,896 | 6,749,301 | 10/451,722 |
| 7,137,678 | 7,252,379 | 7,144,107 | 10/503,900 | 10/503,898 |
| 10/503,897 | 7,220,068 | 7,270,410 | 7,241,005 | 7,108,437 |
| 7,140,792 | 10/503,922 | 7,224,274 | 10/503,917 | 10/503,918 |
| 10/503,925 | 10/503,927 | 10/503,928 | 10/503,929 | 10/503,885 |
| 7,195,325 | 7,229,164 | 7,150,523 | 10/503,889 | 7,154,580 |
| 6,906,778 | 7,167,158 | 7,128,269 | 6,688,528 | 6,986,613 |
| 6,641,315 | 7,278,702 | 10/503,891 | 7,150,524 | 7,155,395 |
| 6,915,140 | 6,999,206 | 6,795,651 | 6,883,910 | 7,118,481 |
| 7,136,198 | 7,092,130 | 6,786,661 | 6,808,325 | 10/920,368 |
| 10/920,284 | 7,219,990 | 10/920,283 | 6,750,901 | 6,476,863 |
| 6,788,336 | 6,322,181 | 6,597,817 | 6,227,648 | 6,727,948 |
| 6,690,419 | 10/470,947 | 6,619,654 | 6,969,145 | 6,679,582 |
| 10/470,942 | 6,568,670 | 6,866,373 | 7,280,247 | 7,008,044 |
| 6,742,871 | 6,966,628 | 6,644,781 | 6,969,143 | 6,767,076 |
| 6,834,933 | 6,692,113 | 6,913,344 | 6,727,951 | 7,128,395 |
| 7,036,911 | 7,032,995 | 6,969,151 | 6,955,424 | 6,969,162 |
| 10/919,249 | 6,942,315 | 11/006,577 | 7,234,797 | 6,986,563 |
| 7,295,211 | 11/045,442 | 7,286,162 | 7,283,159 | 7,077,330 |
| 6,196,541 | 11/149,389 | 11/185,725 | 7,226,144 | 11/202,344 |
| 7,267,428 | 11/248,423 | 11/248,422 | 7,093,929 | 11/282,769 |
| 11/330,060 | 11/442,111 | 7,290,862 | 11/499,806 | 11/499,710 |
| 6,195,150 | 11/749,156 | 11/782,588 | 11/854,435 | 11/853,817 |
| 11/935,958 | 11/924,608 | 6,362,868 | 11/970,993 | 6,831,681 |
| 6,431,669 | 6,362,869 | 6,472,052 | 6,356,715 | 6,894,694 |
| 6,636,216 | 6,366,693 | 6,329,990 | 6,459,495 | 6,137,500 |

-continued

| | | | | |
|---|---|---|---|---|
| 6,690,416 | 7,050,143 | 6,398,328 | 7,110,024 | 6,431,704 |
| 6,879,341 | 6,415,054 | 6,665,454 | 6,542,645 | 6,486,886 |
| 6,381,361 | 6,317,192 | 6,850,274 | 09/113,054 | 6,646,757 |
| 6,624,848 | 6,357,135 | 6,271,931 | 6,353,772 | 6,106,147 |
| 6,665,008 | 6,304,291 | 6,305,770 | 6,289,262 | 6,315,200 |
| 6,217,165 | 6,496,654 | 6,859,225 | 6,924,835 | 6,647,369 |
| 6,943,830 | 09/693,317 | 7,021,745 | 6,712,453 | 6,460,971 |
| 6,428,147 | 6,416,170 | 6,402,300 | 6,464,340 | 6,612,687 |
| 6,412,912 | 6,447,099 | 6,837,567 | 6,505,913 | 7,128,845 |
| 6,733,684 | 7,249,108 | 6,566,858 | 6,331,946 | 6,246,970 |

-continued

| | | | | |
|---|---|---|---|---|
| 6,442,525 | 09/517,384 | 09/505,951 | 6,374,354 | 7,246,098 |
| 6,816,968 | 6,757,832 | 6,334,190 | 6,745,331 | 7,249,109 |
| 10/203,559 | 7,197,642 | 7,093,139 | 10/636,263 | 10/636,283 |
| 10/866,608 | 7,210,038 | 10/902,883 | 10/940,653 | 10/942,858 |
| 11/706,329 | 11/757,385 | 11/758,642 | 7,119,836 | 7,283,162 |
| 7,286,169 | 10/636,285 | 7,170,652 | 6,967,750 | 6,995,876 |
| 7,099,051 | 7,172,191 | 7,243,916 | 7,222,845 | 11/239,232 |
| 7,285,227 | 7,063,940 | 11/107,942 | 7,193,734 | 7,086,724 |
| 7,090,337 | 7,278,723 | 7,140,717 | 11/190,902 | 11/209,711 |
| 7,256,824 | 7,140,726 | 7,156,512 | 7,186,499 | 11/478,585 |
| 11/525,862 | 11/540,574 | 11/583,875 | 11/592,181 | 6,750,944 |
| 11/599,336 | 7,291,447 | 11/744,183 | 11/758,646 | 11/778,561 |
| 11/839,532 | 11/838,874 | 11/853,021 | 11/869,710 | 11/868,531 |
| 11/927,403 | 11/951,960 | 10/636,225 | 6,985,207 | 6,773,874 |
| 6,650,836 | 10/666,495 | 10/636,224 | 7,250,975 | 7,295,343 |
| 6,880,929 | 7,236,188 | 7,236,187 | 7,155,394 | 10/636,219 |
| 10/636,223 | 7,055,927 | 6,986,562 | 7,052,103 | 7,312,845 |
| 10/656,281 | 10/656,791 | 10/666,124 | 10/683,217 | 7,289,142 |
| 7,095,533 | 6,914,686 | 6,896,252 | 6,820,871 | 6,834,851 |
| 6,848,686 | 6,830,246 | 6,851,671 | 10/729,098 | 7,092,011 |
| 7,187,404 | 10/729,159 | 10/753,458 | 6,878,299 | 6,929,348 |
| 6,921,154 | 10/780,625 | 10/804,042 | 6,913,346 | 10/831,238 |
| 10/831,237 | 10/831,239 | 10/831,240 | 10/831,241 | 10/831,234 |
| 10/831,233 | 7,246,897 | 7,077,515 | 10/831,235 | 10/853,336 |
| 10/853,117 | 10/853,659 | 10/853,681 | 6,913,875 | 7,021,758 |
| 7,033,017 | 7,161,709 | 7,099,033 | 7,147,294 | 7,156,494 |
| 11/012,024 | 11/011,925 | 7,032,998 | 7,044,585 | 7,296,867 |
| 6,994,424 | 11/006,787 | 7,258,435 | 7,097,263 | 7,001,012 |
| 7,004,568 | 7,040,738 | 7,188,933 | 7,027,080 | 7,025,446 |
| 6,991,321 | 7,131,715 | 7,261,392 | 7,207,647 | 7,182,435 |
| 7,097,285 | 11/228,410 | 7,097,284 | 7,083,264 | 7,147,304 |
| 7,232,203 | 7,156,498 | 7,201,471 | 11/501,772 | 11/503,084 |
| 11/513,073 | 7,210,764 | 11/635,524 | 11/706,379 | 11/730,386 |
| 11/730,784 | 11/753,568 | 11/782,591 | 11/859,783 | 6,710,457 |
| 6,775,906 | 6,507,099 | 7,221,043 | 7,107,674 | 7,154,172 |
| 11/442,400 | 7,247,941 | 11/736,540 | 7,307,354 | 11/940,304 |
| 6,530,339 | 6,631,897 | 6,851,667 | 6,830,243 | 6,860,479 |
| 6,997,452 | 7,000,913 | 7,204,482 | 11/212,759 | 11/281,679 |
| 11/730,409 | 6,238,044 | 6,425,661 | 11/003,786 | 7,258,417 |
| 7,293,853 | 11/003,334 | 7,270,395 | 11/003,404 | 11/003,419 |
| 11/003,700 | 7,255,419 | 7,284,819 | 7,229,148 | 7,258,416 |
| 7,273,263 | 7,270,393 | 6,984,017 | 11/003,699 | 11/071,473 |
| 7,156,497 | 11/601,670 | 11/748,482 | 11/778,563 | 11/779,851 |
| 11/778,574 | 11/853,816 | 11/853,814 | 11/853,786 | 11/872,037 |
| 11/856,694 | 11/965,703 | 11/971,170 | 11/003,463 | 11/003,701 |
| 11/003,683 | 11/003,614 | 7,284,820 | 11/003,684 | 7,246,875 |
| 11/003,617 | 11/764,760 | 11/853,777 | 11/955,354 | 11/293,800 |
| 11/293,802 | 11/293,801 | 11/293,808 | 11/293,809 | 11/482,975 |
| 11/482,970 | 11/482,968 | 11/482,972 | 11/482,971 | 11/482,969 |
| 6,431,777 | 6,334,664 | 6,447,113 | 7,239,407 | 6,398,359 |
| 6,652,089 | 6,652,090 | 7,057,759 | 6,631,986 | 7,187,470 |

-continued

| | | | | |
|---|---|---|---|---|
| 7,280,235 | 11/501,775 | 11/744,210 | 11/859,784 | 6,471,331 |
| 6,676,250 | 6,347,864 | 6,439,704 | 6,425,700 | 6,588,952 |
| 6,626,515 | 6,722,758 | 6,871,937 | 11/060,803 | 11/097,266 |
| 11/097,267 | 11/685,084 | 11/685,086 | 11/685,090 | 11/740,925 |
| 11/763,444 | 11/763,443 | 11/946,840 | 11/961,712 | 7,249,942 |
| 7,206,654 | 7,162,324 | 7,162,325 | 7,231,275 | 7,146,236 |
| 7,278,847 | 10/753,499 | 6,997,698 | 7,220,112 | 7,231,276 |
| 10/753,440 | 7,220,115 | 7,195,475 | 7,144,242 | 7,306,323 |
| 7,306,319 | 11/525,858 | 11/545,501 | 11/599,335 | 11/706,380 |
| 11/736,545 | 11/736,554 | 11/739,047 | 11/749,159 | 11/739,073 |
| 11/775,160 | 11/853,755 | 11/940,291 | 11/934,071 | 11/951,913 |
| 6,786,420 | 6,827,282 | 6,948,661 | 7,073,713 | 10/983,060 |
| 7,093,762 | 7,083,108 | 7,222,799 | 7,201,319 | 11/442,103 |
| 11/739,071 | 11/518,238 | 11/518,280 | 11/518,244 | 11/518,243 |
| 11/518,242 | 7,032,899 | 6,854,724 | 11/084,237 | 11/084,240 |
| 11/084,238 | 11/357,296 | 11/357,298 | 11/357,297 | 6,350,023 |
| 6,318,849 | 6,592,207 | 6,439,699 | 6,312,114 | 11/246,676 |
| 11/246,677 | 11/246,678 | 11/246,679 | 11/246,680 | 11/246,681 |
| 11/246,714 | 11/246,713 | 11/246,689 | 11/246,671 | 11/246,670 |
| 11/246,669 | 11/246,704 | 11/246,710 | 11/246,688 | 11/246,716 |
| 11/246,715 | 11/246,707 | 11/246,706 | 11/246,705 | 11/246,708 |
| 11/246,693 | 11/246,692 | 11/246,696 | 11/246,695 | 11/246,694 |
| 11/482,958 | 11/482,955 | 11/482,962 | 11/482,963 | 11/482,956 |
| 11/482,954 | 11/482,974 | 11/482,957 | 11/482,987 | 11/482,959 |
| 11/482,960 | 11/482,961 | 11/482,964 | 11/482,965 | 11/482,976 |
| 11/482,973 | 11/495,815 | 11/495,816 | 11/495,817 | 60/992,635 |
| 60/992,637 | 60/992,641 | 10/803,074 | 10/803,073 | 7,040,823 |
| 10/803,076 | 10/803,077 | 10/803,078 | 10/803,079 | 10/922,971 |
| 10/922,970 | 10/922,836 | 10/922,842 | 10/922,848 | 10/922,843 |
| 7,125,185 | 7,229,226 | 11/513,386 | 11/753,559 | 10/815,621 |
| 7,243,835 | 10/815,630 | 10/815,637 | 10/815,638 | 7,251,050 |
| 10/815,642 | 7,097,094 | 7,137,549 | 10/815,618 | 7,156,292 |
| 11/738,974 | 10/815,635 | 10/815,647 | 10/815,634 | 7,137,566 |
| 7,131,596 | 7,128,265 | 7,207,485 | 7,197,374 | 7,175,089 |
| 10/815,617 | 10/815,620 | 7,178,719 | 10/815,613 | 7,207,483 |
| 7,296,737 | 7,270,266 | 10/815,614 | 11/446,240 | 11/488,162 |
| 11/488,163 | 11/488,164 | 11/488,167 | 11/488,168 | 11/488,165 |
| 11/488,166 | 7,267,273 | 11/834,628 | 11/839,497 | 11/944,449 |
| 10/815,636 | 7,128,270 | 11/041,650 | 11/041,651 | 11/041,652 |
| 11/041,649 | 11/041,610 | 11/863,253 | 11/863,255 | 11/863,257 |
| 11/863,258 | 11/863,262 | 11/041,609 | 11/041,626 | 11/041,627 |
| 11/041,624 | 11/041,625 | 11/863,268 | 11/863,269 | 11/863,270 |
| 11/863,271 | 11/863,273 | 76/584,733 | 11/041,556 | 11/041,580 |
| 11/041,723 | 11/041,698 | 11/041,648 | 11/863,263 | 11/863,264 |
| 11/863,265 | 11/863,266 | 11/863,267 | 10/815,609 | 7,150,398 |
| 7,159,777 | 10/815,610 | 7,188,769 | 7,097,106 | 7,070,110 |
| 7,243,849 | 11/442,381 | 11/480,957 | 11/764,694 | 11/957,470 |
| 6,227,652 | 6,213,588 | 6,213,589 | 6,231,163 | 6,247,795 |
| 6,394,581 | 6,244,691 | 6,257,704 | 6,416,168 | 6,220,694 |
| 6,257,705 | 6,247,794 | 6,234,610 | 6,247,793 | 6,264,306 |
| 6,241,342 | 6,247,792 | 6,264,307 | 6,254,220 | 6,234,611 |
| 6,302,528 | 6,283,582 | 6,239,821 | 6,338,547 | 6,247,796 |
| 6,557,977 | 6,390,603 | 6,362,843 | 6,293,653 | 6,312,107 |
| 6,227,653 | 6,234,609 | 6,238,040 | 6,188,415 | 6,227,654 |
| 6,209,989 | 6,247,791 | 6,336,710 | 6,217,153 | 6,416,167 |
| 6,243,113 | 6,283,581 | 6,247,790 | 6,260,953 | 6,267,469 |
| 6,588,882 | 6,742,873 | 6,918,655 | 6,547,371 | 6,938,989 |
| 6,598,964 | 6,923,526 | 6,273,544 | 6,309,048 | 6,420,196 |
| 6,443,558 | 6,439,689 | 6,378,989 | 6,848,181 | 6,634,735 |
| 6,299,289 | 6,299,290 | 6,425,654 | 6,902,255 | 6,623,101 |
| 6,406,129 | 6,505,916 | 6,457,809 | 6,550,895 | 6,457,812 |
| 7,152,962 | 6,428,133 | 7,216,956 | 7,080,895 | 11/144,844 |
| 7,182,437 | 11/599,341 | 11/635,533 | 11/607,976 | 11/607,975 |
| 11/607,999 | 11/607,980 | 11/607,979 | 11/607,978 | 11/735,961 |
| 11/685,074 | 11/696,126 | 11/696,144 | 11/696,650 | 11/763,446 |
| 6,224,780 | 6,235,212 | 6,280,643 | 6,284,147 | 6,214,244 |
| 6,071,750 | 6,267,905 | 6,251,298 | 6,258,285 | 6,225,138 |
| 6,241,904 | 6,299,786 | 6,866,789 | 6,231,773 | 6,190,931 |
| 6,248,249 | 6,290,862 | 6,241,906 | 6,565,762 | 6,241,905 |
| 6,451,216 | 6,231,772 | 6,274,056 | 6,290,861 | 6,248,248 |
| 6,306,671 | 6,331,258 | 6,110,754 | 6,294,101 | 6,416,679 |
| 6,264,849 | 6,254,793 | 6,245,246 | 6,855,264 | 6,235,211 |
| 6,491,833 | 6,264,850 | 6,258,284 | 6,312,615 | 6,228,668 |
| 6,180,427 | 6,171,875 | 6,267,904 | 6,245,247 | 6,315,914 |
| 7,169,316 | 6,526,658 | 7,210,767 | 11/056,146 | 11/635,523 |
| 6,665,094 | 6,450,605 | 6,512,596 | 6,654,144 | 7,125,090 |
| 6,687,022 | 7,072,076 | 7,092,125 | 7,215,443 | 7,136,195 |
| 7,077,494 | 6,877,834 | 6,969,139 | 10/636,227 | 7,283,280 |
| 6,912,067 | 7,277,205 | 7,154,637 | 10/636,230 | 7,070,251 |

-continued

| | | | | |
|---|---|---|---|---|
| 6,851,782 | 10/636,211 | 10/636,247 | 6,843,545 | 7,079,286 |
| 7,064,867 | 7,065,247 | 7,027,177 | 7,218,415 | 7,064,873 |
| 6,954,276 | 7,061,644 | 7,092,127 | 7,059,695 | 10/990,382 |
| 7,177,052 | 7,270,394 | 11/124,231 | 7,188,921 | 7,187,469 |
| 7,196,820 | 11/281,445 | 7,283,281 | 7,251,051 | 7,245,399 |
| 11/524,911 | 11/640,267 | 11/706,297 | 11/730,387 | 11/737,142 |
| 11/764,729 | 11/834,637 | 11/853,019 | 11/863,239 | 11/305,274 |
| 11/305,273 | 11/305,275 | 11/305,152 | 11/305,158 | 11/305,008 |
| 6,231,148 | 6,293,658 | 6,614,560 | 6,238,033 | 6,312,070 |
| 6,238,111 | 6,378,970 | 6,196,739 | 6,270,182 | 6,152,619 |
| 7,006,143 | 6,876,394 | 6,738,096 | 6,970,186 | 6,287,028 |
| 6,412,993 | 11/033,145 | 11/102,845 | 11/102,861 | 11/248,421 |
| 11/672,878 | 7,204,941 | 7,282,164 | 10/815,628 | 11/845,672 |
| 7,278,727 | 10/913,373 | 10/913,374 | 10/913,372 | 7,138,391 |
| 7,153,956 | 10/913,380 | 10/913,379 | 10/913,376 | 7,122,076 |
| 7,148,345 | 11/172,816 | 11/172,815 | 11/172,814 | 11/482,990 |
| 11/482,986 | 11/482,985 | 11/454,899 | 11/583,942 | 11/592,990 |
| 11/849,360 | 11/831,961 | 11/831,962 | 11/831,963 | 60/951,700 |
| 11/832,629 | 11/832,637 | 60/971,535 | 10/407,212 | 7,252,366 |
| 10/683,064 | 10/683,041 | 7,275,811 | 10/884,889 | 10/922,890 |
| 10/922,875 | 10/922,885 | 10/922,889 | 10/922,884 | 10/922,879 |
| 10/922,887 | 10/922,888 | 10/922,874 | 7,234,795 | 10/922,871 |
| 10/922,880 | 7,293,855 | 10/922,882 | 10/922,883 | 10/922,878 |
| 10/922,872 | 10/922,876 | 10/922,886 | 10/922,877 | 7,147,792 |
| 7,175,774 | 11/159,193 | 11/491,378 | 11/766,713 | 11/841,647 |
| 11/482,980 | 11/563,684 | 11/482,967 | 11/482,966 | 11/482,988 |
| 11/482,989 | 11/293,832 | 11/293,838 | 11/293,825 | 11/293,841 |
| 11/293,799 | 11/293,796 | 11/293,797 | 11/293,798 | 11/124,158 |
| 11/124,196 | 11/124,199 | 11/124,162 | 11/124,202 | 11/124,197 |
| 11/124,154 | 11/124,198 | 7,284,921 | 11/124,151 | 11/124,160 |
| 11/124,192 | 11/124,175 | 11/124,163 | 11/124,149 | 11/124,152 |
| 11/124,173 | 11/124,155 | 7,236,271 | 11/124,174 | 11/124,194 |
| 11/124,164 | 11/124,200 | 11/124,195 | 11/124,166 | 11/124,150 |
| 11/124,172 | 11/124,165 | 11/124,186 | 11/124,185 | 11/124,184 |
| 11/124,182 | 11/124,201 | 11/124,171 | 11/124,181 | 11/124,161 |
| 11/124,156 | 11/124,191 | 11/124,159 | 11/124,176 | 11/124,188 |
| 11/124,170 | 11/124,187 | 11/124,189 | 11/124,190 | 11/124,180 |
| 11/124,193 | 11/124,183 | 11/124,178 | 11/124,177 | 11/124,148 |
| 11/124,168 | 11/124,167 | 11/124,179 | 11/124,169 | 11/187,976 |
| 11/188,011 | 11/188,014 | 11/482,979 | 11/735,490 | 11/853,018 |
| 11/944,450 | 11/228,540 | 11/228,500 | 11/228,501 | 11/228,530 |
| 11/228,490 | 11/228,531 | 11/228,504 | 11/228,533 | 11/228,502 |
| 11/228,507 | 11/228,482 | 11/228,505 | 11/228,497 | 11/228,487 |
| 11/228,529 | 11/228,484 | 11/228,489 | 11/228,518 | 11/228,536 |
| 11/228,496 | 11/228,488 | 11/228,506 | 11/228,516 | 11/228,526 |
| 11/228,539 | 11/228,538 | 11/228,524 | 11/228,523 | 11/228,519 |
| 11/228,528 | 11/228,527 | 11/228,525 | 11/228,520 | 11/228,498 |
| 11/228,511 | 11/228,522 | 11/228,515 | 11/228,537 | 11/228,534 |
| 11/228,491 | 11/228,499 | 11/228,509 | 11/228,492 | 11/228,493 |
| 11/228,510 | 11/228,508 | 11/228,512 | 11/228,514 | 11/228,494 |
| 11/228,495 | 11/228,486 | 11/228,481 | 11/228,477 | 11/228,485 |
| 11/228,483 | 11/228,521 | 11/228,517 | 11/228,532 | 11/228,513 |
| 11/228,503 | 11/228,480 | 11/228,535 | 11/228,478 | 11/228,479 |
| 6,238,115 | 6,386,535 | 6,398,344 | 6,612,240 | 6,752,549 |
| 6,805,049 | 6,971,313 | 6,899,480 | 6,860,664 | 6,925,935 |
| 6,966,636 | 7,024,995 | 7,284,852 | 6,926,455 | 7,056,038 |
| 6,869,172 | 7,021,843 | 6,988,845 | 6,964,533 | 6,981,809 |
| 7,284,822 | 7,258,067 | 11/155,544 | 7,222,941 | 7,284,925 |
| 7,278,795 | 7,249,904 | 11/737,726 | 11/772,240 | 11/863,246 |
| 11/863,145 | 11/865,650 | 6,087,638 | 6,340,222 | 6,041,600 |
| 6,299,300 | 6,067,797 | 6,286,935 | 6,044,646 | 6,382,769 |
| 6,787,051 | 6,938,990 | 11/242,916 | 11/144,799 | 11/198,235 |
| 11/861,282 | 11/861,284 | 11/766,052 | 7,152,972 | 11/592,996 |
| D529952 | 6,390,605 | 6,322,195 | 6,612,110 | 6,480,089 |
| 6,460,778 | 6,305,788 | 6,426,014 | 6,364,453 | 6,457,795 |
| 6,315,399 | 6,338,548 | 7,040,736 | 6,938,992 | 6,994,425 |
| 6,863,379 | 6,540,319 | 6,994,421 | 6,984,019 | 7,008,043 |
| 6,997,544 | 6,328,431 | 6,991,310 | 10/965,772 | 7,140,723 |
| 6,328,425 | 6,982,184 | 7,267,423 | 7,134,741 | 7,066,577 |
| 7,152,945 | 11/038,200 | 7,021,744 | 6,991,320 | 7,155,911 |
| 11/107,799 | 6,595,624 | 7,152,943 | 7,125,103 | 11/209,709 |
| 7,290,857 | 7,285,437 | 7,229,151 | 11/330,058 | 7,237,873 |
| 11/329,163 | 11/442,180 | 11/450,431 | 7,213,907 | 6,417,757 |
| 11/482,951 | 11/545,566 | 11/583,826 | 11/604,315 | 11/604,323 |
| 11/643,845 | 11/706,950 | 11/730,399 | 11/749,121 | 11/753,549 |
| 11/834,630 | 11/935,389 | 11/869,670 | 7,095,309 | 11/945,157 |
| 11/957,473 | 11/967,235 | 6,854,825 | 6,623,106 | 6,672,707 |
| 6,575,561 | 6,817,700 | 6,588,885 | 7,075,677 | 6,428,139 |
| 6,575,549 | 6,846,692 | 6,425,971 | 7,063,993 | 6,383,833 |

-continued

| | | | | |
|---|---|---|---|---|
| 6,955,414 | 6,412,908 | 6,746,105 | 6,953,236 | 6,412,904 |
| 7,128,388 | 6,398,343 | 6,652,071 | 6,793,323 | 6,659,590 |
| 6,676,245 | 7,201,460 | 6,464,332 | 6,659,593 | 6,478,406 |
| 6,978,613 | 6,439,693 | 6,502,306 | 6,966,111 | 6,863,369 |
| 6,428,142 | 6,874,868 | 6,390,591 | 6,799,828 | 6,896,358 |
| 7,018,016 | 10/296,534 | 6,328,417 | 6,322,194 | 6,382,779 |
| 6,629,745 | 6,565,193 | 6,609,786 | 6,609,787 | 6,439,908 |
| 6,684,503 | 6,843,551 | 6,764,166 | 6,561,617 | 10/510,092 |
| 6,557,970 | 6,546,628 | 10/510,098 | 6,652,074 | 6,820,968 |
| 7,175,260 | 6,682,174 | 7,303,262 | 6,648,453 | 6,834,932 |
| 6,682,176 | 6,998,062 | 6,767,077 | 7,278,717 | 6,755,509 |
| 10/534,813 | 6,692,108 | 10/534,811 | 6,672,709 | 7,303,263 |
| 7,086,718 | 10/534,881 | 6,672,710 | 10/534,812 | 6,669,334 |
| 10/534,804 | 7,152,958 | 7,281,782 | 6,824,246 | 7,264,336 |
| 6,669,333 | 10/534,815 | 6,820,967 | 7,306,326 | 6,736,489 |
| 7,264,335 | 6,719,406 | 7,222,943 | 7,188,419 | 7,168,166 |
| 6,974,209 | 7,086,719 | 6,974,210 | 7,195,338 | 7,252,775 |
| 7,101,025 | 11/474,281 | 11/485,258 | 11/706,304 | 11/706,324 |
| 11/706,326 | 11/706,321 | 11/772,239 | 11/782,598 | 11/829,941 |
| 11/852,991 | 11/852,986 | 11/936,062 | 11/934,027 | 11/955,028 |
| 11/763,440 | 11/763,442 | 11/246,687 | 11/246,718 | 11/246,685 |
| 11/246,686 | 11/246,703 | 11/246,691 | 11/246,711 | 11/246,690 |
| 11/246,712 | 11/246,717 | 11/246,709 | 11/246,700 | 11/246,701 |
| 11/246,702 | 11/246,668 | 11/246,697 | 11/246,698 | 11/246,699 |
| 11/246,675 | 11/246,674 | 11/246,667 | 11/829,957 | 11/829,960 |
| 11/829,961 | 11/829,962 | 11/829,963 | 11/829,966 | 11/829,967 |
| 11/829,968 | 11/829,969 | 11/946,839 | 11/946,838 | 11/946,837 |
| 11/951,230 | 7,156,508 | 7,159,972 | 7,083,271 | 7,165,834 |
| 7,080,894 | 7,201,469 | 7,090,336 | 7,156,489 | 10/760,233 |
| 10/760,246 | 7,083,257 | 7,258,422 | 7,255,423 | 7,219,980 |
| 10/760,253 | 10/760,255 | 10/760,209 | 7,118,192 | 10/760,194 |
| 10/760,238 | 7,077,505 | 7,198,354 | 7,077,504 | 10/760,189 |
| 7,198,355 | 10/760,232 | 10/760,231 | 7,152,959 | 7,213,906 |
| 7,178,901 | 7,222,938 | 7,108,353 | 7,104,629 | 11/446,227 |
| 11/454,904 | 11/472,345 | 11/474,273 | 7,261,401 | 11/474,279 |
| 11/482,939 | 11/482,950 | 11/499,709 | 7,306,324 | 7,306,325 |
| 11/603,824 | 11/601,756 | 11/601,672 | 7,303,261 | 11/653,253 |
| 11/706,328 | 11/706,299 | 11/706,965 | 11/737,080 | 11/737,041 |
| 11/778,062 | 11/778,566 | 11/782,593 | 11/934,018 | 11/945,157 |
| 11/951,095 | 11/951,828 | 11/954,906 | 11/954,949 | 11/967,226 |
| 7,303,930 | 11/246,672 | 11/246,673 | 11/246,683 | 11/246,682 |
| 60/939,086 | 11/860,538 | 11/860,539 | 11/860,540 | 11/860,541 |
| 11/860,542 | 11/936,060 | 11/877,667 | 11/877,668 | 7,246,886 |
| 7,128,400 | 7,108,355 | 6,991,322 | 7,287,836 | 7,118,197 |
| 10/728,784 | 10/728,783 | 7,077,493 | 6,962,402 | 10/728,803 |
| 7,147,308 | 10/728,779 | 7,118,198 | 7,168,790 | 7,172,270 |
| 7,229,155 | 6,830,318 | 7,195,342 | 7,175,261 | 10/773,183 |
| 7,108,356 | 7,118,202 | 10/773,186 | 7,134,744 | 10/773,185 |
| 7,134,743 | 7,182,439 | 7,210,768 | 10/773,187 | 7,134,745 |
| 7,156,484 | 7,118,201 | 7,111,926 | 10/773,184 | 7,018,021 |
| 11/060,751 | 11/060,805 | 11/188,017 | 7,128,402 | 11/298,774 |
| 11/329,157 | 11/490,041 | 11/501,767 | 7,284,839 | 7,246,885 |
| 7,229,156 | 11/505,846 | 11/505,857 | 7,293,858 | 11/524,908 |
| 11/524,938 | 7,258,427 | 11/524,912 | 7,278,716 | 11/592,995 |
| 11/603,825 | 11/649,773 | 11/650,549 | 11/653,237 | 11/706,378 |
| 11/706,962 | 11/749,118 | 11/754,937 | 11/749,120 | 11/744,885 |
| 11/779,850 | 11/765,439 | 11/842,950 | 11/839,539 | 11/926,121 |
| 11/097,308 | 11/097,309 | 7,246,876 | 11/097,299 | 11/097,310 |
| 11/097,213 | 11/210,687 | 11/097,212 | 7,147,306 | 7,261,394 |
| 11/764,806 | 11/782,595 | 11/965,696 | 11/482,953 | 11/482,977 |
| 11/544,778 | 11/544,779 | 11/764,808 | 11/756,624 | 11/756,625 |
| 11/756,626 | 11/756,627 | 11/756,628 | 11/756,629 | 11/756,630 |
| 11/756,631 | 7,156,289 | 7,178,718 | 7,225,979 | 11/712,434 |
| 11/084,796 | 11/084,742 | 11/084,806 | 09/575,197 | 09/575,197 |
| 7,079,712 | 7,079,712 | 6,825,945 | 6,825,945 | 09/575,165 |
| 09/575,165 | 6,813,039 | 6,813,039 | 7,190,474 | 7,190,474 |
| 6,987,506 | 6,987,506 | 6,824,044 | 6,824,044 | 7,038,797 |
| 7,038,797 | 6,980,318 | 6,980,318 | 6,816,274 | 6,816,274 |
| 7,102,772 | 7,102,772 | 09/575,186 | 09/575,186 | 6,681,045 |
| 6,681,045 | 6,678,499 | 6,678,499 | 6,679,420 | 6,679,420 |
| 6,963,845 | 6,963,845 | 6,976,220 | 6,976,220 | 6,728,000 |
| 6,728,000 | 7,110,126 | 7,110,126 | 7,173,722 | 7,173,722 |
| 6,976,035 | 6,976,035 | 6,813,558 | 6,813,558 | 6,766,942 |
| 6,766,942 | 6,965,454 | 6,965,454 | 6,995,859 | 6,995,859 |
| 7,088,459 | 7,088,459 | 6,720,985 | 6,720,985 | 7,286,113 |
| 7,286,113 | 6,922,779 | 6,922,779 | 6,978,019 | 6,978,019 |
| 6,847,883 | 6,847,883 | 7,131,058 | 7,131,058 | 7,295,839 |
| 7,295,839 | 09/607,843 | 09/607,843 | 09/693,690 | 09/693,690 |
| 6,959,298 | 6,959,298 | 6,973,450 | 6,973,450 | 7,150,404 |

-continued

| | | | | |
|---|---|---|---|---|
| 7,150,404 | 6,965,882 | 6,965,882 | 7,233,924 | 7,233,924 |
| 09/575,181 | 09/575,181 | 09/722,174 | 09/722,174 | 7,175,079 |
| 7,175,079 | 7,162,259 | 6,718,061 | 10/291,523 | 10/291,471 |
| 7,012,710 | 6,825,956 | 10/291,481 | 7,222,098 | 10/291,825 |
| 7,263,508 | 7,031,010 | 6,972,864 | 6,862,105 | 7,009,738 |
| 6,989,911 | 6,982,807 | 10/291,576 | 6,829,387 | 6,714,678 |
| 6,644,545 | 6,609,653 | 6,651,879 | 10/291,555 | 7,293,240 |
| 10/291,592 | 10/291,542 | 7,044,363 | 7,004,390 | 6,867,880 |
| 7,034,953 | 6,987,581 | 7,216,224 | 10/291,821 | 7,162,269 |
| 7,162,222 | 7,290,210 | 7,293,233 | 7,293,234 | 6,850,931 |
| 6,865,570 | 6,847,961 | 10/685,523 | 10/685,583 | 7,162,442 |
| 10/685,584 | 7,159,784 | 10/804,034 | 10/793,933 | 6,889,896 |
| 10/831,232 | 7,174,056 | 6,996,274 | 7,162,088 | 10/943,874 |
| 10/943,872 | 10/944,044 | 7,259,884 | 10/944,043 | 7,167,270 |
| 10/943,877 | 6,986,459 | 10/954,170 | 7,181,448 | 10/981,626 |
| 10/981,616 | 10/981,627 | 7,231,293 | 7,174,329 | 10/992,713 |
| 7,295,922 | 7,200,591 | 11/020,106 | 11/020,260 | 11/020,321 |
| 11/020,319 | 11/026,045 | 11/059,696 | 11/051,032 | 11/059,674 |
| 11/107,944 | 11/107,941 | 11/082,940 | 11/082,815 | 11/082,827 |
| 11/082,829 | 6,991,153 | 6,991,154 | 11/124,256 | 11/123,136 |
| 11/154,676 | 11/159,196 | 11/182,002 | 11/202,251 | 11/202,252 |
| 11/202,253 | 11/203,200 | 11/202,218 | 11/206,778 | 11/203,424 |
| 11/222,977 | 11/228,450 | 11/227,239 | 11/286,334 | 7,225,402 |
| 11/329,187 | 11/349,143 | 11/491,225 | 11/491,121 | 11/442,428 |
| 11/454,902 | 11/442,385 | 11/478,590 | 7,271,931 | 11/520,170 |
| 11/603,057 | 11/706,964 | 11/739,032 | 11/739,014 | 11/834,633 |
| 11/830,848 | 11/830,849 | 11/839,542 | 11/866,394 | 11/934,077 |
| 11/951,874 | 7,068,382 | 7,068,382 | 7,007,851 | 7,007,851 |
| 6,957,921 | 6,957,921 | 6,457,883 | 6,457,883 | 10/743,671 |
| 7,044,381 | 11/203,205 | 7,094,910 | 7,091,344 | 7,122,685 |
| 7,038,066 | 7,099,019 | 7,062,651 | 7,062,651 | 6,789,194 |
| 6,789,194 | 6,789,191 | 6,789,191 | 10/900,129 | 7,278,018 |
| 10/913,350 | 10/982,975 | 10/983,029 | 11/331,109 | 6,644,642 |
| 6,644,642 | 6,502,614 | 6,502,614 | 6,622,999 | 6,622,999 |
| 6,669,385 | 6,669,385 | 6,827,116 | 7,011,128 | 10/949,307 |
| 6,549,935 | 6,549,935 | 6,987,573 | 6,987,573 | 6,727,996 |
| 6,727,996 | 6,591,884 | 6,591,884 | 6,439,706 | 6,439,706 |
| 6,760,119 | 6,760,119 | 7,295,332 | 7,295,332 | 7,064,851 |
| 7,064,851 | 6,826,547 | 6,826,547 | 6,290,349 | 6,290,349 |
| 6,428,155 | 6,428,155 | 6,785,016 | 6,785,016 | 6,831,682 |
| 6,831,682 | 6,741,871 | 6,741,871 | 6,927,871 | 6,927,871 |
| 6,980,306 | 6,980,306 | 6,965,439 | 6,965,439 | 6,840,606 |
| 7,036,918 | 6,977,746 | 6,970,264 | 7,068,389 | 7,093,991 |
| 7,190,491 | 10/901,154 | 10/932,044 | 10/962,412 | 7,177,054 |
| 10/962,552 | 10/965,733 | 10/965,933 | 10/974,742 | 10/982,974 |
| 7,180,609 | 10/986,375 | 11/107,817 | 7,292,363 | 11/149,160 |
| 11/206,756 | 11/250,465 | 7,202,959 | 11/653,219 | 11/706,309 |
| 11/730,389 | 11/730,392 | 60/953,443 | 11/866,387 | 60/974,077 |
| 6,982,798 | 6,982,798 | 6,870,966 | 6,870,966 | 6,822,639 |
| 6,822,639 | 6,474,888 | 6,474,888 | 6,627,870 | 6,627,870 |
| 6,724,374 | 6,724,374 | 6,788,982 | 6,788,982 | 7,263,270 |
| 7,263,270 | 6,788,293 | 6,788,293 | 6,946,672 | 6,946,672 |
| 6,737,591 | 6,737,591 | 7,091,960 | 7,091,960 | 09/693,514 |
| 09/693,514 | 6,792,165 | 6,792,165 | 7,105,753 | 7,105,753 |
| 6,795,593 | 6,980,704 | 6,768,821 | 7,132,612 | 7,041,916 |
| 6,797,895 | 7,015,901 | 7,289,882 | 7,148,644 | 10/778,056 |
| 10/778,058 | 10/778,060 | 10/778,059 | 10/778,063 | 10/778,062 |
| 10/778,061 | 10/778,057 | 7,096,199 | 7,286,887 | 10/917,467 |
| 10/917,466 | 10/917,465 | 7,218,978 | 7,245,294 | 7,277,085 |
| 7,187,370 | 10/917,436 | 10/943,856 | 10/919,379 | 7,019,319 |
| 10/943,878 | 10/943,849 | 7,043,096 | 7,148,499 | 11/144,840 |
| 11/155,556 | 11/155,557 | 11/193,481 | 11/193,435 | 11/193,482 |
| 11/193,479 | 11/255,941 | 11/281,671 | 11/298,474 | 7,245,760 |
| 11/488,832 | 11/495,814 | 11/495,823 | 11/495,822 | 11/495,821 |
| 11/495,820 | 11/653,242 | 11/754,370 | 60/911,260 | 11/829,936 |
| 11/839,494 | 11/866,305 | 11/866,313 | 11/866,324 | 11/866,336 |
| 11/866,348 | 11/866,359 | 11/970,951 | 7,055,739 | 7,055,739 |
| 7,233,320 | 7,233,320 | 6,830,196 | 6,830,196 | 6,832,717 |
| 6,832,717 | 7,182,247 | 7,182,247 | 7,120,853 | 7,082,562 |
| 6,843,420 | 10/291,718 | 6,789,731 | 7,057,608 | 6,766,944 |
| 6,766,945 | 7,289,103 | 10/291,559 | 7,299,969 | 7,264,173 |
| 10/409,864 | 7,108,192 | 10/537,159 | 7,111,791 | 7,077,333 |
| 6,983,878 | 10/786,631 | 7,134,598 | 10/893,372 | 6,929,186 |
| 6,994,264 | 7,017,826 | 7,014,123 | 7,134,601 | 7,150,396 |
| 10/971,146 | 7,017,823 | 7,025,276 | 7,284,701 | 7,080,780 |
| 11/074,802 | 11/442,366 | 11/749,158 | 11/842,948 | 10/492,169 |
| 10/492,152 | 10/492,168 | 10/492,161 | 7,308,148 | 10/502,575 |
| 10/531,229 | 10/683,151 | 10/531,733 | 10/683,040 | 10/510,391 |
| 10/919,260 | 10/510,392 | 10/778,090 | 11/944,404 | 11/936,638 |

-continued

| | | | | |
|---|---|---|---|---|
| 6,957,768 | 6,957,768 | 09/575,172 | 09/575,172 | 7,170,499 |
| 7,170,499 | 7,106,888 | 7,106,888 | 7,123,239 | 7,123,239 |
| 6,982,701 | 6,982,703 | 7,227,527 | 6,786,397 | 6,947,027 |
| 6,975,299 | 7,139,431 | 7,048,178 | 7,118,025 | 6,839,053 |
| 7,015,900 | 7,010,147 | 7,133,557 | 6,914,593 | 10/291,546 |
| 6,938,826 | 7,278,566 | 7,123,245 | 6,992,662 | 7,190,346 |
| 11/074,800 | 11/074,782 | 11/074,777 | 11/075,917 | 7,221,781 |
| 11/102,843 | 7,213,756 | 11/188,016 | 7,180,507 | 7,263,225 |
| 7,287,688 | 11/737,094 | 11/753,570 | 11/782,596 | 11/865,711 |
| 11/856,061 | 11/856,062 | 11/856,064 | 11/856,066 | 11/672,522 |
| 11/672,950 | 11/672,947 | 11/672,891 | 11/672,954 | 11/672,533 |
| 11/754,310 | 11/754,321 | 11/754,320 | 11/754,319 | 11/754,318 |
| 11/754,317 | 11/754,316 | 11/754,315 | 11/754,314 | 11/754,313 |
| 11/754,312 | 11/754,311 | 6,593,166 | 6,593,166 | 7,132,679 |
| 6,940,088 | 7,119,357 | 7,307,272 | 6,755,513 | 6,974,204 |
| 6,409,323 | 7,055,930 | 6,281,912 | 6,893,109 | 6,604,810 |
| 6,824,242 | 6,318,920 | 7,210,867 | 6,488,422 | 6,655,786 |
| 6,457,810 | 6,485,135 | 6,796,731 | 6,904,678 | 6,641,253 |
| 7,125,106 | 6,786,658 | 7,097,273 | 6,824,245 | 7,222,947 |
| 6,918,649 | 6,860,581 | 6,929,351 | 7,063,404 | 6,969,150 |
| 7,004,652 | 6,871,938 | 6,905,194 | 6,846,059 | 6,997,626 |
| 10/974,881 | 7,029,098 | 6,966,625 | 7,114,794 | 7,207,646 |
| 7,077,496 | 7,284,831 | 11/072,529 | 7,152,938 | 7,182,434 |
| 7,182,430 | 7,306,317 | 7,032,993 | 11/155,513 | 11/155,545 |
| 11/144,813 | 7,172,266 | 7,258,430 | 7,128,392 | 7,210,866 |
| 7,306,322 | 11/505,933 | 11/540,727 | 11/635,480 | 11/707,946 |
| 11/706,303 | 11/709,084 | 11/730,776 | 11/744,143 | 11/779,845 |
| 11/782,589 | 11/863,256 | 11/940,302 | 11/940,235 | 11/955,359 |
| 11/066,161 | 11/066,160 | 11/066,159 | 11/066,158 | 7,287,831 |
| 11/875,936 | 6,804,030 | 6,807,315 | 6,771,811 | 6,683,996 |
| 7,271,936 | 7,304,771 | 6,965,691 | 7,058,219 | 7,289,681 |
| 7,187,807 | 7,181,063 | 11/338,783 | 11/603,823 | 11/650,536 |
| 10/727,181 | 10/727,162 | 10/727,163 | 10/727,245 | 7,121,639 |
| 7,165,824 | 7,152,942 | 10/727,157 | 7,181,572 | 7,096,137 |
| 7,302,592 | 7,278,034 | 7,188,282 | 10/727,159 | 10/727,180 |
| 10/727,179 | 10/727,192 | 10/727,274 | 10/727,164 | 10/727,161 |
| 10/727,198 | 10/727,158 | 10/754,536 | 10/754,938 | 10/727,227 |
| 10/727,160 | 10/934,720 | 7,171,323 | 7,278,697 | 11/442,131 |
| 11/474,278 | 11/488,853 | 11/488,841 | 11/749,750 | 11/749,749 |
| 11/955,127 | 11/951,213 | 10/296,522 | 6,795,215 | 7,070,098 |
| 7,154,638 | 6,805,419 | 6,859,289 | 6,977,751 | 6,398,332 |
| 6,394,573 | 6,622,923 | 6,747,760 | 6,921,144 | 10/884,881 |
| 7,092,112 | 7,192,106 | 11/039,866 | 7,173,739 | 6,986,560 |
| 7,008,033 | 11/148,237 | 7,222,780 | 7,270,391 | 7,150,510 |
| 11/478,599 | 11/499,749 | 11/521,388 | 11/738,518 | 11/482,981 |
| 11/743,662 | 11/743,661 | 11/743,659 | 11/743,655 | 11/743,657 |
| 11/752,900 | 11/926,109 | 11/927,163 | 11/929,567 | 7,195,328 |
| 7,182,422 | 11/650,537 | 11/712,540 | 10/854,521 | 10/854,522 |
| 10/854,488 | 7,281,330 | 10/854,503 | 10/854,504 | 10/854,509 |
| 7,188,928 | 7,093,989 | 10/854,497 | 10/854,495 | 10/854,498 |
| 10/854,511 | 10/854,512 | 10/854,525 | 10/854,526 | 10/854,516 |
| 7,252,353 | 10/854,515 | 7,267,417 | 10/854,505 | 10/854,493 |
| 7,275,805 | 7,314,261 | 10/854,490 | 7,281,777 | 7,290,852 |
| 10/854,528 | 10/854,523 | 10/854,527 | 10/854,524 | 10/854,520 |
| 10/854,514 | 10/854,519 | 10/854,513 | 10/854,499 | 10/854,501 |
| 7,266,661 | 7,243,193 | 10/854518 | 10/854,517 | 10/934,628 |
| 7,163,345 | 11/499,803 | 11/601,757 | 11/706,295 | 11/735,881 |
| 11/748,483 | 11/749,123 | 11/766,061 | 11/775,135 | 11/772,235 |
| 11/778,569 | 11/829,942 | 11/870,342 | 11/935,274 | 11/937,239 |
| 11/961,907 | 11/961,940 | 11/961,961 | 11/014,731 | D529081 |
| D541848 | D528597 | 6,924,907 | 6,712,452 | 6,416,160 |
| 6,238,043 | 6,958,826 | 6,812,972 | 6,553,459 | 6,967,741 |
| 6,956,669 | 6,903,766 | 6,804,026 | 7,259,889 | 6,975,429 |
| 10/636,234 | 10/636,233 | 7,301,567 | 10/636,216 | 7,274,485 |
| 7,139,084 | 7,173,735 | 7,068,394 | 7,286,182 | 7,086,644 |
| 7,250,977 | 7,146,281 | 7,023,567 | 7,136,183 | 7,083,254 |
| 6,796,651 | 7,061,643 | 7,057,758 | 6,894,810 | 6,995,871 |
| 7,085,010 | 7,092,126 | 7,123,382 | 7,061,650 | 10/853,143 |
| 6,986,573 | 6,974,212 | 7,307,756 | 7,173,737 | 10/954,168 |
| 7,246,868 | 11/065,357 | 7,137,699 | 11/107,798 | 7,148,994 |
| 7,077,497 | 11/176,372 | 7,248,376 | 11/225,158 | 7,306,321 |
| 7,173,729 | 11/442,132 | 11/478,607 | 11/503,085 | 11/545,502 |
| 11/583,943 | 11/585,946 | 11/653,239 | 11/653,238 | 11/764,781 |
| 11/764,782 | 11/779,884 | 11/845,666 | 11/872,637 | 11/944,401 |
| 11/940,215 | 11/544,764 | 11/544,765 | 11/544,772 | 11/544,773 |
| 11/544,774 | 11/544,775 | 11/544,776 | 11/544,766 | 11/544,767 |
| 11/544,771 | 11/544,770 | 11/544,769 | 11/544,777 | 11/544,768 |
| 11/544,763 | 11/293,804 | 11/293,840 | 11/293,803 | 11/293,833 |
| 11/293,834 | 11/293,835 | 11/293,836 | 11/293,837 | 11/293,792 |

-continued

| | | | | |
|---|---|---|---|---|
| 11/293,794 | 11/293,839 | 11/293,826 | 11/293,829 | 11/293,830 |
| 11/293,827 | 11/293,828 | 7,270,494 | 11/293,823 | 11/293,824 |
| 11/293,831 | 11/293,815 | 11/293,819 | 11/293,818 | 11/293,817 |
| 11/293,816 | 11/838,875 | 11/482,978 | 11/640,356 | 11/640,357 |
| 11/640,358 | 11/640,359 | 11/640,360 | 11/640,355 | 11/679,786 |
| 11/872,714 | 10/760,254 | 10/760,210 | 10/760,202 | 7,201,468 |
| 10/760,198 | 10/760,249 | 7,234,802 | 7,303,255 | 7,287,846 |
| 7,156,511 | 10/760,264 | 7,258,432 | 7,097,291 | 10/760,222 |
| 10/760,248 | 7,083,273 | 10/760,192 | 10/760,203 | 10/760,204 |
| 10/760,205 | 10/760,206 | 10/760,267 | 10/760,270 | 7,198,352 |
| 10/760,271 | 7,303,251 | 7,201,470 | 7,121,655 | 7,293,861 |
| 7,232,208 | 10/760,186 | 10/760,261 | 7,083,272 | 7,261,400 |
| 11/474,272 | 11/474,315 | 7,311,387 | 11/583,874 | 7,303,258 |
| 11/706,322 | 11/706,968 | 11/749,119 | 11/749,157 | 11/779,848 |
| 11/782,590 | 11/855,152 | 11/855,151 | 11/870,327 | 11/934,780 |
| 11/935,992 | 11/951,193 | 11/014,764 | 11/014,763 | 11/014,748 |
| 11/014,747 | 11/014,761 | 11/014,760 | 11/014,757 | 7,303,252 |
| 7,249,822 | 11/014,762 | 11/014,724 | 11/014,723 | 11/014,756 |
| 11/014,736 | 11/014,759 | 11/014,758 | 11/014,725 | 11/014,739 |
| 11/014,738 | 11/014,737 | 11/014,726 | 11/014,745 | 11/014,712 |
| 7,270,405 | 7,303,268 | 11/014,735 | 11/014,734 | 11/014,719 |
| 11/014,750 | 11/014,749 | 7,249,833 | 11/758,640 | 11/775,143 |
| 11/838,877 | 11/944,453 | 11/944,633 | 11/955,065 | 11/014,769 |
| 11/014,729 | 11/014,743 | 11/014,733 | 7,300,140 | 11/014,755 |
| 11/014,765 | 11/014,766 | 11/014,740 | 7,284,816 | 7,284,845 |
| 7,255,430 | 11/014,744 | 11/014,741 | 11/014,768 | 11/014,767 |
| 11/014,718 | 11/014,717 | 11/014,716 | 11/014,732 | 11/014,742 |
| 11/097,268 | 11/097,185 | 11/097,184 | 11/778,567 | 11/852,958 |
| 11/852,907 | 11/872,038 | 11/955,093 | 11/961,578 | 11/293,820 |
| 11/293,813 | 11/293,822 | 11/293,812 | 11/293,821 | 11/293,814 |
| 11/293,793 | 11/293,842 | 11/293,811 | 11/293,807 | 11/293,806 |
| 11/293,805 | 11/293,810 | 11/688,863 | 11/688,864 | 11/688,865 |
| 11/688,866 | 11/688,867 | 11/688,868 | 11/688,869 | 11/688,871 |
| 11/688,872 | 11/688,873 | 11/741,766 | 11/482,982 | 11/482,983 |
| 11/482,984 | 11/495,818 | 11/495,819 | 11/677,049 | 11/677,050 |
| 11/677,051 | 11/872,719 | 11/872,718 | 7,306,320 | 11/934,781 |
| D528156 | 10/760,180 | 7,111,935 | 10/760,213 | 10/760,219 |
| 10/760,237 | 7,261,482 | 10/760,220 | 7,002,664 | 10/760,252 |
| 10/760,265 | 7,088,420 | 11/446,233 | 11/503,083 | 11/503,081 |
| 11/516,487 | 11/599,312 | 6,364,451 | 6,533,390 | 6,454,378 |
| 7,224,478 | 6,559,969 | 6,896,362 | 7,057,760 | 6,982,799 |
| 11/202,107 | 11/743,672 | 11/744,126 | 11/743,673 | 7,093,494 |
| 7,143,652 | 7,089,797 | 7,159,467 | 7,234,357 | 7,124,643 |
| 7,121,145 | 7,089,790 | 7,194,901 | 6,968,744 | 7,089,798 |
| 7,240,560 | 7,137,302 | 11/442,177 | 7,171,855 | 7,260,995 |
| 7,260,993 | 7,165,460 | 7,222,538 | 7,258,019 | 11/543,047 |
| 7,258,020 | 11/604,324 | 11/642,520 | 11/706,305 | 11/707,056 |
| 11/744,211 | 11/767,526 | 11/779,846 | 11/764,227 | 11/829,943 |
| 11/829,944 | 6,454,482 | 6,454,482 | 6,808,330 | 6,808,330 |
| 6,527,365 | 6,527,365 | 6,474,773 | 6,474,773 | 6,550,997 |
| 6,550,997 | 7,093,923 | 6,957,923 | 7,131,724 | 10/949,288 |
| 7,168,867 | 7,125,098 | 11/706,966 | 11/185,722 | 7,249,901 |
| 7,188,930 | 11/014,728 | 11/014,727 | D536031 | D531214 |
| 7,237,888 | 7,168,654 | 7,201,272 | 6,991,098 | 7,217,051 |
| 6,944,970 | 10/760,215 | 7,108,434 | 10/760,257 | 7,210,407 |
| 7,186,042 | 10/760,266 | 6,920,704 | 7,217,049 | 10/760,214 |
| 10/760,260 | 7,147,102 | 7,287,828 | 7,249,838 | 10/760,241 |
| 10/962,413 | 10/962,427 | 7,261,477 | 7,225,739 | 10/962,402 |
| 10/962,425 | 10/962,428 | 7,191,978 | 10/962,426 | 10/962,409 |
| 10/962,417 | 10/962,403 | 7,163,287 | 7,258,415 | 10/962,523 |
| 7,258,424 | 10/962,410 | 7,195,412 | 7,207,670 | 7,270,401 |
| 7,220,072 | 11/474,267 | 11/544,547 | 11/585,925 | 11/593,000 |
| 11/706,298 | 11/706,296 | 11/706,327 | 11/730,760 | 11/730,407 |
| 11/730,787 | 11/735,977 | 11/736,527 | 11/753,566 | 11/754,359 |
| 11/778,061 | 11/765,398 | 11/778,556 | 11/829,937 | 11/780,470 |
| 11/866,399 | 11/223,262 | 11/223,018 | 11/223,114 | 11/955,366 |
| 11/223,022 | 11/223,021 | 11/223,020 | 11/223,019 | 11/014,730 |
| D541849 | 29/279,123 | 6,716,666 | 6,949,217 | 6,750,083 |
| 7,014,451 | 6,777,259 | 6,923,524 | 6,557,978 | 6,991,207 |
| 6,766,998 | 6,967,354 | 6,759,723 | 6,870,259 | 10/853,270 |
| 6,925,875 | 10/898,214 | 7,095,109 | 7,145,696 | 10/976,081 |
| 7,193,482 | 7,134,739 | 7,222,939 | 7,164,501 | 7,118,186 |
| 7,201,523 | 7,226,159 | 7,249,839 | 7,108,343 | 7,154,626 |
| 7,079,292 | 10/980,184 | 7,233,421 | 7,063,408 | 10/983,082 |
| 10/982,804 | 7,032,996 | 10/982,834 | 10/982,833 | 10/982,817 |
| 7,217,046 | 6,948,870 | 7,195,336 | 7,070,257 | 10/986,813 |
| 10/986,785 | 7,093,922 | 6,988,789 | 10/986,788 | 7,246,871 |
| 10/992,748 | 10/992,747 | 7,187,468 | 10/992,828 | 7,196,814 |
| 10/992,754 | 7,268,911 | 7,265,869 | 7,128,384 | 7,164,505 |

-continued

| | | | | |
|---|---|---|---|---|
| 7,284,805 | 7,025,434 | 7,298,519 | 7,280,244 | 7,206,098 |
| 7,265,877 | 7,193,743 | 7,168,777 | 11/006,734 | 7,195,329 |
| 7,198,346 | 7,281,786 | 11/013,363 | 11/013,881 | 6,959,983 |
| 7,128,386 | 7,097,104 | 11/013,636 | 7,083,261 | 7,070,258 |
| 7,083,275 | 7,110,139 | 6,994,419 | 6,935,725 | 11/026,046 |
| 7,178,892 | 7,219,429 | 6,988,784 | 11/026,135 | 7,289,156 |
| 11/064,005 | 7,284,976 | 7,178,903 | 7,273,274 | 7,083,256 |
| 11/064,008 | 7,278,707 | 11/064,013 | 6,974,206 | 11/064,004 |
| 7,066,588 | 7,222,940 | 11/075,918 | 7,018,025 | 7,221,867 |
| 7,290,863 | 7,188,938 | 7,021,742 | 7,083,262 | 7,192,119 |
| 11/083,021 | 7,036,912 | 7,175,256 | 7,182,441 | 7,083,258 |
| 7,114,796 | 7,147,302 | 11/084,757 | 7,219,982 | 7,118,195 |
| 7,229,153 | 6,991,318 | 7,108,346 | 11/248,429 | 11/239,031 |
| 7,178,899 | 7,066,579 | 11/281,419 | 11/298,633 | 11/329,188 |
| 11/329,140 | 7,270,397 | 7,258,425 | 7,237,874 | 7,152,961 |
| 11/478,592 | 7,207,658 | 11/484,744 | 7,311,257 | 7,207,659 |
| 11/525,857 | 11/540,569 | 11/583,869 | 11/592,985 | 11/585,947 |
| 7,306,307 | 11/604,316 | 11/604,309 | 11/604,303 | 11/643,844 |
| 11/650,553 | 11/655,940 | 11/653,320 | 7,278,713 | 11/706,381 |
| 11/706,323 | 11/706,963 | 11/713,660 | 7,290,853 | 11/696,186 |
| 11/730,390 | 11/737,139 | 11/737,749 | 11/740,273 | 11/749,122 |
| 11/754,361 | 11/766,043 | 11/764,775 | 11/768,872 | 11/775,156 |
| 11/779,271 | 11/779,272 | 11/829,938 | 11/839,502 | 11/858,852 |
| 11/862,188 | 11/859,790 | 11/872,618 | 11/923,651 | 11/950,255 |
| 11/930,001 | 11/955,362 | 11/965,718 | 6,485,123 | 6,425,657 |
| 6,488,358 | 7,021,746 | 6,712,986 | 6,981,757 | 6,505,912 |
| 6,439,694 | 6,364,461 | 6,378,990 | 6,425,658 | 6,488,361 |
| 6,814,429 | 6,471,336 | 6,457,813 | 6,540,331 | 6,454,396 |
| 6,464,325 | 6,443,559 | 6,435,664 | 6,412,914 | 6,488,360 |
| 6,550,896 | 6,439,695 | 6,447,100 | 09/900,160 | 6,488,359 |
| 6,637,873 | 10/485,738 | 6,618,117 | 10/485,737 | 6,803,989 |
| 7,234,801 | 7,044,589 | 7,163,273 | 6,416,154 | 6,547,364 |
| 10/485,744 | 6,644,771 | 7,152,939 | 6,565,181 | 10/485,805 |
| 6,857,719 | 7,255,414 | 6,702,417 | 7,284,843 | 6,918,654 |
| 7,070,265 | 6,616,271 | 6,652,078 | 6,503,408 | 6,607,263 |
| 7,111,924 | 6,623,108 | 6,698,867 | 6,488,362 | 6,625,874 |
| 6,921,153 | 7,198,356 | 6,536,874 | 6,425,651 | 6,435,667 |
| 10/509,997 | 6,527,374 | 10/510,154 | 6,582,059 | 10/510,152 |
| 6,513,908 | 7,246,883 | 6,540,332 | 6,547,368 | 7,070,256 |
| 6,508,546 | 10/510,151 | 6,679,584 | 10/510,000 | 6,857,724 |
| 10/509,998 | 6,652,052 | 10/509,999 | 6,672,706 | 10/510,096 |
| 6,688,719 | 6,712,924 | 6,588,886 | 7,077,508 | 7,207,654 |
| 6,935,724 | 6,927,786 | 6,988,787 | 6,899,415 | 6,672,708 |
| 6,644,767 | 6,874,866 | 6,830,316 | 6,994,420 | 6,954,254 |
| 7,086,720 | 7,240,992 | 7,267,424 | 7,128,397 | 7,084,951 |
| 7,156,496 | 7,066,578 | 7,101,023 | 11/165,027 | 11/202,235 |
| 11/225,157 | 7,159,965 | 7,255,424 | 11/349,519 | 7,137,686 |
| 7,201,472 | 7,287,829 | 11/504,602 | 7,216,957 | 11/520,572 |
| 11/583,858 | 11/583,895 | 11/585,976 | 11/635,488 | 7,278,712 |
| 11/706,952 | 11/706,307 | 7,287,827 | 11/944,451 | 11/740,287 |
| 11/754,367 | 11/758,643 | 11/778,572 | 11/859,791 | 11/863,260 |
| 11/874,178 | 11/936,064 | 11/951,983 | 6,916,082 | 6,786,570 |
| 10/753,478 | 6,848,780 | 6,966,633 | 7,179,395 | 6,969,153 |
| 6,979,075 | 7,132,056 | 6,832,828 | 6,860,590 | 6,905,620 |
| 6,786,574 | 6,824,252 | 7,097,282 | 6,997,545 | 6,971,734 |
| 6,918,652 | 6,978,990 | 6,863,105 | 10/780,624 | 7,194,629 |
| 10/791,792 | 6,890,059 | 6,988,785 | 6,830,315 | 7,246,881 |
| 7,125,102 | 7,028,474 | 7,066,575 | 6,986,202 | 7,044,584 |
| 7,210,762 | 7,032,992 | 7,140,720 | 7,207,656 | 7,285,170 |
| 11/048,748 | 7,008,041 | 7,011,390 | 7,048,868 | 7,014,785 |
| 7,131,717 | 7,284,826 | 11/176,158 | 7,182,436 | 7,104,631 |
| 7,240,993 | 7,290,859 | 11/202,217 | 7,172,265 | 7,284,837 |
| 7,066,573 | 11/298,635 | 7,152,949 | 11/442,161 | 11/442,133 |
| 11/442,126 | 7,156,492 | 11/478,588 | 11/505,848 | 7,287,834 |
| 11/525,861 | 11/583,939 | 11/545,504 | 7,284,326 | 11/635,485 |
| 11/730,391 | 11/730,788 | 11/749,148 | 11/749,149 | 11/749,152 |
| 11/749,151 | 11/759,886 | 11/865,668 | 11/874,168 | 11/874,203 |
| 11/971,182 | 11/965,722 | 6,824,257 | 7,270,475 | 6,971,811 |
| 6,878,564 | 6,921,145 | 6,890,052 | 7,021,747 | 6,929,345 |
| 6,811,242 | 6,916,087 | 6,905,195 | 6,899,416 | 6,883,906 |
| 6,955,428 | 7,284,834 | 6,932,459 | 6,962,410 | 7,033,008 |
| 6,962,409 | 7,013,641 | 7,204,580 | 7,032,997 | 6,998,278 |
| 7,004,563 | 6,910,755 | 6,969,142 | 6,938,994 | 7,188,935 |
| 10/959,049 | 7,134,740 | 6,997,537 | 7,004,567 | 6,916,091 |
| 7,077,588 | 6,918,707 | 6,923,583 | 6,953,295 | 6,921,221 |
| 7,001,008 | 7,168,167 | 7,210,759 | 11/008,115 | 11/011,120 |
| 11/012,329 | 6,988,790 | 7,192,120 | 7,168,789 | 7,004,577 |
| 7,052,120 | 11/123,007 | 6,994,426 | 7,258,418 | 7,014,298 |
| 11/124,348 | 11/177,394 | 7,152,955 | 7,097,292 | 7,207,657 |

-continued

| | | | | |
|---|---|---|---|---|
| 7,152,944 | 7,147,303 | 11/209,712 | 7,134,608 | 7,264,333 |
| 7,093,921 | 7,077,590 | 7,147,297 | 11/239,029 | 11/248,832 |
| 11/248,428 | 11/248,434 | 7,077,507 | 7,172,672 | 7,175,776 |
| 7,086,717 | 7,101,020 | 11/329,155 | 7,201,466 | 11/330,057 |
| 7,152,967 | 7,182,431 | 7,210,666 | 7,252,367 | 7,287,837 |
| 11/485,255 | 11/525,860 | 6,945,630 | 7,018,294 | 6,910,014 |
| 6,659,447 | 6,648,321 | 7,082,980 | 6,672,584 | 7,073,551 |
| 6,830,395 | 7,289,727 | 7,001,011 | 6,880,922 | 6,886,915 |
| 6,644,787 | 6,641,255 | 7,066,580 | 6,652,082 | 7,284,833 |
| 6,666,544 | 6,666,543 | 6,669,332 | 6,984,023 | 6,733,104 |
| 6,644,793 | 6,723,575 | 6,953,235 | 6,663,225 | 7,076,872 |
| 7,059,706 | 7,185,971 | 7,090,335 | 6,854,827 | 6,793,974 |
| 10/636,258 | 7,222,929 | 6,739,701 | 7,073,881 | 7,155,823 |
| 7,219,427 | 7,008,503 | 6,783,216 | 6,883,890 | 6,857,726 |
| 10/636,274 | 6,641,256 | 6,808,253 | 6,827,428 | 6,802,587 |
| 6,997,534 | 6,959,982 | 6,959,981 | 6,886,917 | 6,969,473 |
| 6,827,425 | 7,007,859 | 6,802,594 | 6,792,754 | 6,860,107 |
| 6,786,043 | 6,863,378 | 7,052,114 | 7,001,007 | 10/729,151 |
| 10/729,157 | 6,948,794 | 6,805,435 | 6,733,116 | 10/683,006 |
| 7,008,046 | 6,880,918 | 7,066,574 | 6,983,595 | 6,923,527 |
| 7,275,800 | 7,163,276 | 7,156,495 | 6,976,751 | 6,994,430 |
| 7,014,296 | 7,059,704 | 7,160,743 | 7,175,775 | 7,287,839 |
| 7,097,283 | 7,140,722 | 11/123,009 | 11/123,008 | 7,080,893 |
| 7,093,920 | 7,270,492 | 7,128,093 | 7,052,113 | 7,055,934 |
| 11/155,627 | 7,278,796 | 11/159,197 | 7,083,263 | 7,145,592 |
| 7,025,436 | 11/281,444 | 7,258,421 | 11/478,591 | 11/478,735 |
| 7,226,147 | 11/482,940 | 7,195,339 | 11/503,061 | 11/505,938 |
| 7,284,838 | 7,293,856 | 11/544,577 | 11/540,576 | 11/585,964 |
| 11/592,991 | 11/599,342 | 11/600,803 | 11/604,321 | 11/604,302 |
| 11/635,535 | 11/635,486 | 11/643,842 | 11/655,987 | 11/650,541 |
| 11/706,301 | 11/707,039 | 11/730,388 | 11/730,786 | 11/730,785 |
| 11/739,080 | 11/764,746 | 11/768,875 | 11/779,847 | 11/829,940 |
| 11/847,240 | 11/834,625 | 11/863,210 | 11/865,680 | 11/874,156 |
| 11/923,602 | 11/951,940 | 11/954,988 | 11/961,662 | 7,067,067 |
| 6,776,476 | 6,880,914 | 7,086,709 | 6,783,217 | 7,147,791 |
| 6,929,352 | 7,144,095 | 6,820,974 | 6,918,647 | 6,984,016 |
| 7,192,125 | 6,824,251 | 6,834,939 | 6,840,600 | 6,786,573 |
| 7,144,519 | 6,799,835 | 6,959,975 | 6,959,974 | 7,021,740 |
| 6,935,718 | 6,938,983 | 6,938,991 | 7,226,145 | 7,140,719 |
| 6,988,788 | 7,022,250 | 6,929,350 | 7,011,393 | 7,004,566 |
| 7,175,097 | 6,948,799 | 7,143,944 | 7,310,157 | 7,029,100 |
| 6,957,811 | 7,073,724 | 7,055,933 | 7,077,490 | 7,055,940 |
| 10/991,402 | 7,234,645 | 7,032,999 | 7,066,576 | 7,229,150 |
| 7,086,728 | 7,246,879 | 7,284,825 | 7,140,718 | 7,284,817 |
| 7,144,098 | 7,044,577 | 7,284,824 | 7,284,827 | 7,189,334 |
| 7,055,935 | 7,152,860 | 11/203,188 | 11/203,173 | 11/202,343 |
| 7,213,989 | 11/225,156 | 11/225,173 | 7,300,141 | 7,114,868 |
| 7,168,796 | 7,159,967 | 11/272,425 | 7,152,805 | 11/298,530 |
| 11/330,061 | 7,133,799 | 11/330,054 | 11/329,284 | 7,152,956 |
| 7,128,399 | 7,147,305 | 7,287,702 | 11/442,160 | 7,246,884 |
| 7,152,960 | 11/442,125 | 11/454,901 | 11/442,134 | 11/450,441 |
| 11/474,274 | 11/499,741 | 7,270,399 | 6,857,728 | 6,857,729 |
| 6,857,730 | 6,989,292 | 7,126,216 | 6,977,189 | 6,982,189 |
| 7,173,332 | 7,026,176 | 6,979,599 | 6,812,062 | 6,886,751 |
| 10/804,057 | 10/804,036 | 7,001,793 | 6,866,369 | 6,946,743 |
| 10/804,048 | 6,886,918 | 7,059,720 | 7,306,305 | 10/846,562 |
| 10/846,647 | 10/846,649 | 10/846,627 | 6,951,390 | 6,981,765 |
| 6,789,881 | 6,802,592 | 7,029,097 | 6,799,836 | 7,048,352 |
| 7,182,267 | 7,025,279 | 6,857,571 | 6,817,539 | 6,830,198 |
| 6,992,791 | 7,038,809 | 6,980,323 | 7,148,992 | 7,139,091 |
| 6,947,173 | 7,101,034 | 6,969,144 | 6,942,319 | 6,827,427 |
| 6,984,021 | 6,984,022 | 6,869,167 | 6,918,542 | 7,007,852 |
| 6,899,420 | 6,918,665 | 6,997,625 | 6,988,840 | 6,984,080 |
| 6,845,978 | 6,848,687 | 6,840,512 | 6,863,365 | 7,204,582 |
| 6,921,150 | 7,128,396 | 6,913,347 | 7,008,819 | 6,935,736 |
| 6,991,317 | 7,284,836 | 7,055,947 | 7,093,928 | 7,100,834 |
| 7,270,396 | 7,187,086 | 7,290,856 | 7,032,825 | 7,086,721 |
| 7,159,968 | 7,010,456 | 7,147,307 | 7,111,925 | 11/144,812 |
| 7,229,154 | 11/505,849 | 11/520,570 | 11/520,575 | 11/546,437 |
| 11/540,575 | 11/583,937 | 7,278,711 | 7,290,720 | 11/592,207 |
| 11/635,489 | 11/604,319 | 11/635,490 | 11/635,525 | 7,287,706 |
| 11/706,366 | 11/706,310 | 11/706,308 | 11/785,108 | 11/744,214 |
| 11/744,218 | 11/748,485 | 11/748,490 | 11/764,778 | 11/766,025 |
| 11/834,635 | 11/839,541 | 11/860,420 | 11/865,693 | 11/863,118 |
| 11/866,307 | 11/866,340 | 11/869,684 | 11/869,722 | 11/869,694 |
| 11/876,592 | 11/945,244 | 11/951,121 | 11/945,238 | 11/955,358 |
| 11/965,710 | 11/962,050 | | | |

BACKGROUND OF THE INVENTION

The Applicant has developed a wide range of printers that use pagewidth printheads instead of traditional reciprocating printhead designs. The pagewidth designs increase print speeds as the printhead does not traverse back and forth across the page to deposit a line of an image. The pagewidth printhead simply deposits the ink on the media as it moves past at high speeds. Such printheads have made it possible to perform 1600 dpi resolution printing at speeds in the vicinity of 60 pages per minute; speeds previously not attainable with conventional inkjet printers.

The high print speeds require a large ink supply flowrate. Not only are the flow rates higher but distributing the ink along the entire length of a pagewidth printhead is more complex than feeding ink to a relatively small reciprocating printhead.

To prolong the life of the printhead, most inkjet printers will incorporate some type of maintenance facility. This may be as simple as capping the printhead when it is not in use. Capping a printhead will stop the ink on the nozzles from drying out. However it does not clean any paper dust or other contaminants that may have adhered to be nozzle face. The most effective way to remove these particles is by wiping the nozzle face with a suitable surface. Removing the dust and contaminants using a wiping surface cleans the nozzle face but eventually the wiping surface itself will need to be cleaned. The Applicant has developed a printhead maintenance facility with an absorbent pad to clean the wiping surface, but the ordinary worker will appreciate that cleaning wiping surface is not required every time the nozzle face is wiped. Similarly, the wiping surface may be adequately cleaned by a single traverse across the absorbent pad. However in other cases, it will need to be drawn across the absorbent pad several times.

In conventional printers, the maintenance regime from the printhead is a set of steps that are carried out in a predetermined order. If just one of those steps needs to be repeated, the printer repeats the entire maintenance regime. This extends the time required to adequately clean the printhead and can be excessively wasteful if the nozzles purge ink unnecessarily.

SUMMARY OF THE INVENTION

Accordingly, the present invention provides a printhead maintenance facility for an inkjet printer having a pagewidth printhead and a media path for feeding sheets of media substrate in a media feed direction, the pagewidth printhead having a nozzle face defining an elongate array of nozzles extending the printing width of the media substrate, the printhead maintenance facility comprising:

a wiper member extending the length of the nozzle array;

a chassis for supporting the wiper member; and, a maintenance drive has a first actuator for moving the wiper member towards or away from the nozzle face, and a second actuator for rotating wiper member about an axis extending transverse to the media feed direction; wherein, the first actuator and the second actuator are independently operable.

The ability to independently operate the different drives within the maintenance facility gives the user a wide range of cleaning options. The versatility provided by separate independent drives allows the maintenance regime can focus on the maintenance problems that are currently relevant while skipping any maintenance procedures that are not required at the time.

Preferably, the second actuator is configured to selectively rotate the wiper member in either direction about the axis extending transverse to the media feed direction. Preferably, the second actuator is configured to selectively vary the speed with which the wiper member is rotated about the axis extending transverse to the media feed direction. Conveniently, the first actuator and the second actuator are both electric motors with encoder disks providing feedback to a print engine controller in the inkjet printer.

In a further preferred form, the first actuator is configured to apply a force to the chassis at a first bearing point proximate one end of the wiper member, and configured to apply an equal moving force to the chassis at a second bearing point proximate the other end of the wiper member wherein, the first bearing point and the second bearing point are equidistant from a longitudinal mid-point of the wiper member.

Preferably, the maintenance drive has a first arm engaging the first bearing point and a second arm engaging the second bearing point, the maintenance drive also having a first cam and a second cam, the first cam engaging the first arm and the second cam engaging the second arm, the first and second cam is being mounted for rotation on a common shaft. In a further preferred form, the maintenance drive has a first actuator for rotating the chassis about an axis extending transverse to the media feed direction. In a particularly preferred form, the maintenance drive has a second actuator for rotating the common shaft such that the first actuator and the second actuator can operate independently. Preferably, the wiper member has a plurality of resilient blades extending the width of media substrate. Preferably the plurality of blades are arranged in parallel rows, each of the rows extending the width of media substrate. In a further preferred form, the blades in one of the parallel rows positioned such that they are not in registration with the blades an adjacent one of the parallel rows. In particularly preferred form, blades in each of the parallel rows are spaced from their adjacent blades by a gap allowing independent movement of adjacent blades.

In some embodiments, the maintenance drive is configured to move the wiper member past the printhead in the media feed direction and opposite the media feed direction. Preferably the chassis is a tubular chassis, the wiper member being mounted to the tubular chassis exterior. In some embodiments, the maintenance facility further comprises a blotter mounted to the tubular chassis exterior. In a further preferred form, the maintenance facility further comprises a capper and print platen mounted to the tube and the chassis exterior. Preferably the tubular chassis has porous material in central cavity and apertures to establish fluid communication between the wiper member and the porous material. In particular preferred form, the wiper member is a molded elastomeric element.

Preferably, the printhead maintenance facility further comprises an absorbent pad extending the length of the wiper member such that the maintenance drive moves the wiper member across the absorbent pad after the wiper member has wiped the nozzle face. In some embodiments, the second actuator moves the wiper member across the absorbent pad repeatedly while the first actuator holds the chassis away from the nozzle face so as not contact wiper member. Preferably, the absorbent pad has a cleaning surface which contacts the wiper member, the contact surface being covered with a woven material having stranded less than two deniers. In a further preferred form, the woven material is a blend of polyester and polyamide. In a particularly preferred embodiment the woven material is microfibre. In some embodiments, the absorbent pad has a foam core.

In a further preferred form the printhead maintenance facility further comprises a doctor blade extending transverse to the media feed direction, wherein during use the maintenance drive moves the wiper member over the nozzle face, then across the absorbent pad and then past the doctor blade such that the resilient blade flexes in order to pass the doctor blade and upon disengagement of the resilient blade and the doctor blade, the resilient blade springs back to its quiescent shape thereby projecting contaminants from its surface.

BRIEF DESCRIPTION OF THE DRAWINGS

Preferred embodiments of the invention will now be described by way of example only, with reference to the accompanying figures, in which.

DETAILED DESCRIPTION OF PREFERRED EMBODIMENTS

Printer Fluidic System

Figure 1:
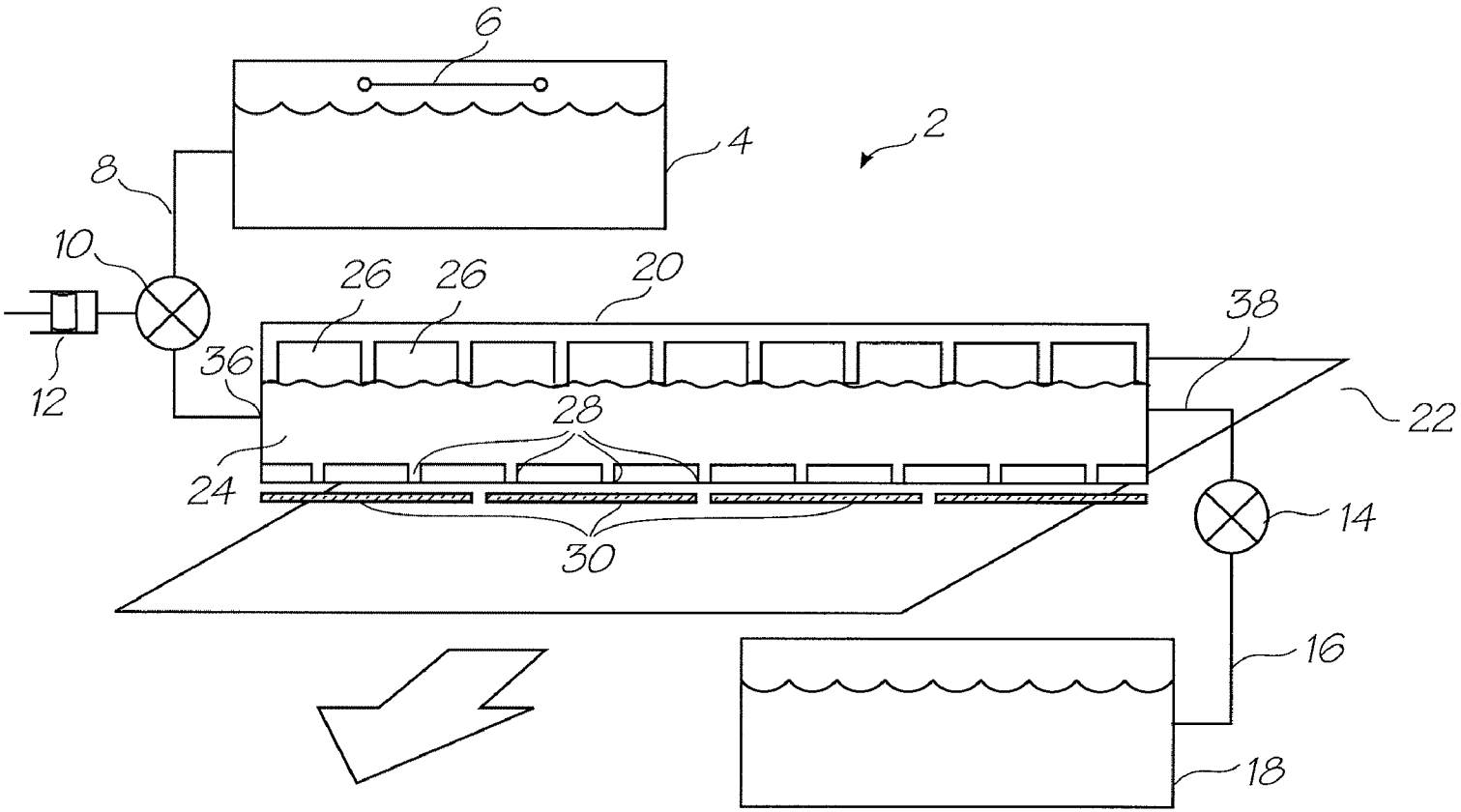
FIG. 1 is schematic overview of the printer fluidic system.
Figure 2A:
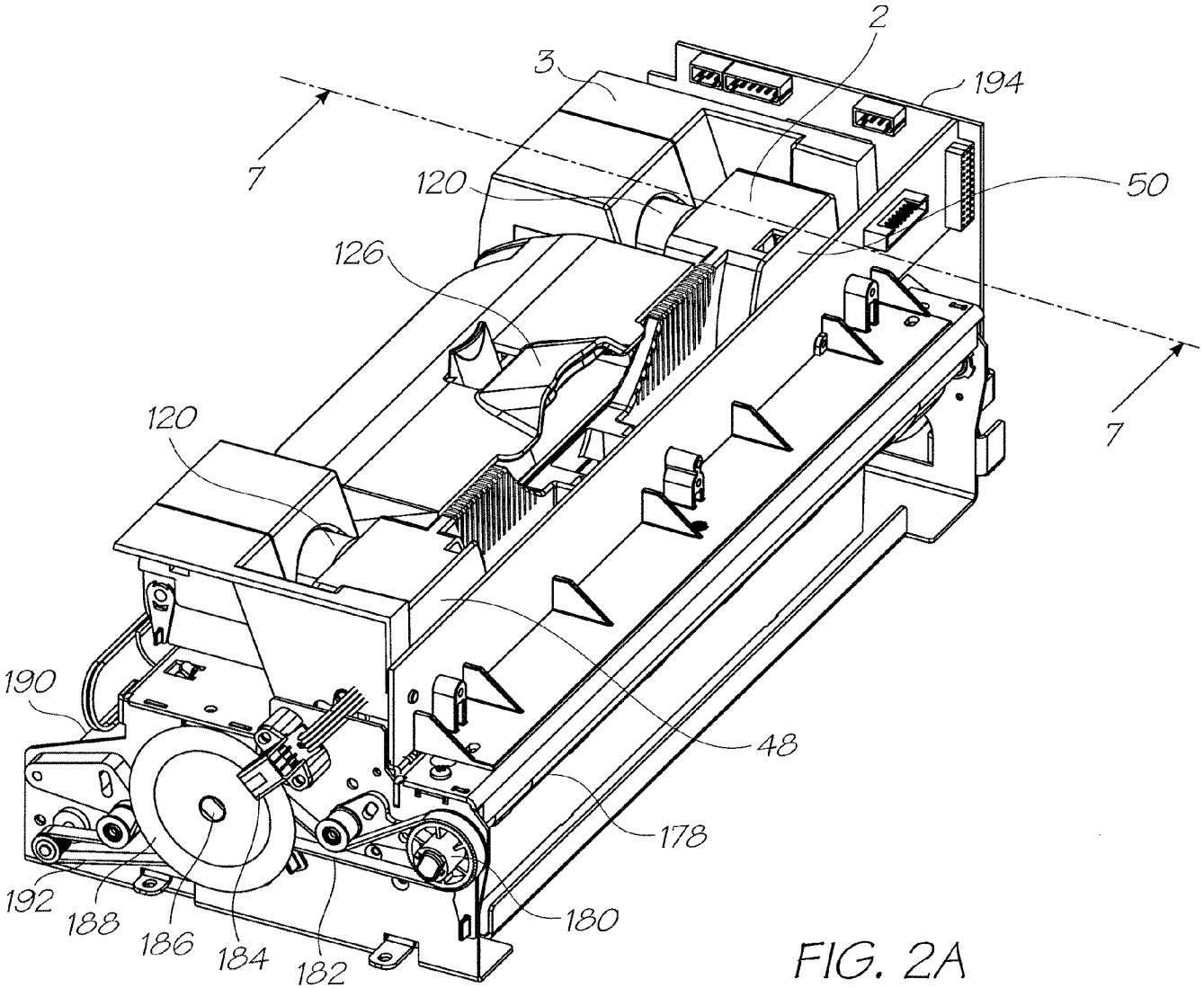
FIG. 2A is a perspective of the printhead cartridge of the present invention installed the print engine of a printer.
Figure 2B:
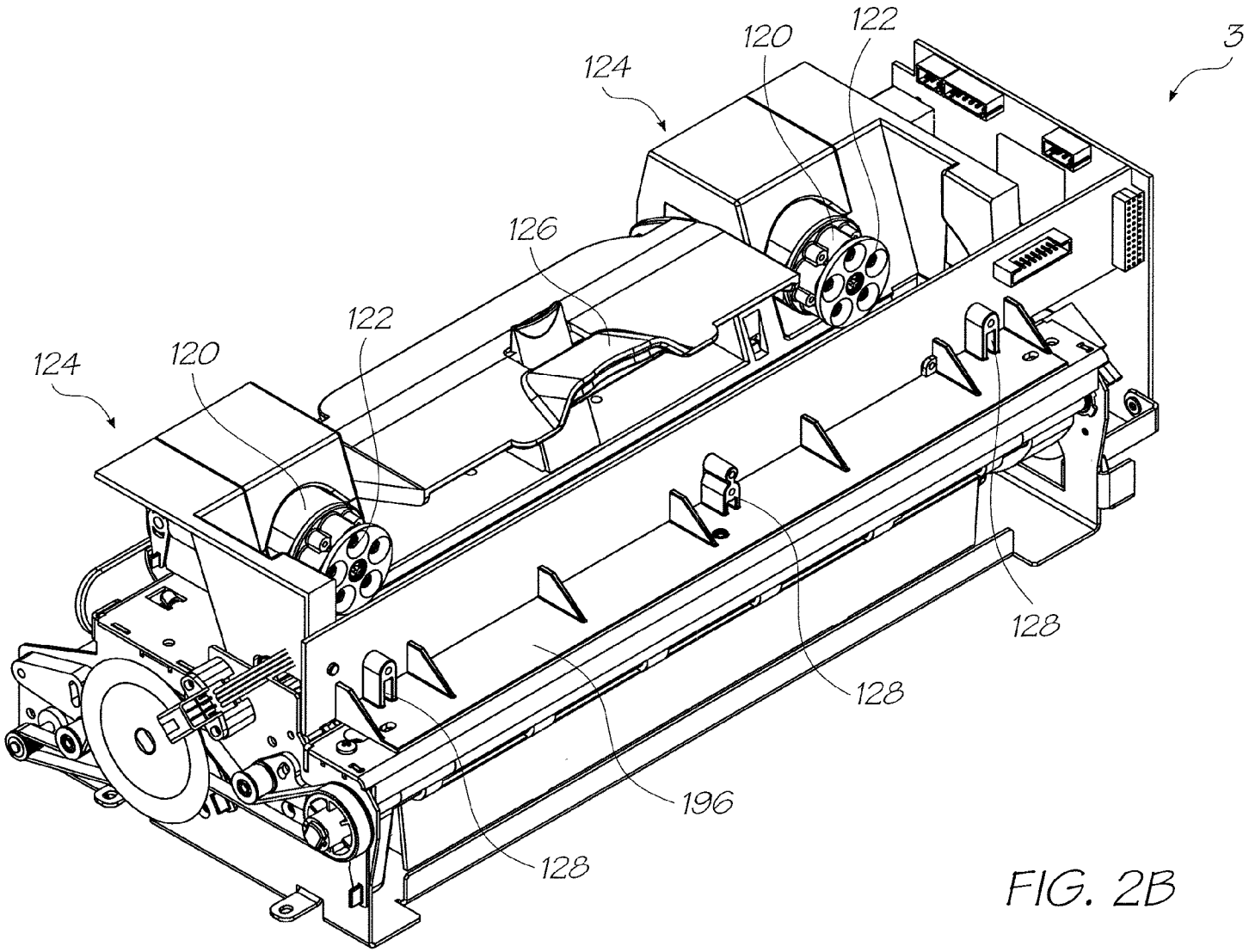
FIG. 2B shows the print engine without the printhead cartridge installed to expose the inlet and outlet ink couplings.

FIG. 1 is a schematic overview of the fluidic system used by the print engine described in FIGS. 2A and 2B. As previously discussed, the print engine has the key mechanical structures of an inkjet printer. The peripheral structures such as the outer casing, the paperfeed tray, paper collection tray and so on are configured to suit the specific printing requirements of the printer (for example, the photo printer, the network printer or Soho printer). The Applicant's photo printer disclosed in the co-pending application U.S. Ser. No. 11/688863 is an example of an inkjet printer using a fluidic system according to FIG. 1. The contents of this disclosure are incorporated herein by reference. The operation of the system and its individual components are described in detail in U.S. Ser. No. 11/872719 the contents of which are incorporated herein by reference.

Briefly, the printer fluidic system has a printhead assembly 2 supplied with ink from an ink tank 4 via an upstream ink line 8. Waste ink is drained to a sump 18 via a downstream ink line 16. A single ink line is shown for simplicity. In reality, the printhead has multiple ink lines for full colour printing. The upstream ink line 8 has a shut off valve 10 for selectively isolating the printhead assembly 2 from the pump 12 and or the ink tank 4. The pump 12 is used to actively prime or flood the printhead assembly 2. The pump 12 is also used to establish a negative pressure in the ink tank 4. During printing, the negative pressure is maintained by the bubble point regulator 6.

The printhead assembly 2 is an LCP (liquid crystal polymer) molding 20 supporting a series of printhead ICs 30 secured with an adhesive die attach film (not shown). The printhead ICs 30 have an array of ink ejection nozzles for ejecting drops of ink onto the passing media substrate 22. The nozzles are MEMS (micro electro-mechanical) structures printing at true 1600 dpi resolution (that is, a nozzle pitch of 1600 npi), or greater. The fabrication and structure of suitable printhead IC's 30 are described in detail in U.S. Ser. No. 11/246687 the contents of which are incorporated by reference. The LCP molding 20 has a main channel 24 extending between the inlet 36 and the outlet 38. The main channel 24 feeds a series of fine channels 28 extending to the underside of the LCP molding 20. The fine channels 28 supply ink to the printhead ICs 30 through laser ablated holes in the die attach film.

Above the main channel 24 is a series of non-priming air cavities 26. These cavities 26 are designed to trap a pocket of air during printhead priming. The air pockets give the system some compliance to absorb and damp pressure spikes or hydraulic shocks in the ink. The printers are high speed page-width printers with a large number of nozzles firing rapidly. This consumes ink at a fast rate and suddenly ending a print job, or even just the end of a page, means that a column of ink moving towards (and through) the printhead assembly 2 must be brought to rest almost instantaneously. Without the compliance provided by the air cavities 26, the momentum of the ink would flood the nozzles in the printhead ICs 30. Furthermore, the subsequent 'reflected wave' can generate a negative pressure strong enough to deprime the nozzles.

Print Engine

FIG. 2A shows a print engine 3 of the type that uses a print cartridge 2. The print engine 3 is the internal structure of an inkjet printer and therefore does not include any external casing, ink tanks or media feed and collection trays. The printhead cartridge 2 is inserted and removed by the user lifting and lowering the latch 126. The print engine 3 forms an electrical connection with contacts on the printhead cartridge 2 and a fluid coupling is formed via the sockets 120 and the inlet and outlet manifolds, 48 and 50 respectively.

Sheets of media are fed through the print engine by the main drive roller 186 and the exit feed roller 178. The main drive roller 186 is driven by the main drive pulley and encoder disk 188. The exit feed roller 178 is driven by the exit drive pulley 180 which is synchronized to the main drive pulley 188 by the media feed belt 182. The main drive pulley 188 is powered by the media feed motor 190 via the input drive belt 192.

The main drive pulley 188 has an encoder disk which is read by the drive pulley sensor 184. Data relating to the speed and number of revolutions of the drive shafts 186 and 178 is sent to the print engine controller (or PEC). The PEC (not shown) is mounted to the main PCB 194 (printed circuit board) and is the primary micro-processor for controlling the operation of the printer.

FIG. 2B shows the print engine 3 with the printhead cartridge removed to reveal the apertures 122 in each of the sockets 120. Each aperture 122 receives one of the spouts 52 (see FIG. 5) on the inlet and outlet manifolds. As discussed above, the ink tanks have an arbitrary position and configuration but simply connect to hollow spigots 124 (see FIG. 8) at the rear of the sockets 120 in the inlet coupling. The spigot 124 at the rear of the outlet coupling leads to the waste ink outlet in the sump 18 (see FIG. 1).

Reinforced bearing surfaces 128 are fixed to the pressed metal casing 196 of the print engine 3. These provide reference points for locating the printhead cartridge within the print engine. They are also positioned to provide a bearing surface directly opposite the compressive loads acting on the cartridge 2 when installed. The fluid couplings 120 push against the inlet and outlet manifolds of the cartridge when the manifold spouts (described below) open the shut off valves in the print engine (also described below). The pressure of the latch 126 on the cartridge 2 is also directly opposed by a bearing surface 128. Positioning the bearing surfaces 128 directly opposite the compressive loads in the cartridge 2, the flex and deformation in the cartridge is reduced. Ultimately, this assists the precise location of the nozzles relative to the media feed path. It also protects the less robust structures within the cartridge from damage.

Printhead Cartridge

Figure 3:
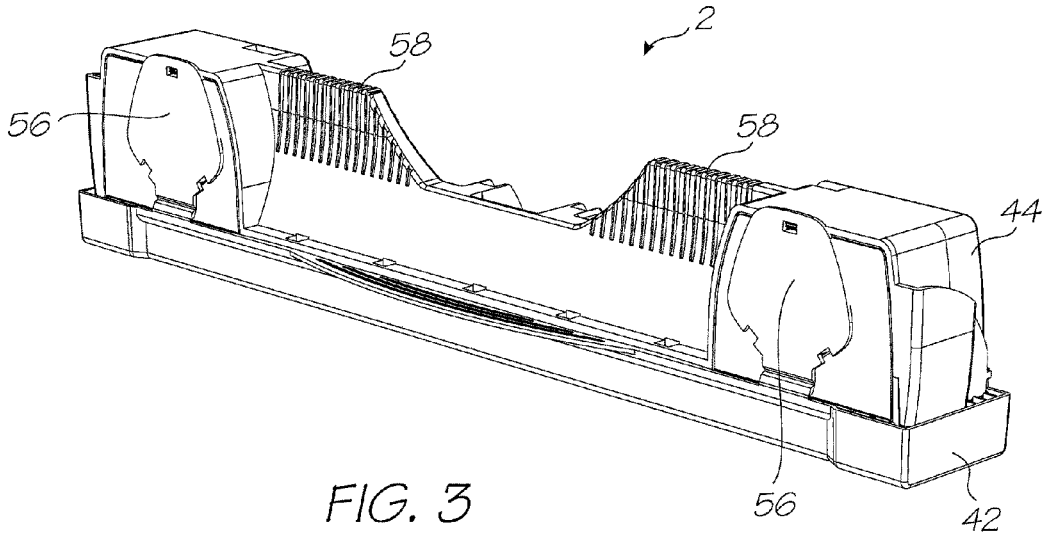
FIG. 3 is a perspective of the complete printhead cartridge according to the present invention.

FIG. 3 is a perspective of the complete printhead cartridge 2. The printhead cartridge 2 has a top molding 44 and a removable protective cover 42. The top molding 44 has a central web for structural stiffness and to provide textured grip surfaces 58 for manipulating the cartridge during insertion and removal. The base portion of the protective cover 42 protects the printhead ICs (not shown) and line of contacts (not shown) prior to installation in the printer. Caps 56 are integrally formed with the base portion and cover the ink inlets and outlets (see 54 and 52 of FIG. 5).

Figure 4:
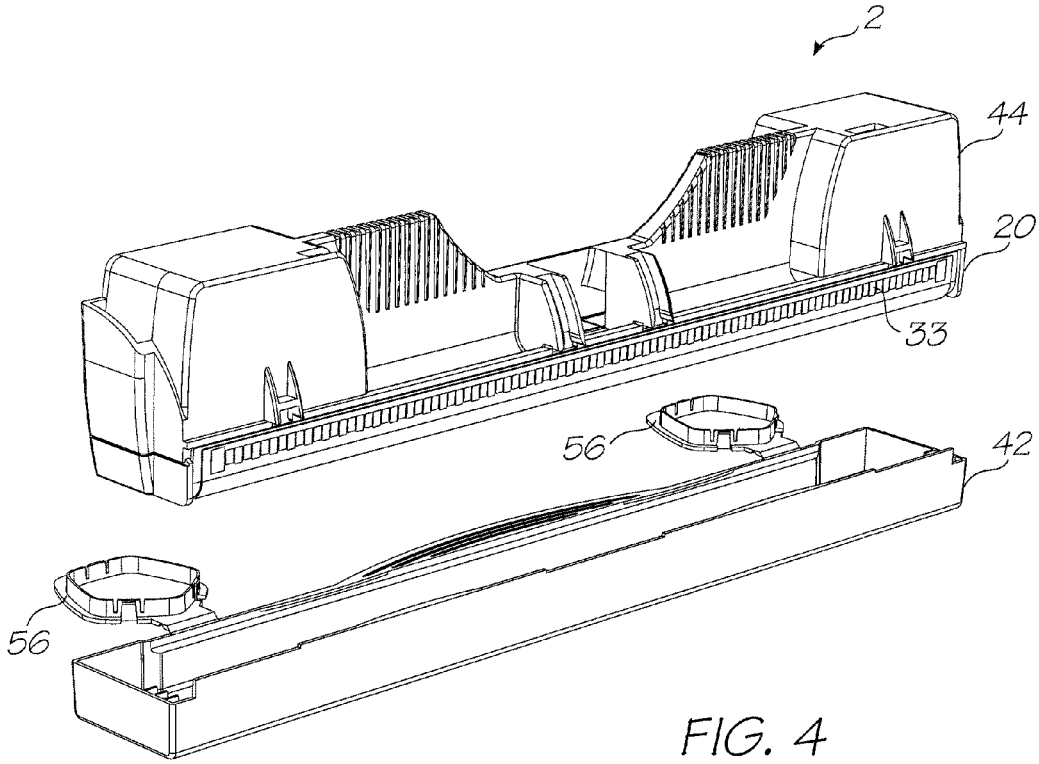
FIG. 4 shows the printhead cartridge of FIG. 3 with the protective cover removed.
Figure 5:
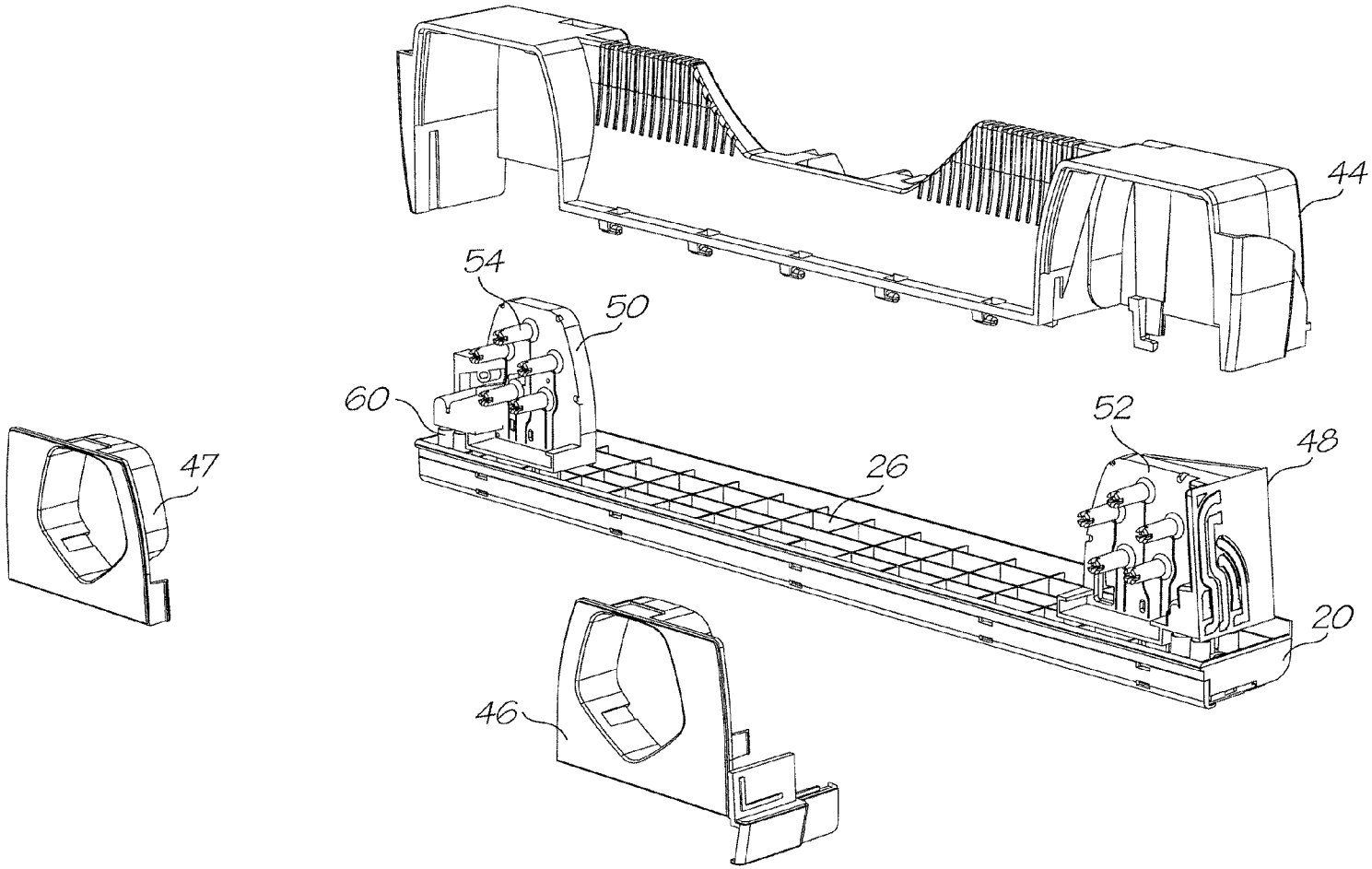
FIG. 5 is an exploded is a partial perspective of the printhead assembly within the printhead cartridge of FIG. 3.

FIG. 4 shows the printhead assembly 2 with its protective cover 42 removed to expose the printhead ICs on the bottom surface and the line of contacts 33 on the side surface. The protective cover is discarded to the recycling waste or fitted to the printhead cartridge being replaced to contain leakage from residual ink. FIG. 5 is a partially exploded perspective of the printhead assembly 2. The top cover 44 has been removed reveal the inlet manifold 48 and the outlet manifold 50. The inlet and outlet shrouds 46 and 47 have been removed to better expose the five inlet and outlet spouts (52 and 54). The inlet and outlet manifolds 48 and 50 form a fluid connection between each of the individual inlets and outlets and the corresponding main channel (see 24 in FIG. 6) in the LCP molding. The main channel extends the length of the LCP molding and it feeds a series of fine channels on the underside of the LCP molding. A line of air cavities 26 are formed above each of the main channels 24. As explained above in relation to FIG. 1, any shock waves or pressure pulses in the ink are damped by compressing the air the air cavities 26.

Figure 6:
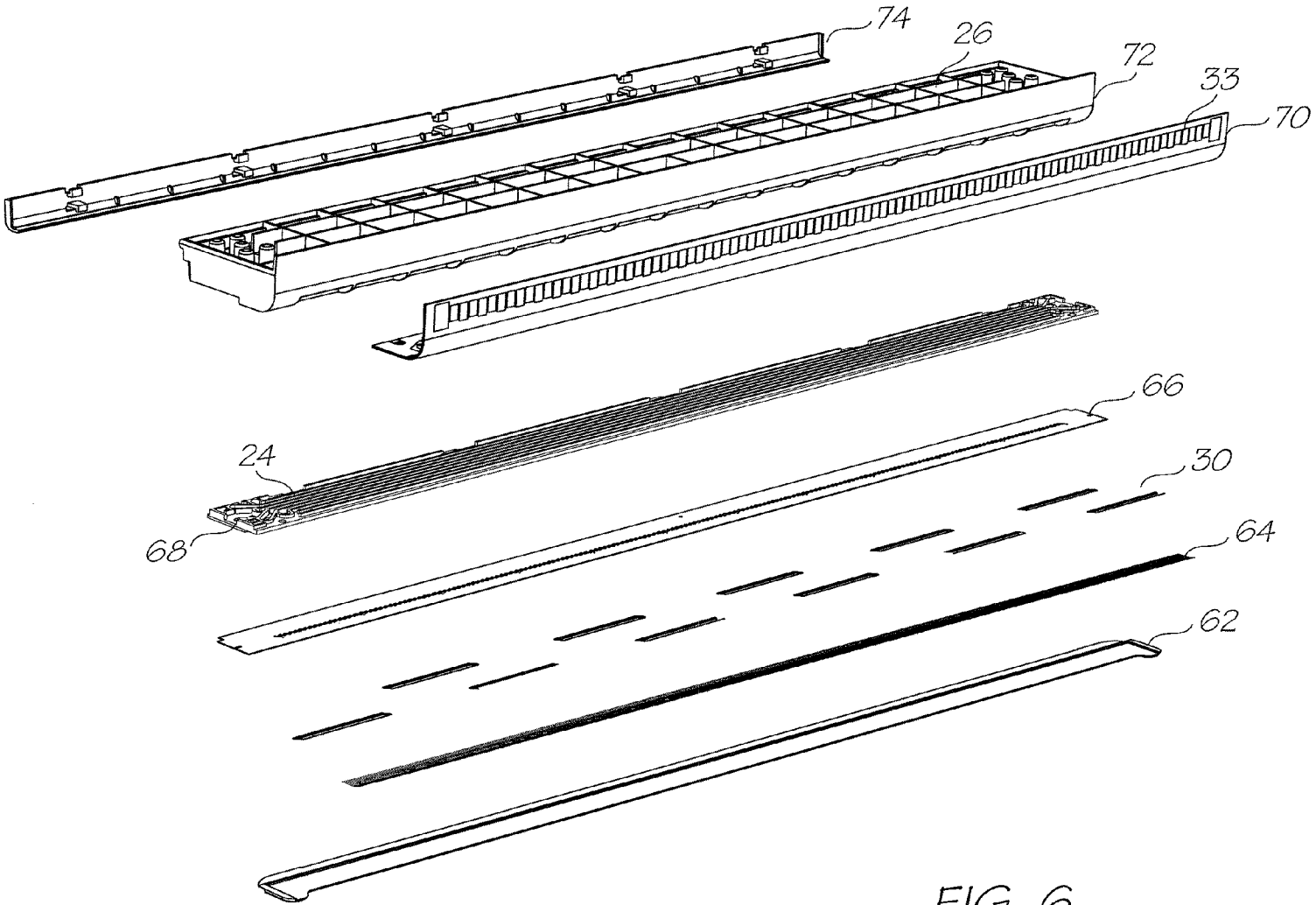
FIG. 6 is an exploded perspective of the printhead assembly without the inlet or outlet manifolds or the top cover molding.

FIG. 6 is an exploded perspective of the printhead assembly without the inlet or outlet manifolds or the top cover molding. The main channels 24 for each ink color and their associated air cavities 26 are formed in the channel molding 68 and the cavity molding 72 respectively. Adhered to the bottom of the channel molding 68 is a die attach film 66. The die attach film 66 mounts the printhead ICs 30 to the channel molding such that the fine channels on the underside of the channel molding 68 are in fluid communication with the printhead ICs 30 via small laser ablated holes through the film.

Both the channel molding 68 and the top cover molding 72 are molded from LCP (liquid crystal polymer) because of its stiffness and coefficient of thermal expansion that closely matches that of silicon. It will be appreciated that a relatively long structure such as a pagewidth printhead should minimize any thermal expansion differences between the silicon substrate of the printhead ICs 30 and their supporting structure.

Printhead Maintenance Carousel

Figure 7:
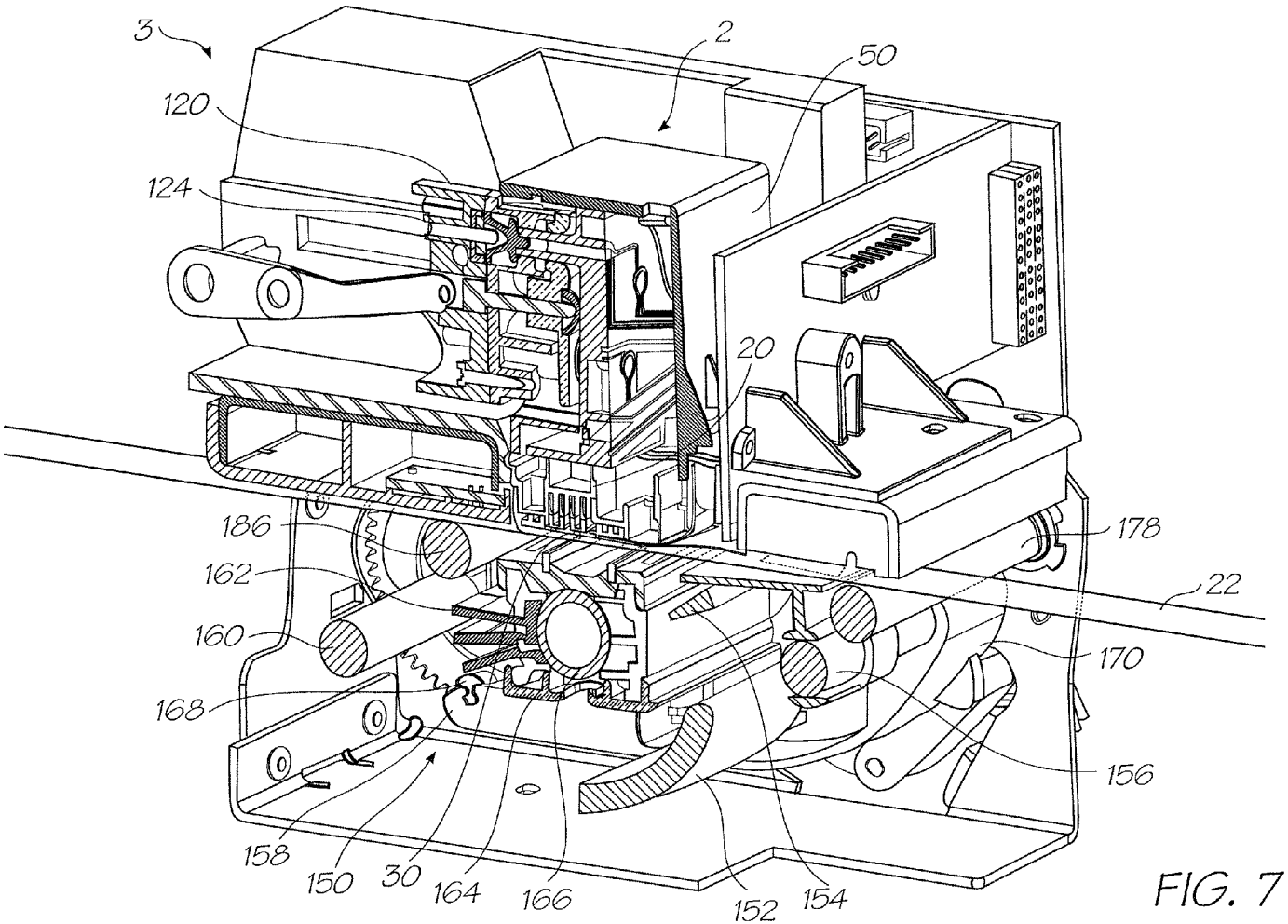
FIG. 7 is a sectional perspective view of the print engine, the section taken through the line 7-7 of FIG. 2A.

Referring to FIG. 7, a sectioned perspective view is shown. The section is taken through line 7-7 shown in FIG. 2A. The printhead cartridge 2 is inserted in the print engine 3 such that its outlet manifold 50 is open to fluid communication with the spigot 124 which leads to a sump in the completed printer (typically situated at the base the print engine). The LCP molding 20 supports the printhead ICs 30 immediately adjacent the media feed path 22 extending through the print engine.

On the opposite side of the media feed path 22 is the printhead maintenance carousel 150 and its associated drive mechanisms. The printhead maintenance carousel 150 is mounted for rotation about the tubular drive shaft 156. The maintenance carousel 150 is also configured for movement towards and away from the printhead ICs 30. By raising the carousel 150 towards the printhead ICs 30, the various printhead maintenance stations on the exterior of the carousel are presented to the printhead. The maintenance carousel 150 is rotatably mounted on a lift structure 170 that is mounted to a lift structure shaft 156 such that it can pivot relative to the remainder of the print engine 3. The lift structure 170 includes a pair of lift arms 158 (only one lift arm is shown, the other being positioned at the opposite end of the lift structure shaft 156). Each lift arm 158 has a cam engaging surface 168, such as a roller or pad of low friction material. The cams (described in more detail below) are fixed to the carousel drive shaft 160 for rotation therewith. The lift arms 158 are biased into engagement with the cams on the carousel lift drive shaft 160, such that the carousel lift motor (described below) can move the carousel towards and away from the printhead by rotating the shaft 160.

The rotation of the maintenance carousel 150 about the tubular shaft 166 is independent of the carousel lift drive. The carousel drive shaft 166 engages the carousel rotation motor (described below) such that it can be rotated regardless of whether it is retracted from, or advanced towards, the printhead. When the carousel is advanced towards the printhead, the wiper blades 162 move through the media feed path 22 in order to wipe the printhead ICs 30. When retracted from the printhead, the carousel 150 can be repeatedly rotated such that the wiper blades 162 engage the doctor blade 154 and the cleaning pad 152. This is also discussed in more detail below.

Figure 8:
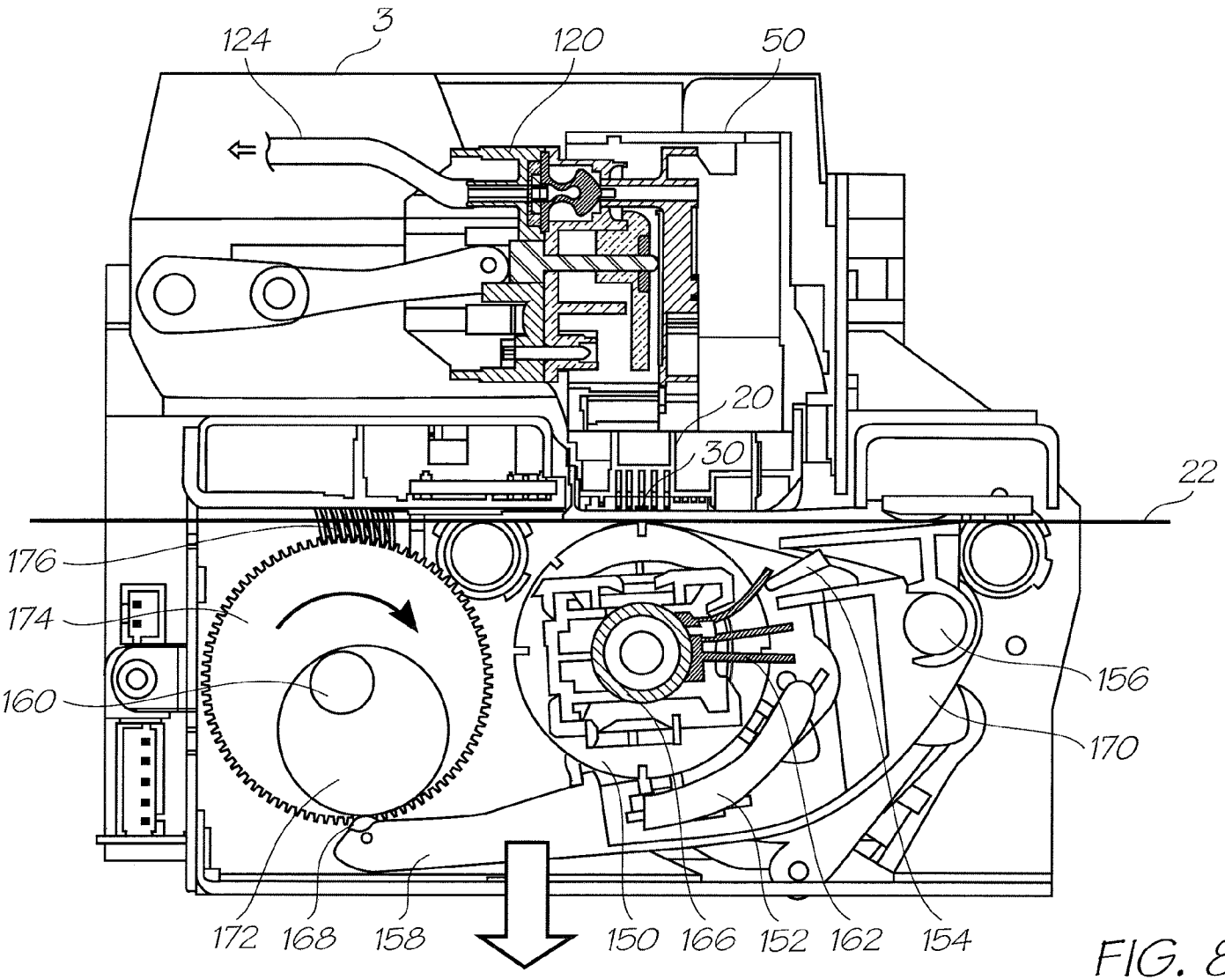
FIG. 8 is a sectional elevation of the print engine taken through line 7-7 of FIG. 2A, showing the maintenance carousel drawing the wiper blades over the doctor blade.

Referring now to FIG. 8, the cross section 7-7 is shown in elevation to better depict the maintenance carousel lift drive. The carousel lift drive shaft 160 is shown rotated such that the lift cam 172 has pushed the lift arms 158 downwards via the cam engaging surface 168. The lift shaft 160 is driven by the carousel lift spur gear 174 which is in turn driven by the carousel lift worm gear 176. The worm gear 176 is keyed to the output shaft of the carousel lift motor (described below).

With the lift arms 158 drawing the lift structure 170 downwards, the maintenance carousel 150 is retracted away from the printhead ICs 30. In this position, the carousel 150 can be rotated with none of the maintenance stations touching the printhead ICs 30. It does, however, bring the wiper blades 162 into contact with the doctor blade 154 and the absorbent cleaning pad 152.

Doctor Blade

The doctor blade 154 works in combination with the cleaning pad 152 to comprehensively clean the wiper blades 162. The cleaning pad 152 wipes paper dust and dried ink from the wiping contact face of the wiper blades 162. However, a bead of ink and other contaminants can form at the tip of the blades 162 where it does not contact the surface of the cleaning pad 152.

To dislodge this ink and dust, the doctor blade 154 is mounted in the print engine 3 to contact the blades 162 after they have wiped the printhead ICs 30, but before they contact the cleaning pad 152. Upon contact with the doctor blade 154, the wiper blades 162 flex into a curved shaped in order to pass. As the wiper blades 162 are an elastomeric material, they spring back to their quiescent straight shape as soon as they disengage from the doctor blade 154. Rapidly springing back to their quiescent shape projects dust and other contaminants from the wiper blade 162, and in particular, from the tip.

The ordinary worker will appreciate that the wiper blades 162 also flex when they contact the cleaning pad 152, and likewise spring back to their quiescent shapes once disengaged from the pad. However, the doctor blade 154 is mounted radially closer to the central shaft 166 of the carousel 150 than the cleaning pad 152. This bends the wiper blades 162 more as they pass, and so imparts more momentum to the contaminants when springing back to the quiescent shape. It is not possible to simply move the cleaning pad 152 closer to the carousel shaft 166 to bend the wiper blades 162 more, as the trailing blades would not properly wipe across the cleaning pad 152 because of contact with the leading blades.

Cleaning Pad

The cleaning pad 152 is an absorbent foam body formed into a curved shape corresponding to the circular path of the wiper blades 162. The pad 152 cleans more effectively when covered with a woven material to provide a multitude of densely packed contacts points when wiping the blades. Accordingly, the strand size of the woven material should be relatively small; say less than 2 deniers. A microfiber material works particularly well with a strand size of about 1 denier.

The cleaning pad 152 extends the length of the wiper blades 162 which in turn extend the length of the pagewidth printhead. The pagewidth cleaning pad 152 cleans the entire length of the wiper blades simultaneously which reduces the time required for each wiping operation. Furthermore the length of the pagewidth cleaning pad inherently provides a large volume of the absorbent material for holding a relatively large amount of ink. With a greater capacity for absorbing ink, the cleaning pad 152 will be replaced less frequently.

Capping the Printhead

Figure 9:
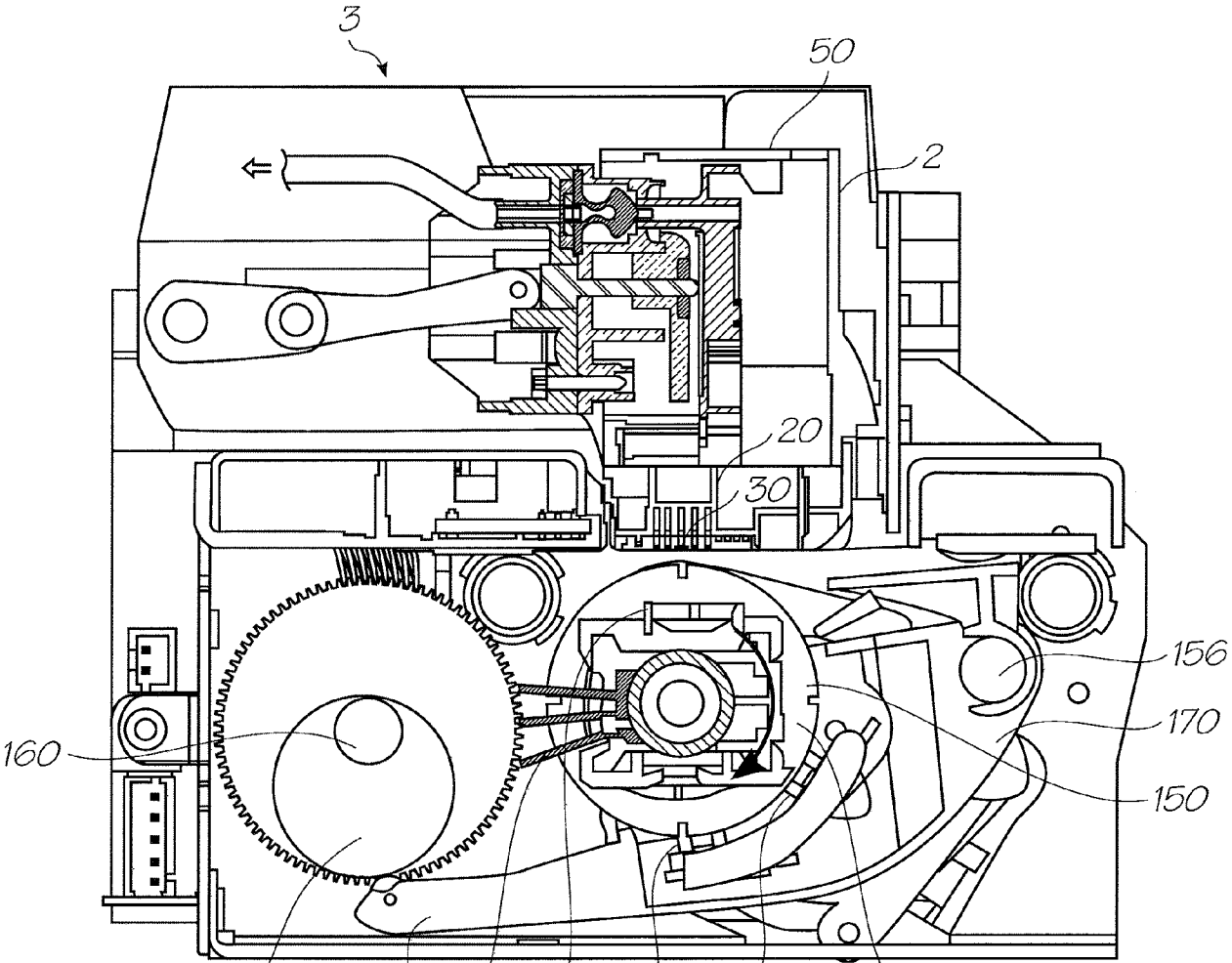
FIG. 9 is a section view showing the maintenance carousel after drawing the wiper blades over the absorbent cleaning pad.

FIG. 9 shows the first stage of capping the printhead ICs 30 with the capping maintenance station 198 mounted to the maintenance carousel 150. The maintenance carousel 150 is retracted away from the printhead ICs 30 as the lift cam 172 pushes down on the lift arms 158. The maintenance carousel 150, together with the maintenance encoder disk 204, are rotated until the first carousel rotation sensor 200 and the second carousel rotation sensor 202 determine that the printhead capper 198 is facing the printhead ICs 30.

Figure 10:
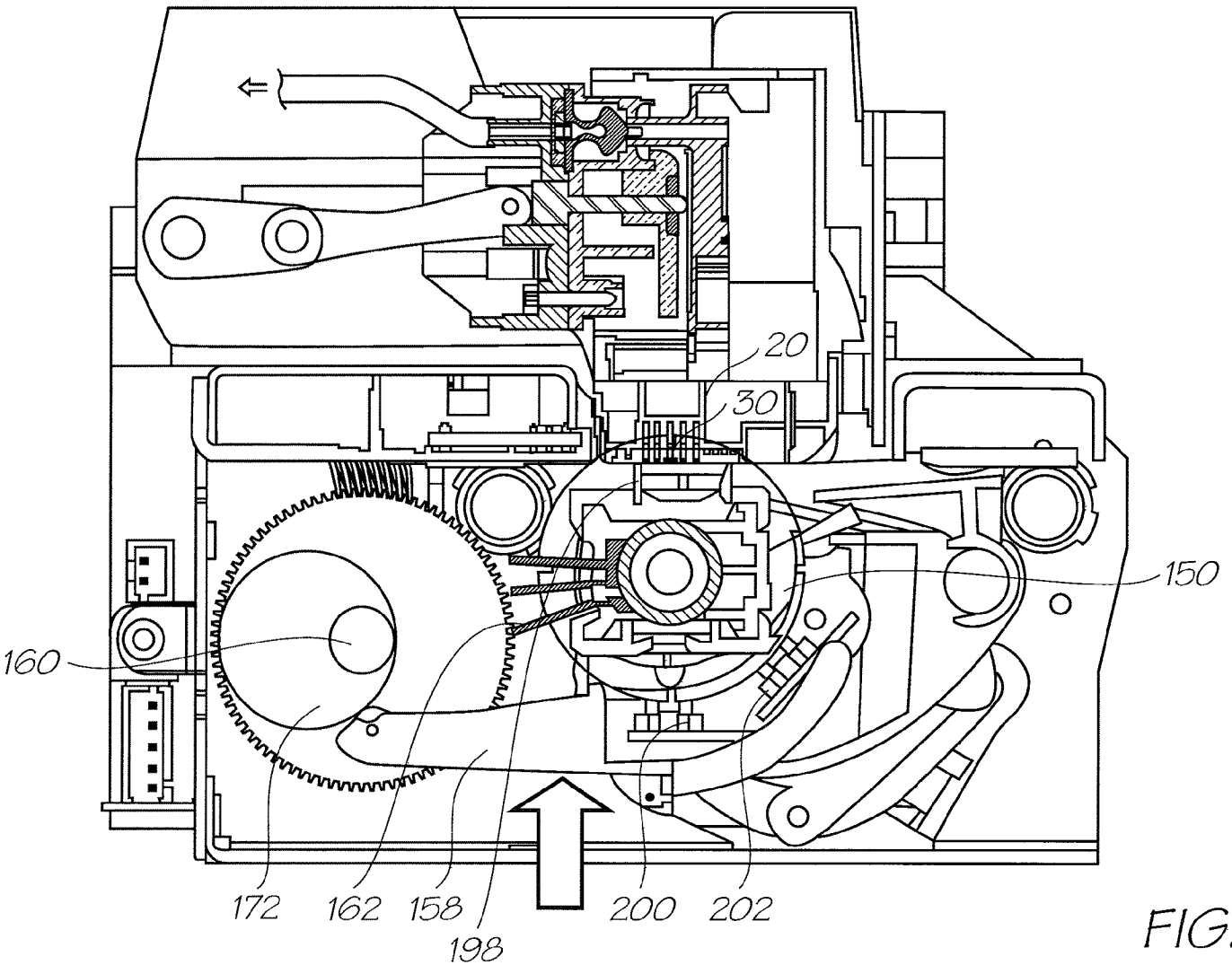
FIG. 10 is a sectional view showing the maintenance carousel being lifted to cap the printhead with the capper maintenance station.

As shown in FIG. 10, the lift shaft 160 rotates the cam 172 so that the lift arms 158 move upwards to advance the maintenance carousel 150 towards the printhead ICs 30. The capper maintenance station 198 engages the underside of the LCP moldings 20 to seal the nozzles of the printhead ICs 30 in a relatively humid environment. The ordinary worker will understand that this prevents, or at least prolongs, the nozzles from drying out and clogging.

Uncapping the Printhead

Figure 11:
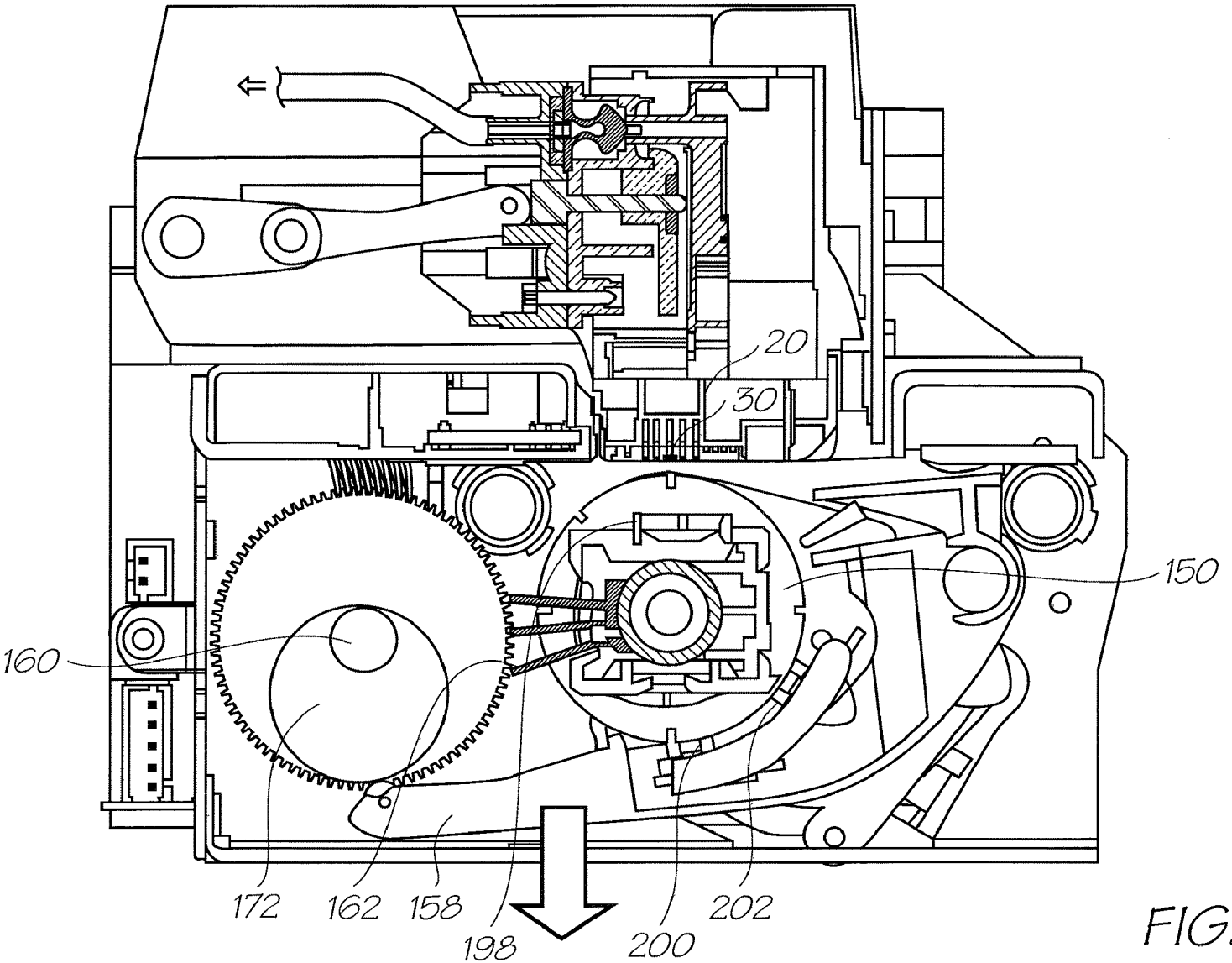
FIG. 11 is a sectional view showing the maintenance carousel being lowered in order to uncap the printhead.

FIG. 11 shows the printhead ICs 30 being uncapped in preparation for printing. The lift shaft 160 is rotated so that the lift cam 172 pushes the carousel lift arms 158 downwards. The capping maintenance station 198 moves away from the LCP molding 20 to expose the printhead ICs 30.

Wiping the Printhead

Figure 12:
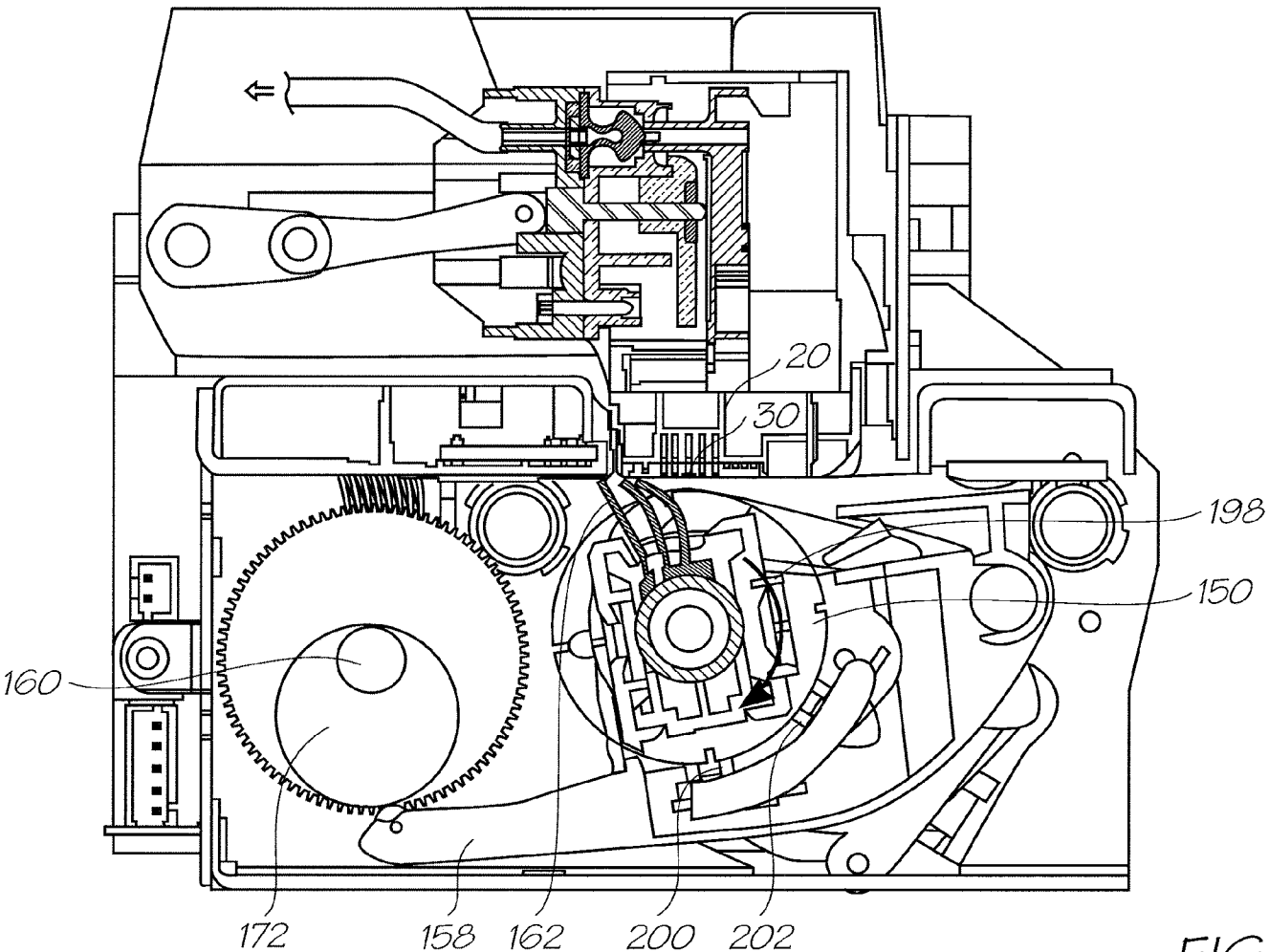
FIG. 12 is a sectional view showing the wiper blades wiping the nozzle face of the printhead.

FIG. 12 shows the printhead ICs 30 being wiped by the wiper blades 162. As the capping station 198 is rotated away from the printhead, the blades of the wiper member 162 contact the underside of the LCP molding 20. As the carousel 150 continues to rotate, the wiper blades and drawn across the nozzle face of the printhead ICs 30 to wipe away any paper dust, dried ink or other contaminants. The wiper blades 162 are formed from elastomeric material so that they resiliently flex and bend as they wipe over the printhead ICs 30. As the tip of each wiper blade is bent over, the side surface of each blade comes into wiping contact with the nozzle face. It will be appreciated that the broad flat side surface of the blades has greater contact with the nozzle face and is more effective at cleaning away contaminants.

Wiper Blade Cleaning

Figure 13:
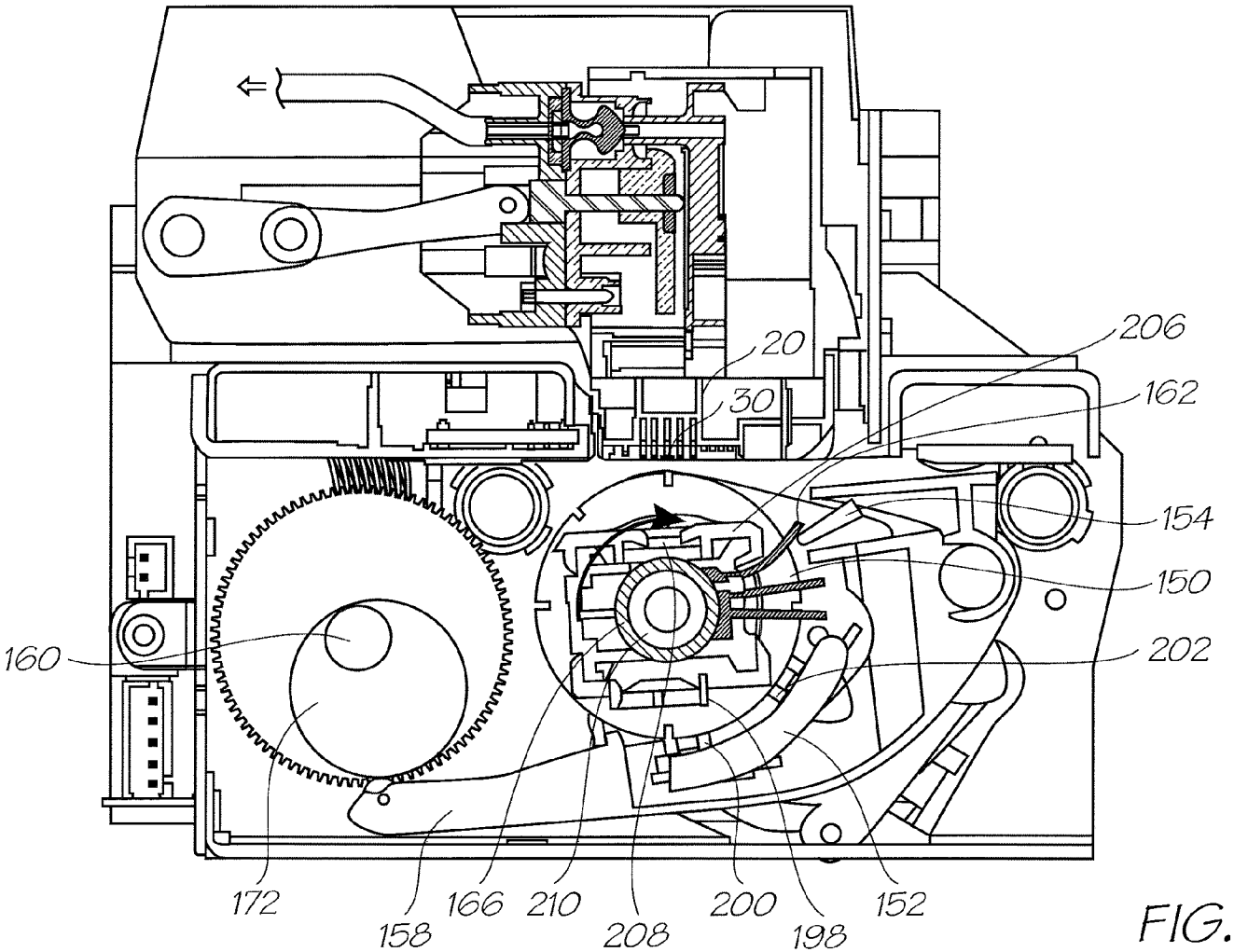
FIG. 13 is a sectional view showing the maintenance carousel rotated back to its initial position shown in FIG. 8 where the wiper blades have been drawn past the doctor blade to flick contaminants of the tip region.
Figure 14:
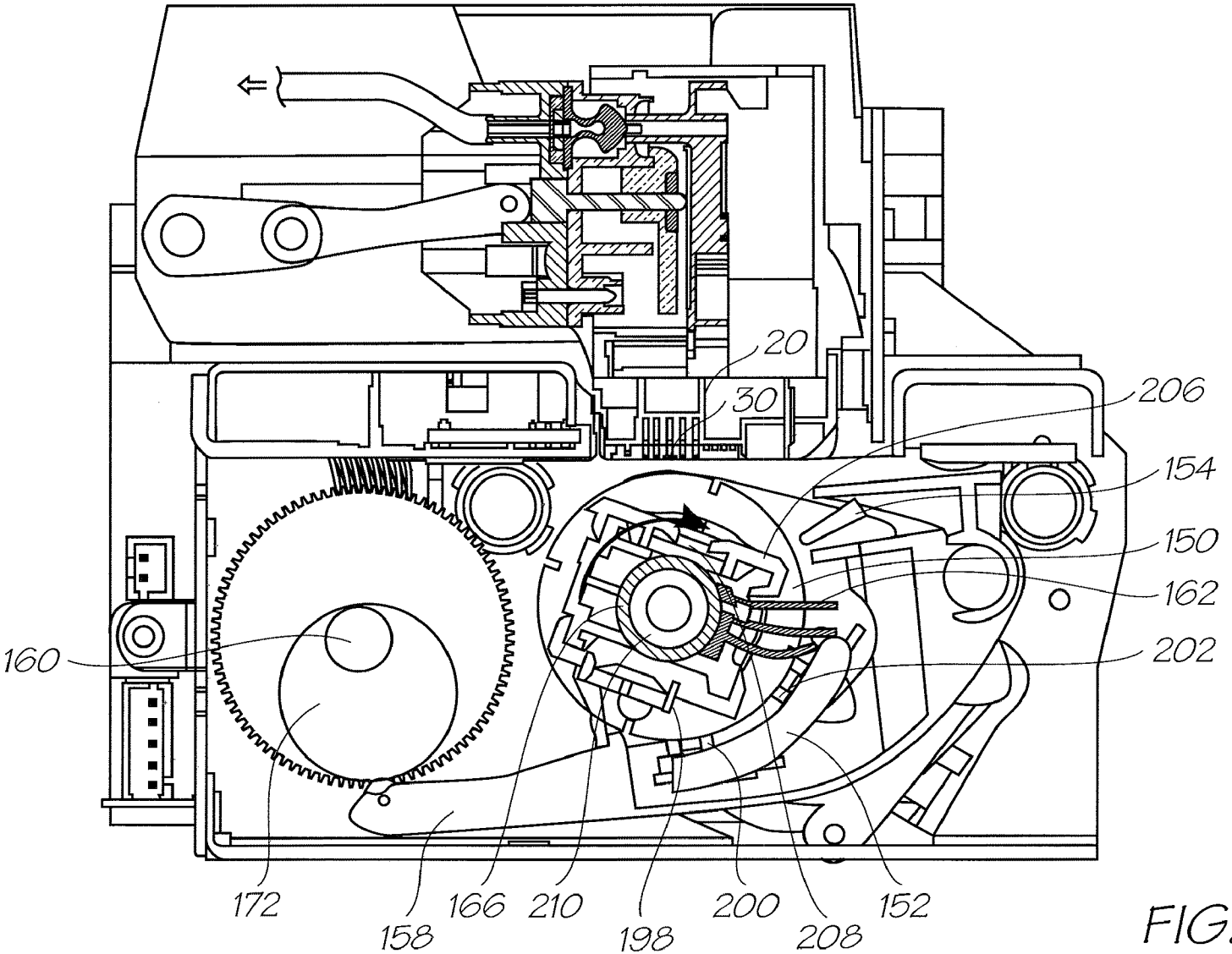
FIG. 14 is a sectional view showing the wiper blades been drawn across the absorbent cleaning pad.

FIGS. 13 and 14 show the wiper blades 162 being cleaned. As shown in FIG. 13, immediately after wiping the printhead ICs 30, the wiper blades 162 are rotated past the doctor blade 154. The function of the doctor blade 154 is discussed in greater detail above under the subheading "Doctor Blade".

After dragging the wiper blades 162 past the doctor blade 154, any residual dust and contaminants stuck to the blades is removed by the absorbent cleaning pad 152. This step is shown in FIG. 14.

During this process the print platen maintenance station 206 is directly opposite the printhead ICs 30. If desired, the carousel can be lifted by rotation of the lift cam 172 so that the nozzles can fire into the absorbent material 208. Any colour mixing at the ink nozzles is immediately purged. Holes (not shown) drilled into the side of the tubular chassis 166 provides a fluid communication between the absorbent material 208 and the porous material 210 within the central cavity of the carousel shaft 166. Ink absorbed by the material 208 is drawn into, and retained by, the porous material 210. To drain the porous material 210, the carousel 150 can be provided with a vacuum attachment point (not shown) to draw the waste ink away.

Figure 15:
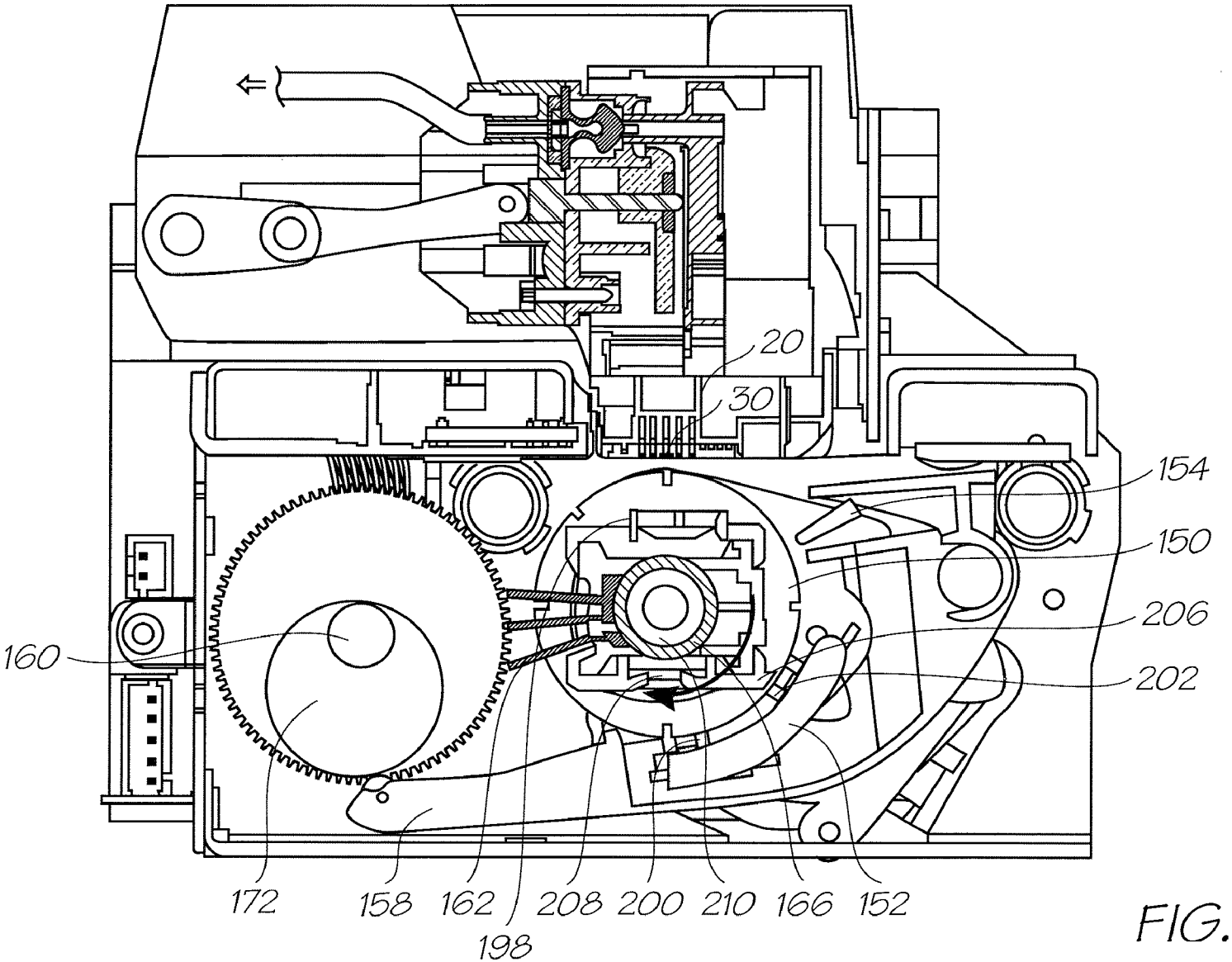
FIG. 15 is a sectional view showing the maintenance carousel rotated to present the printhead capper to the printhead.
Figure 16:
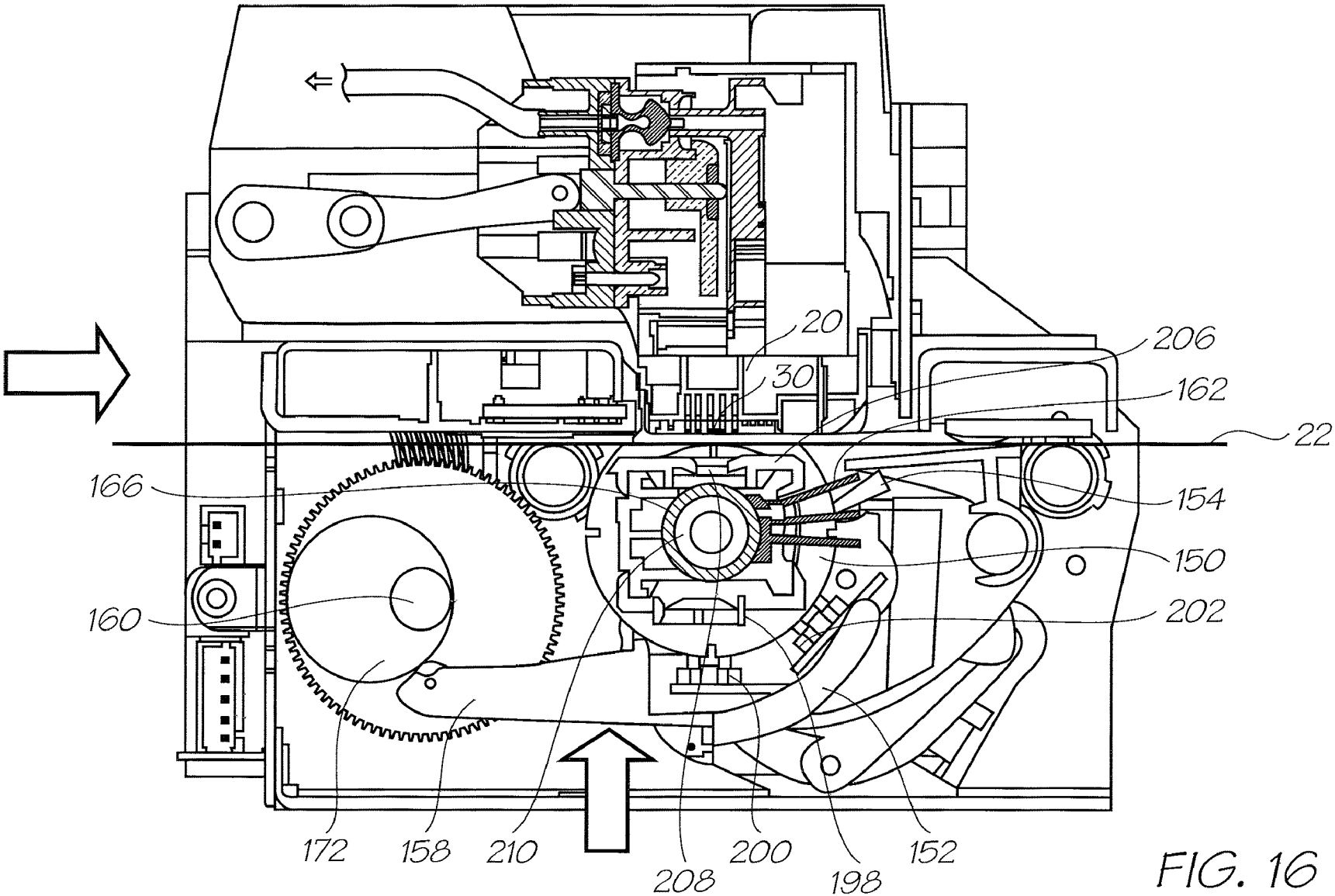
FIG. 16 is a sectional view showing the maintenance carousel being lifted to present the print platen to the printhead.

With the wiper blades clean, the carousel 150 continues to rotate (see FIG. 15) until the print platen 206 is again opposite the printhead ICs 30. As shown in FIG. 16, the carousel is then lifted towards the printhead ICs 30 in readiness for printing. The sheets of media substrate are fed along the media feed path 22 and past the printhead ICs 30. For full bleed printing (printing to the very edges of the sheets of media), the media substrate can be held away from the platen 206 so that it does not get smeared with ink overspray. It will be understood that the absorbent material 208 is positioned within a recessed portion of the print platen 206 so that any overspray ink (usually about one millimeter either side of the paper edges) is kept away from surfaces that may contact the media substrate.

Figure 17:
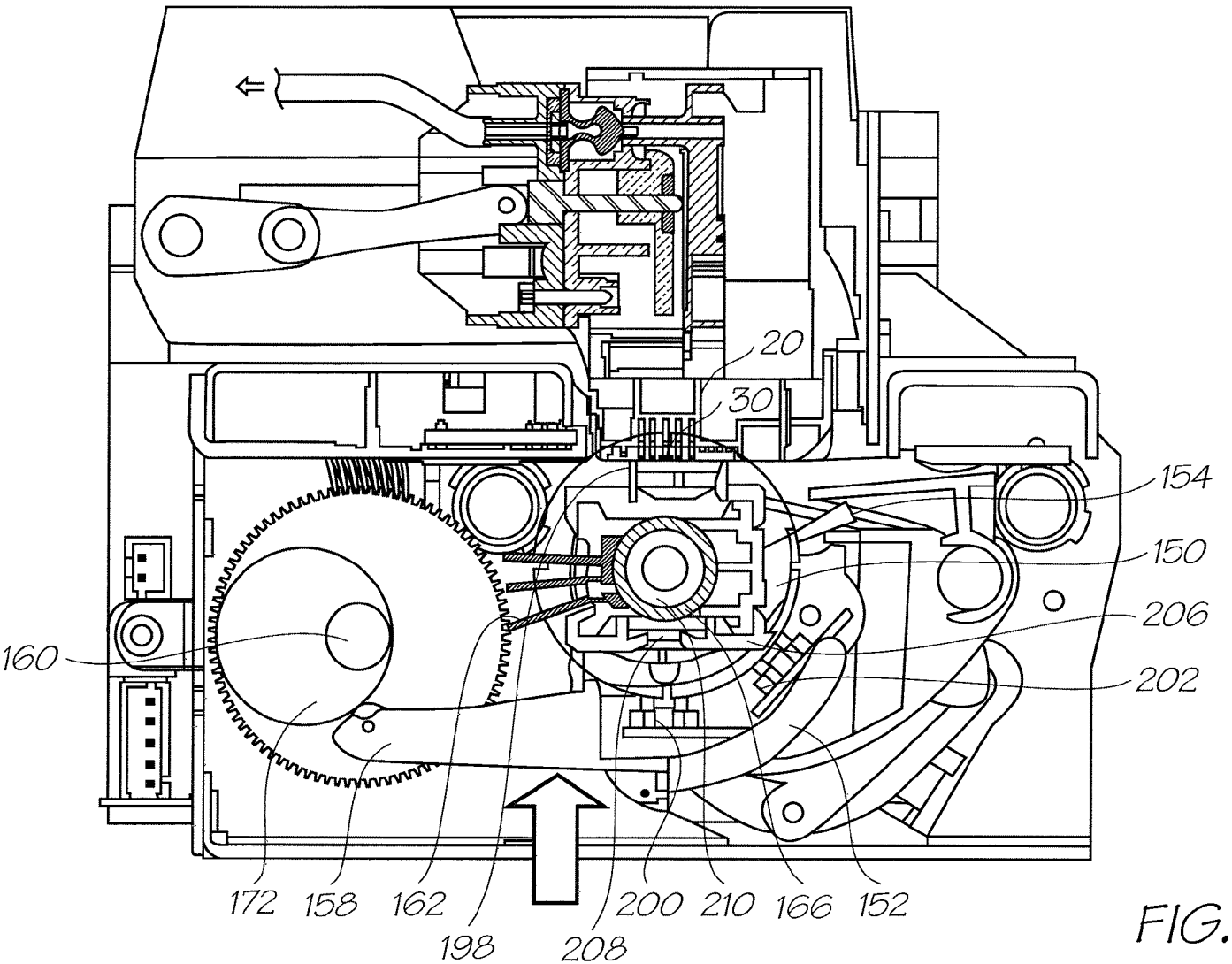
FIG. 17 is a sectional view showing the way that is carousel being lifted to seal the printhead ICs with the capper.

At the end of the print job or prior to the printer going into standby mode, the carousel 150 is retracted away from the printhead ICs 30 in rotated so that the printhead capping maintenance station 198 is again presented to the printhead. As shown in FIG. 17, the lift shaft 160 rotates the lift cam so that the lift arms 158 move the printhead capping maintenance station 198 into sealing engagement with the underside of the LCP molding 20.

Printhead Maintenance Carousel

Figure 18:
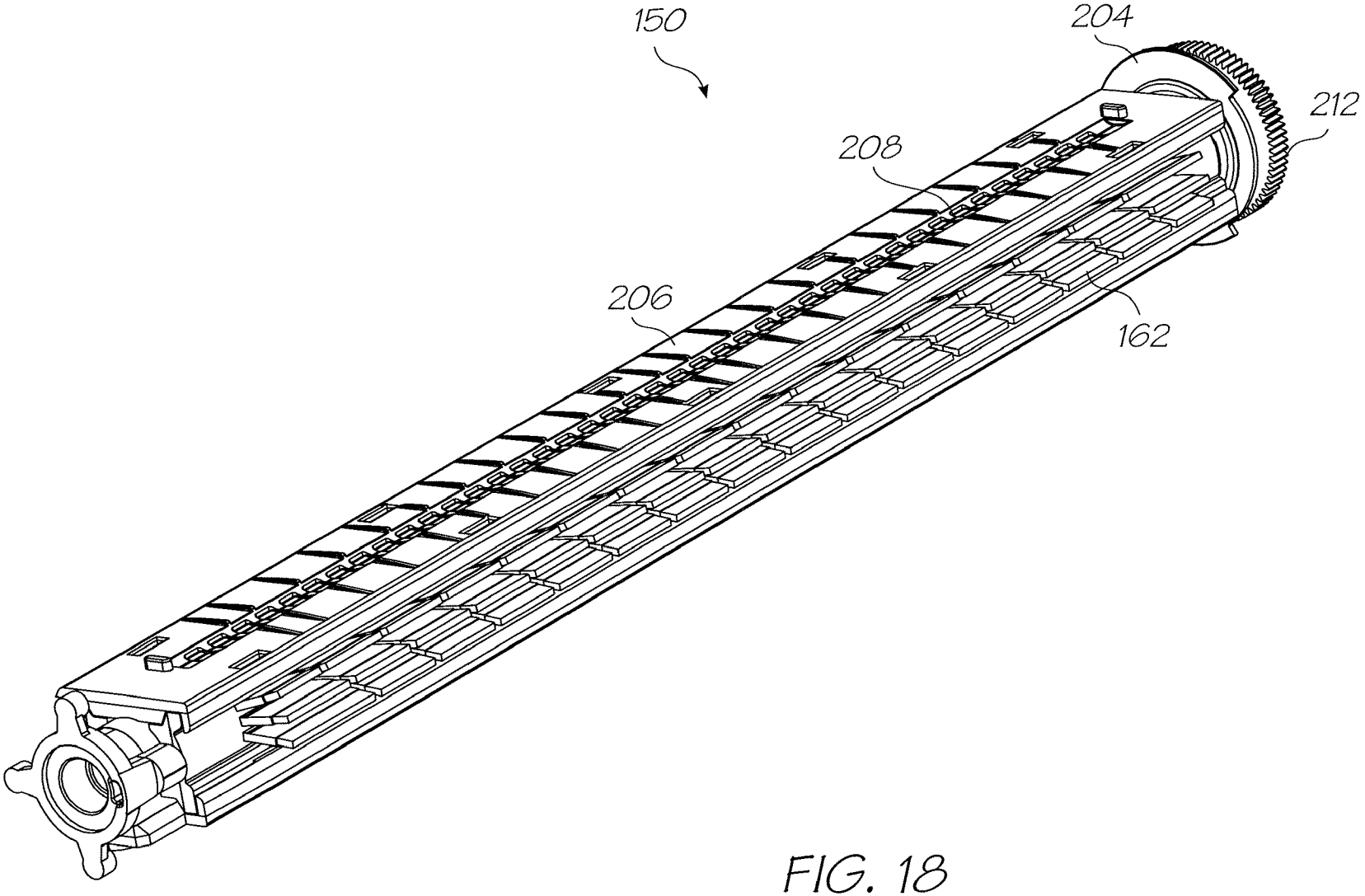
FIG. 18 is a perspective view of the maintenance carousel in isolation.
Figure 19:
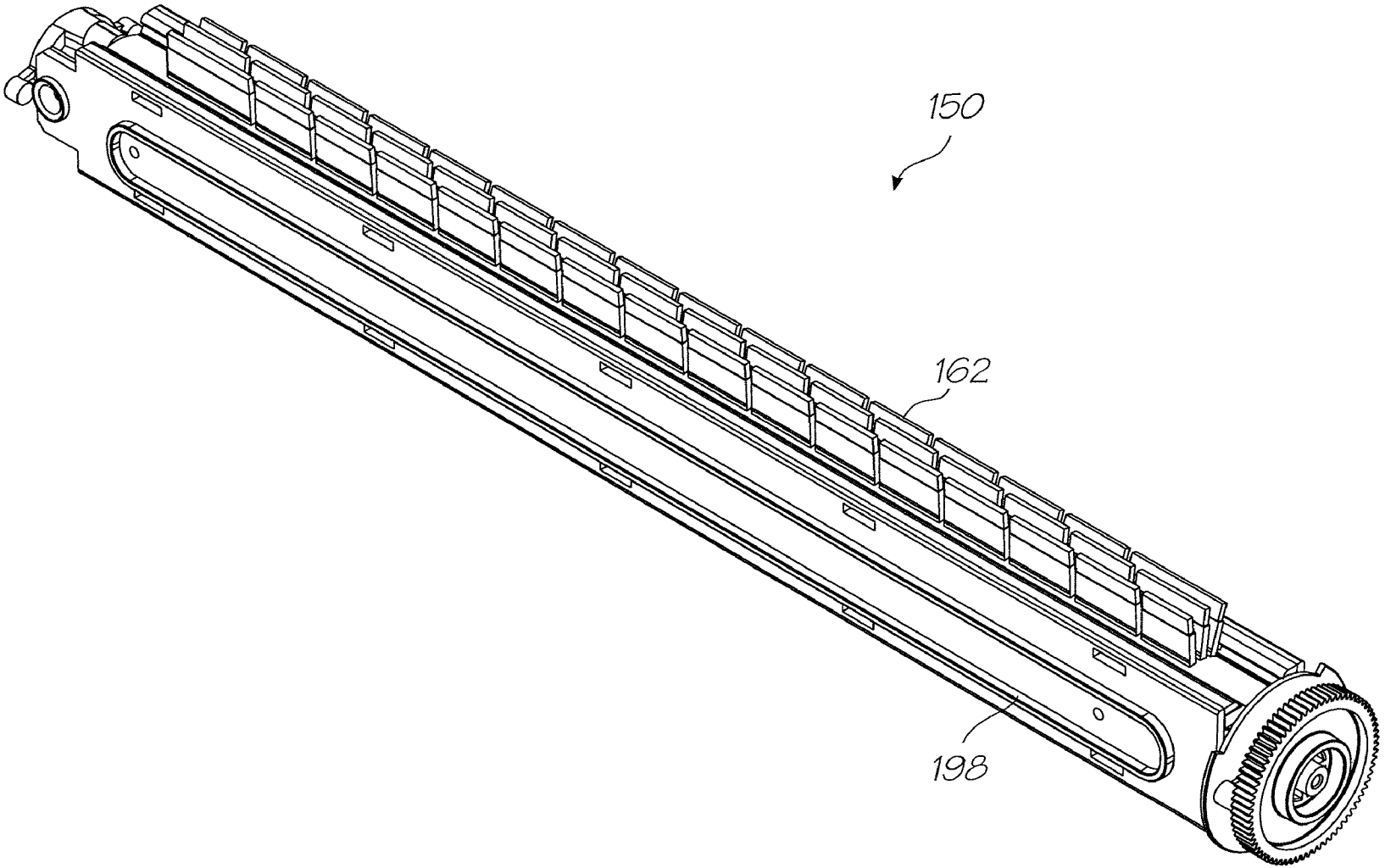
FIG. 19 is another perspective view of the maintenance carousel in isolation in showing the carousel drive spur gear.
Figure 20:
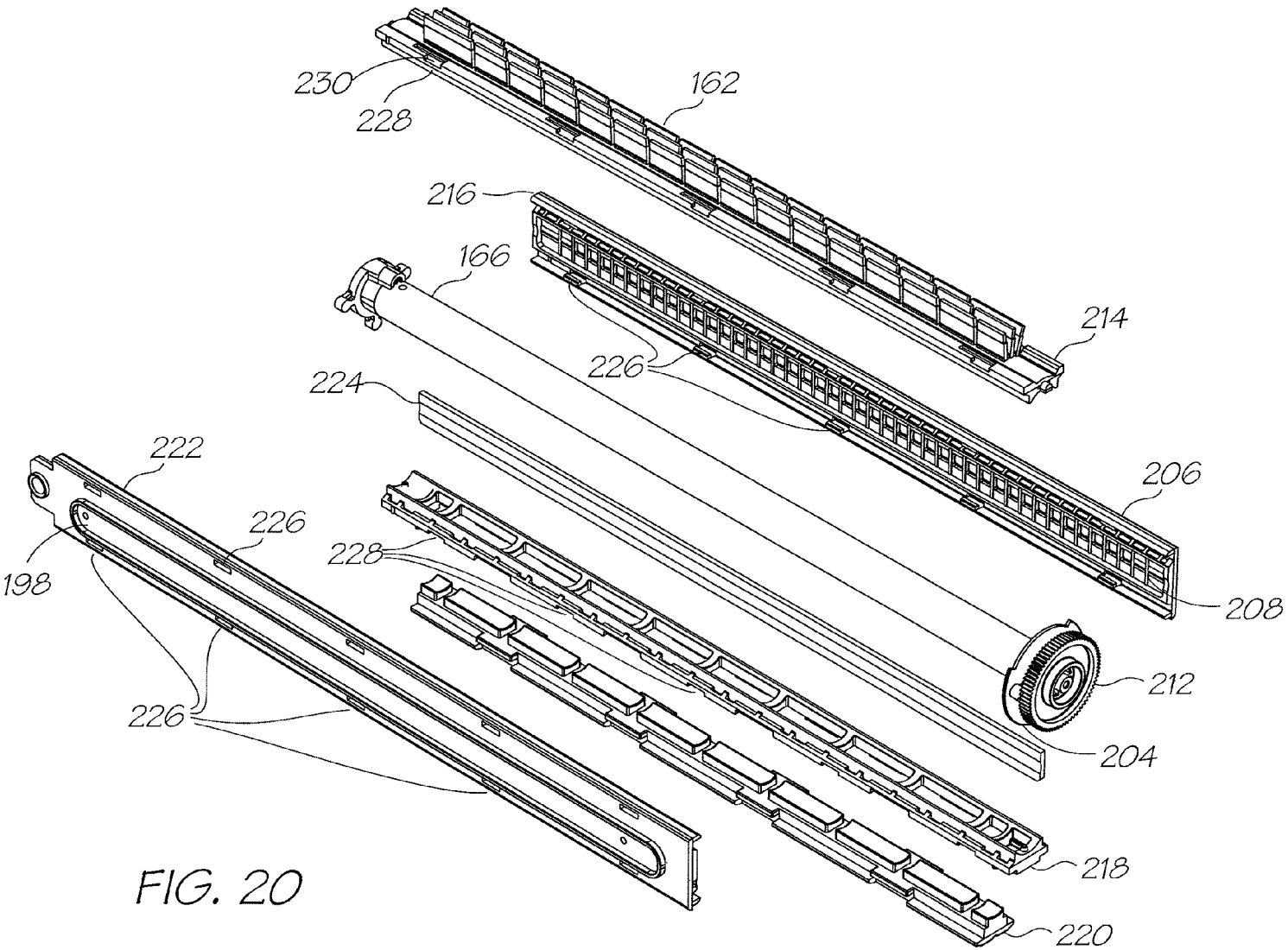
FIG. 20 is an exploded perspective of the maintenance carousel in isolation.
Figure 21:
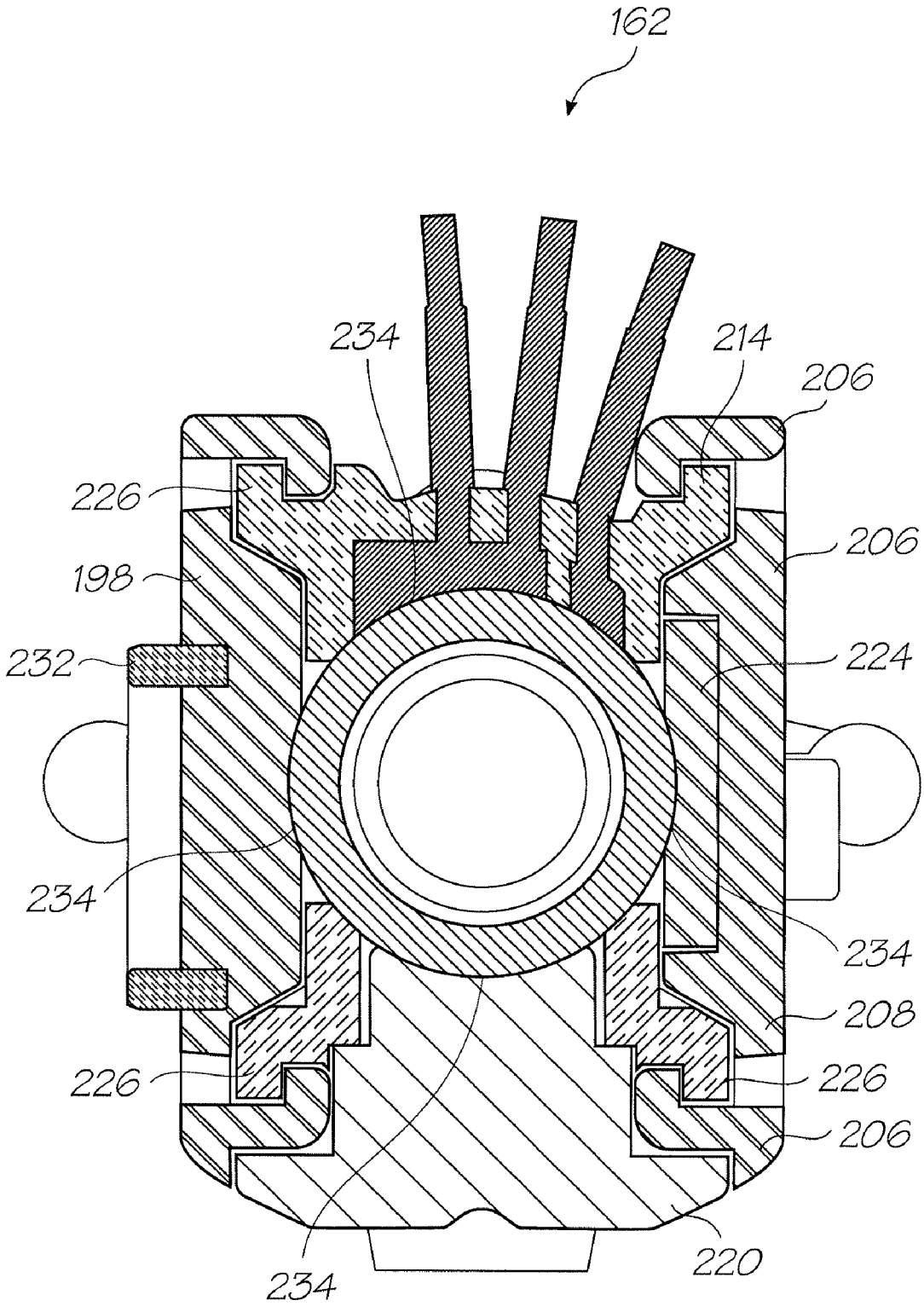
FIG. 21 is a cross-sectional through an intermediate point along the carousel length.

FIGS. 18, 19, 20 and 21 show the maintenance carousel in isolation. FIG. 18 is a perspective view showing the wiper blades 162 and print platen 206. FIG. 19 is a perspective view showing the printhead capper 198 and the wiper blades 162. FIG. 20 is an exploded perspective showing the component parts of the maintenance carousel, and FIG. 21 is a section view showing the component parts fully assembled.

The maintenance carousel has four printhead maintenance stations; a print platen 206, a wiper member 162, a printhead capper 198 and a spittoon/blotter 220. Each of the maintenance stations is mounted to its own outer chassis component. The outer chassis components fit around the carousel tubular shaft 166 and interengage each other to lock on to the shaft. At one end of the tubular shaft 166 is a carousel encoder disk 204 and a carousel spur gear 212 which is driven by the carousel rotation motor (not shown) described below. The tubular shaft is fixed to the spur gear or rotation therewith. The printhead maintenance stations rotate together with the tubular shaft by virtue of their firm compressive grip on the shaft's exterior.

The wiper blade outer chassis component 214 is an aluminum extrusion (or other suitable alloy) configured to securely hold the wiper blades 162. Similarly, the other outer chassis components are metal extrusions for securely mounting the softer elastomeric and or absorbent porous material of their respective maintenance stations. The outer chassis components for the print platen 216 and the printhead capper 198 have a series of identical locking lugs 226 along each of the longitudinal edges. The wiper member outer chassis component 214 and the spittoon/blotter outer chassis component 218 have complementary bayonet style slots for receiving the locking lugs 226. Each of the bayonet slots has a lug access aperture 228 adjacent a lug locking slot 230. Inserting the locking lugs 226 into the lug access aperture 228 of the adjacent outer chassis component, and then longitudinally sliding the components relative to each other will lock them on to the chassis tubular shaft 166.

To improve the friction, and therefore the locking engagement, between each of the maintenance stations and the chassis chip shaft 166, each of the printhead maintenance stations have an element with a curved shaft engagement surface 234. The print platen 206 has an absorbent member 224 with a curved shaft engagement surface 234 formed on one side. The spittoon/blotter outer chassis component 218 has a relatively large absorbent spittoon/blotter member 220 which also has a curved shaft engagement surface 234 formed on its interior face. Likewise, the outer chassis component for the printhead capper 198, and the common base of the wiper blades 162 work has curved shaft engagement surfaces 234.

The ordinary worker will appreciate that clamping the outer chassis to the inner chassis with the use of interengaging locking formations minimises the amount of machining and assembly time while maintaining fine tolerances for precisely mounting the maintenance station structures. Furthermore, the outer chassis components can be assembled in different configurations. The wiper blade outer chassis component 214 can change positions with the spittoon/blotter chassis component 218. Similarly, the printhead capper 198 can swap with the print platen 206. In this way the maintenance station can be assembled in a manner that is optimised for the particular printer in which it will be installed.

Injection Molded Polymer Carousel Chassis

FIGS. 22 to 28 show another embodiment of the printhead maintenance carousel. These figures are schematic cross sections showing only the carousel and the lower portion of the printhead cartridge. It will be appreciated that the maintenance drive systems require simple and straightforward modifications in order to suit this embodiment of the carousel.

Figure 22:
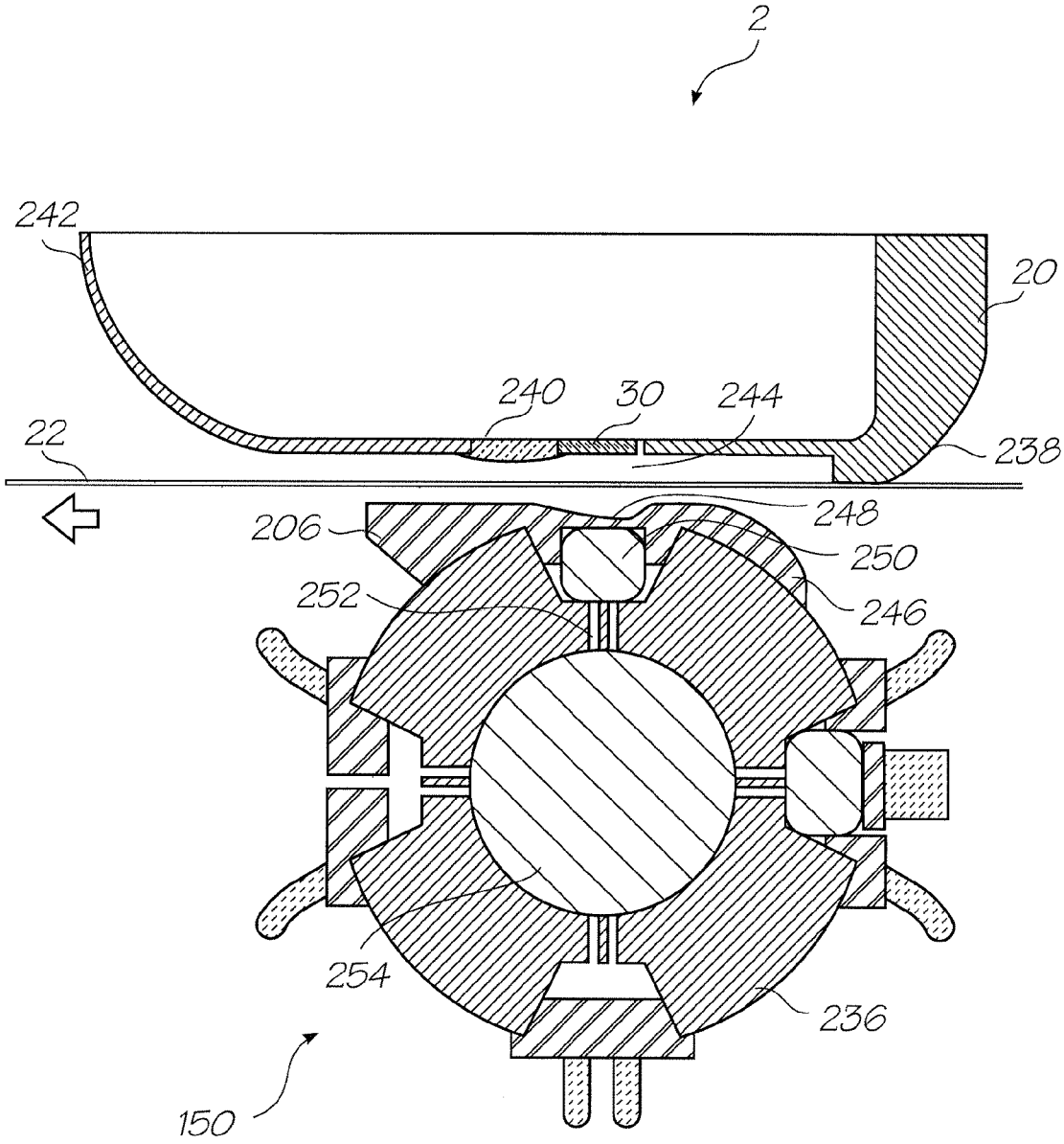
FIG. 22 is a schematic section view of a second embodiment of the maintenance carousel, the maintenance carousel presenting a print platen to the printhead.
Figure 29:
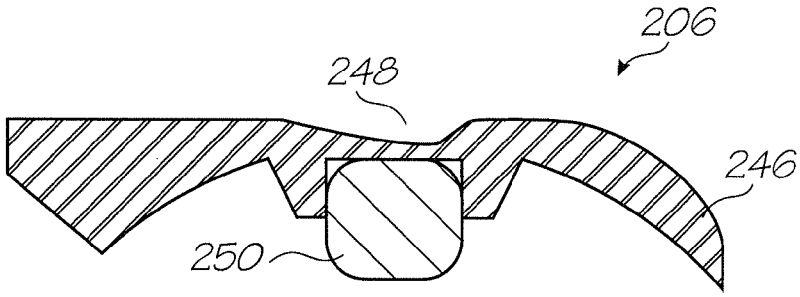
FIG. 29 is a section view of the print platen maintenance station shown in isolation.

FIG. 22 shows the LCP molding 20 of the printhead cartridge 2 adjacent the printhead maintenance carousel 150 with the print platen 206 presented to the printhead ICs 30. For clarity, FIG. 29 shows the print platen 206 in isolation. In use, sheets of media substrate are fed along the media feed path 22. Between the nozzles of the printhead ICs 30 and the media feed path 22 is a printing gap 244. To maintain print quality, the gap 244 between the printhead IC nozzle face and the media surface should as close as possible to the nominal values specified during design. In commercially available printers this gap is about two millimeters. However, as print technology is refined, some printers have a printing gap of about one millimeter.

With the widespread popularity of digital photography, there is increasing demand for full bleed printing of colour images. "Full bleed printing" is printing to the very edges of the media surface. This will usually cause some "over spray" where ejected ink misses the edge of the media substrate and deposits on the supporting print platen. This over spray ink can then smear onto subsequent sheets of media.

The arrangement shown in FIG. 22 deals with both these issues. The paper guide 238 on the LCP molding 20 defines the printing gap 244 during printing. However the print platen 206 has a guide surface 246 formed on its hard plastic base molding. The guide surface 246 directs the leading edge of the sheets towards the exit drive rollers or other drive mechanism. With minimal contact between the sheets of media and print platen 206, there is a greatly reduced likelihood of smearing from over sprayed ink during full bleed printing. Furthermore, placing the paper guide 238 on the LCP molding 20 immediately adjacent the printhead ICs 30 accurately maintains the gap 244 from the nozzles to the media surface.

Some printers in the Applicant's range use this to provide a printing gap 244 of 0.7 millimeters. However this can be further reduced by flattening the bead of encapsulant material 240 adjacent the printhead ICs 30. Power and data is transmitted to the printhead ICs 30 by the flex PCB 242 mounted to the exterior of the LCP molding 20. The contacts of the flex PCB 242 are electrically connected to the contacts of the printhead ICs 30 by a line of wire bonds (not shown). To protect the wire bonds, they are encapsulated in an epoxy material referred to as encapsulant. The Applicant has developed several techniques for flattening the profile of the wire bonds and the bead of encapsulant 240 covering them. This in turn allows the printing gap 244 to be further reduced.

The print platen 206 has an indentation or central recessed portion 248 which is directly opposite the nozzles of the printhead ICs 30. Any over spray ink will be in this region of the platen 206. Recessing this region away from the remainder of the platen ensures that the media substrate will not get smeared with wet over spray ink. The surface of the central recessed 248 is in fluid communication with an absorbent fibrous element 250. In turn, the fibrous element 250 is in fluid communication with porous material 254 in the centre of the chassis 236 by capillary tubes 252. Over sprayed ink is wicked into the fibrous element 250 and drawn into the porous material 254 by capillary action through the tubes 252.

Figure 23:
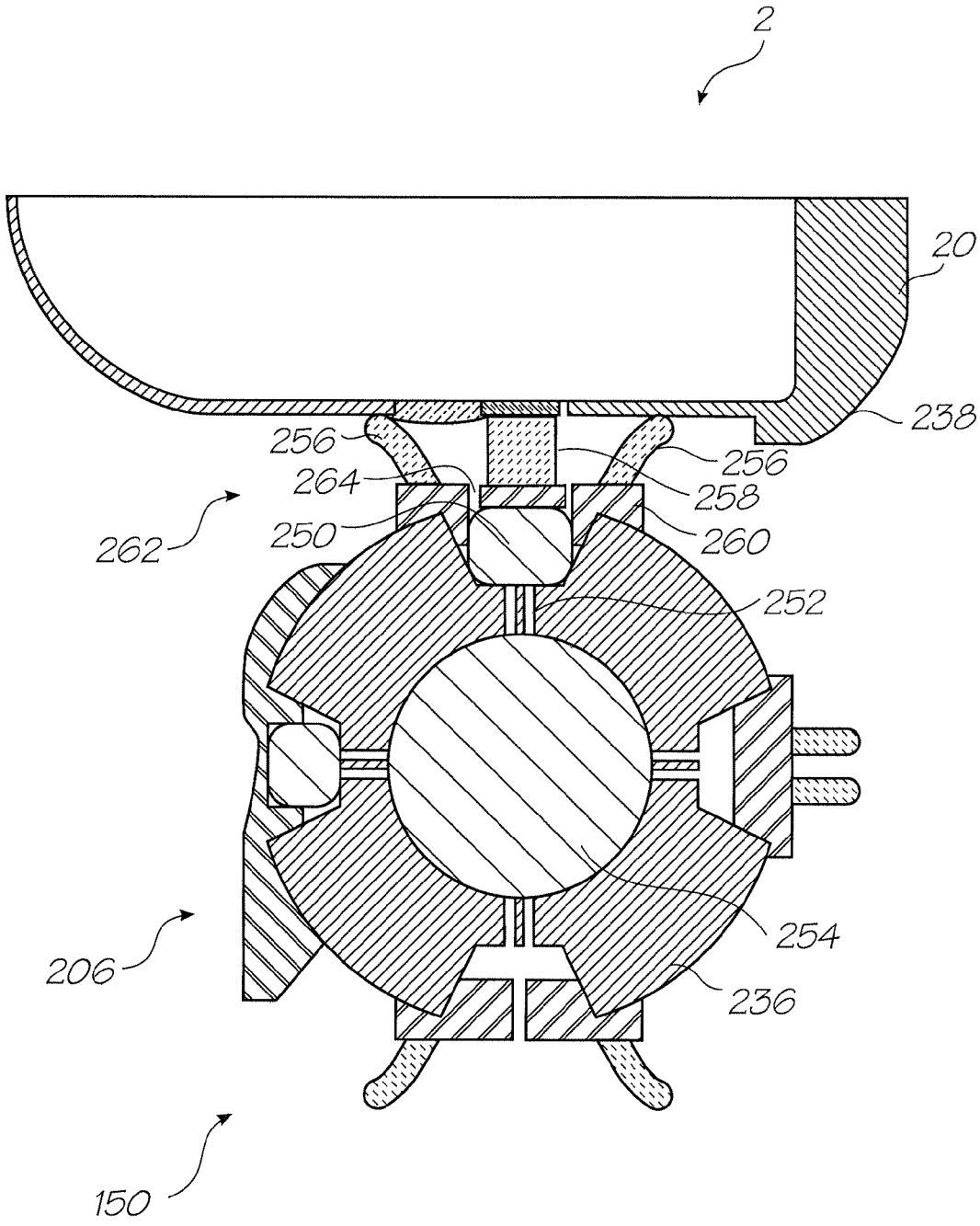
FIG. 23 is a schematic section view of the second embodiment of the maintenance carousel with the printhead priming station engaging the printhead.
Figure 30:
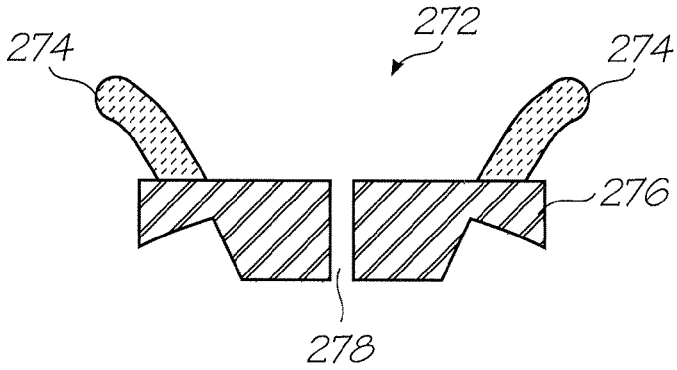
FIG. 30 is a section view of the printhead capper maintenance station shown in isolation.

FIG. 23 shows the carousel 150 rotated such that the printhead priming station 262 is presented to the printhead ICs 30. FIG. 30 shows the printhead priming station 272 and its structural features in isolation. The printhead priming station has an elastomeric skirt 256 surrounding a priming contact pad 258 formed of porous material. The elastomeric skirt and the priming contact pad are co-molded together with a rigid polymer base 260 which securely mounts to the injection molded chassis 236.

Whenever the printhead cartridge 2 is replaced, it needs to be primed with ink. Priming is notoriously wasteful as the ink is typically forced through the nozzles until the entire printhead structure has purged any air bubbles. In the time it takes for the air to be cleared from the multitude of conduits extending through the printhead, a significant amount of ink has been wasted.

To combat this, the maintenance carousel 150 is raised so that the priming contact pad 258 covers the nozzles of the printhead ICs 30. Holding the contact pad 258 against the nozzle array as it is primed under pressure significantly reduces the volume of ink purged through the nozzles. The porous material partially obstructs the nozzles to constrict the flow of ink. However the flow of air out of the nozzles is much less constricted, so the overall priming process is not delayed because of the flow obstruction generated by the porous material. The elastomeric skirt 256 seals against the underside of the LCP molding 22 to capture any excess ink that may flow from the sides of the contact pad 258. Flow apertures 264 formed in the rigid polymer base 260 allows the ink absorbed by the pad 258 and any excess ink to flow to the absorbent fibrous element 250 (identical to that used by the print platen 206). As with the print platen 206, ink in the fibrous element 250 is drawn into the porous material 254 within the injection molded chassis 236 by the capillary tubes 252.

By using the printhead priming station 262, the amount of wasted ink is significantly reduced. Without the priming station, the volume of ink wasted when priming the pagewidth printhead is typically about two millileters per colour. With the priming station 262, this is reduced to 0.1 millileters per colour.

The priming contact pad 258 need not be formed of porous material. Instead, the pad can be formed from the same elastomeric material as the surrounding skirt 256. In this case, the contact pad 258 needs to have a particular surface roughness. The surface that engages the nozzle face of the printhead ICs 30, should be rough at the 2 to 4 micron scale, but smooth and compliant at the 20 micron scale. This type of surface roughness allows air to escape from between the nozzle face and contact pad, but only a small amount of ink.

Figure 24:
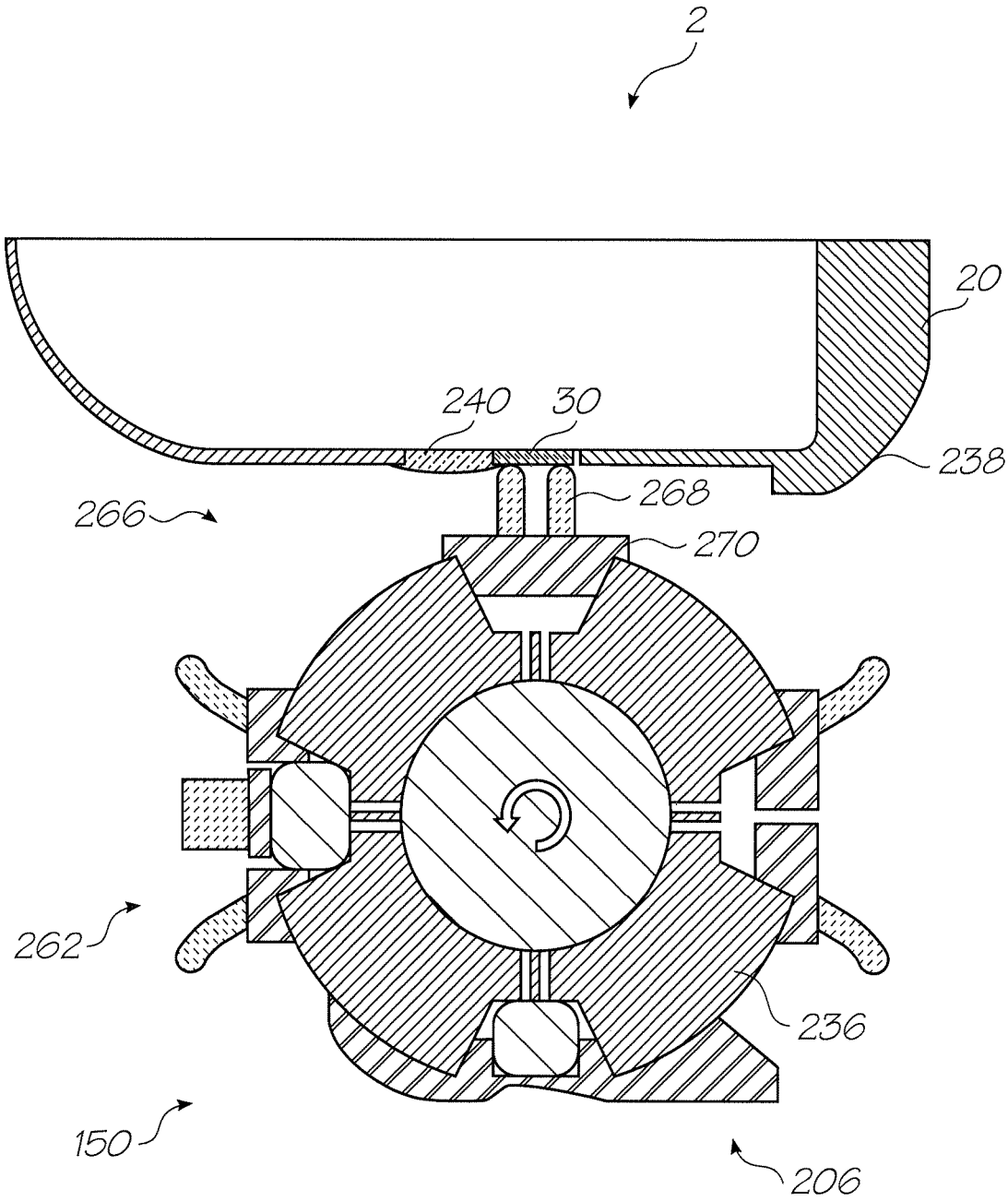
FIG. 24 is a schematic section view of the second embodiment of the maintenance carousel with the wiper blades engaging the printhead.
Figure 31:
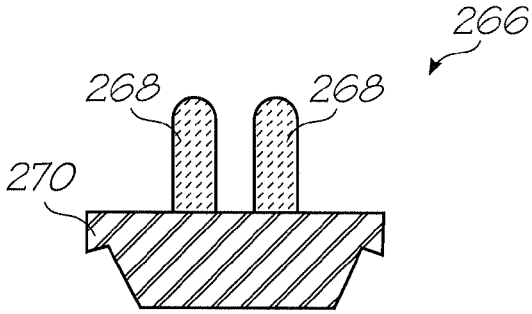
FIG. 31 is a section view of the wiper blade maintenance station shown in isolation.

FIG. 24 shows the maintenance carousel 150 with the wiping station 266 presented to the printhead ICs 30. The wiping station is shown in isolation in FIG. 31. The wiping station 266 is also a co-molded structure with the soft elastomeric wiper blades 268 supported on a hard plastic base 270. To wipe the nozzle face of the printhead ICs 30, the carousel chassis 236 is raised and then rotated so that the wiper blades 268 wipe across the nozzle face. Ordinarily, the carousel chassis 236 is rotated so that the wiper blades 268 wipe towards the encapsulation bead 240. As discussed in the Applicant's co-pending application Ser. No. 12/014,770, incorporated by cross-reference above, the encapsulant bead 240 can be profiled to assist the dust and contaminants to lodge on the face of the wiper blade 268. However, the maintenance drive (not shown) can easily be configured to rotate the chassis 236 in both directions if wiping in two directions proves more effective. Similarly, the number of wipes across the printhead ICs 30 is easily varied by changing the number of rotations the maintenance drive is programmed to perform for each wiping operation.

Figure 25:
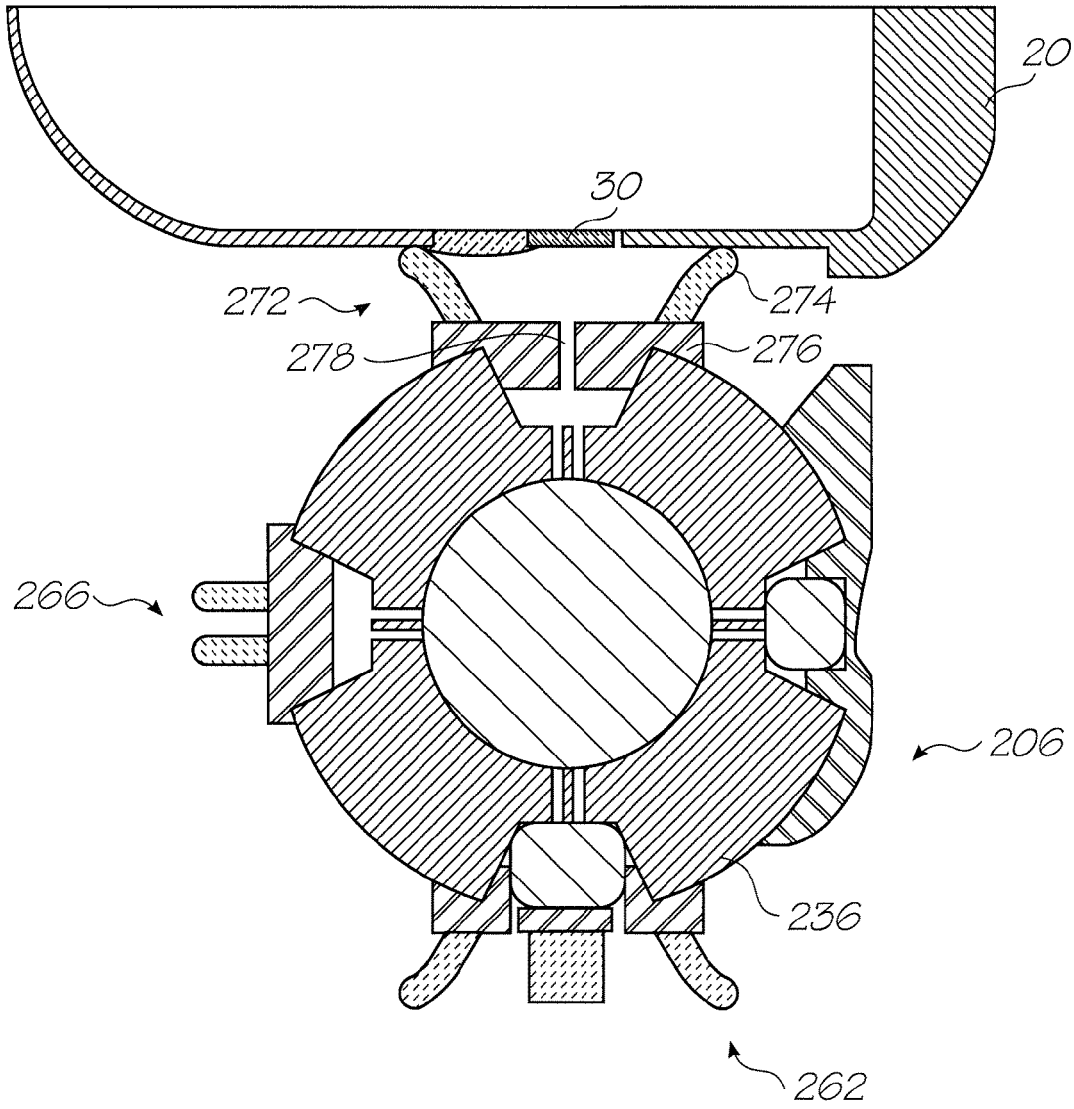
FIG. 25 is a schematic section view of the second embodiment of the maintenance carousel with an ink spittoon presented to the printhead.
Figure 32:
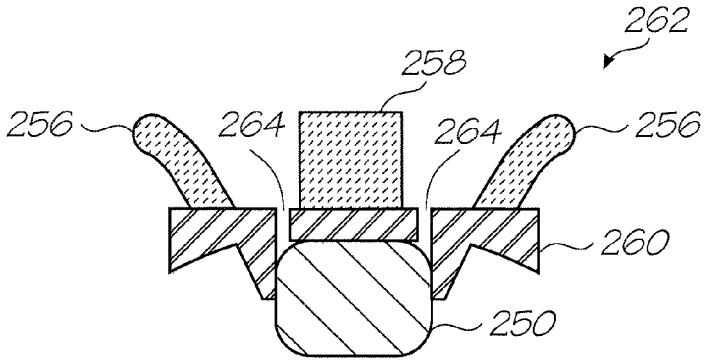
FIG. 32 is a section view of the printhead priming station shown in isolation.

In FIG. 25, the maintenance carousel 150 is shown with the printhead capper 272 presented to the printhead ICs 30. FIG. 32 shows the capper in isolation to better illustrate its structure. The capper 272 has a perimeter seal 274 formed of soft elastomeric material. The perimeter seal 274 is co-molded with its hard plastic base 276. The printhead capper 272 reduces the rate of nozzle drying when the printer is idle. The seal between the perimeter seal 274 and the underside of the LCP molding 20 need not be completely air tight as the capper is being used to prime printhead using a suction force. In fact the hard plastic base 276 should include an air breather hole 278 so that the nozzles do not flood by the suction caused as the printhead is uncapped. To cap the printhead, the chassis 236 is rotated until the printhead capper 272 is presented to the printhead ICs 30. The chassis 236 is then raised until the perimeter seal 274 engages the printhead cartridge 2.

Figure 26:
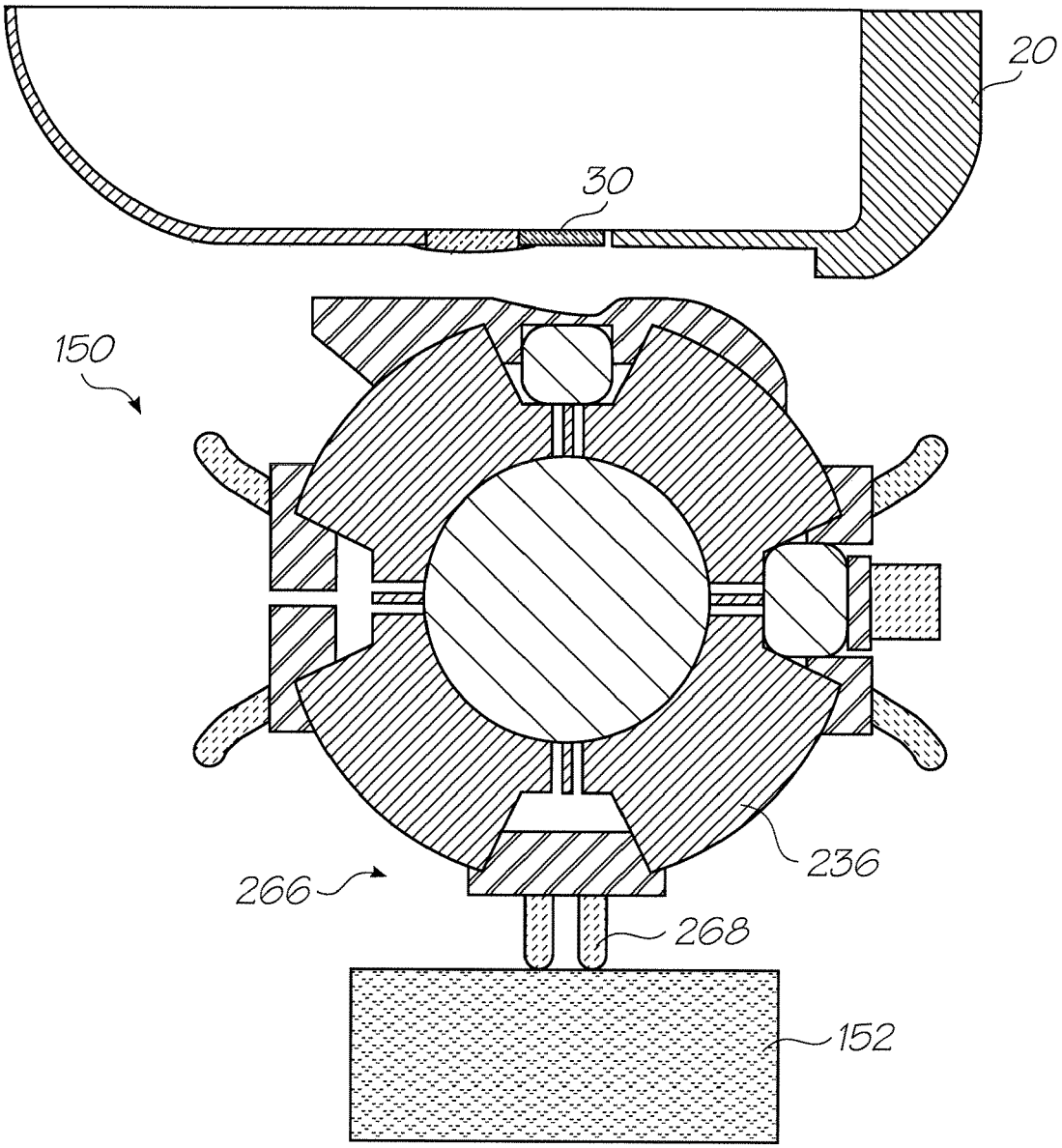
FIG. 26 is a schematic section view of the second time of maintenance carousel with the print platen presented to the printhead as the wiper blades are cleaned on the absorbent pad.

FIG. 26 shows the inclusion of the wiper blade cleaning pad 152. As with the first embodiment described above, the cleaning pad 152 is mounted in the printer so that the wiper blades 268 move across the surface of the pad 152 as the maintenance carousel 150 is rotated. By positioning the cleaning pad 152 such that the chassis 236 needs to be retracted from the printhead ICs 30 in order to allow the wiper blades 268 to contact pad, the chassis 236 can be rotated at relatively high speeds for a comprehensive clean of the wiper blades 268 while not risking any damaging contact with the printhead ICs 30. Furthermore the cleaning pad 152 can be wetted with a surfactant to better remove contaminants from the wiper blades surface.

Figure 27:
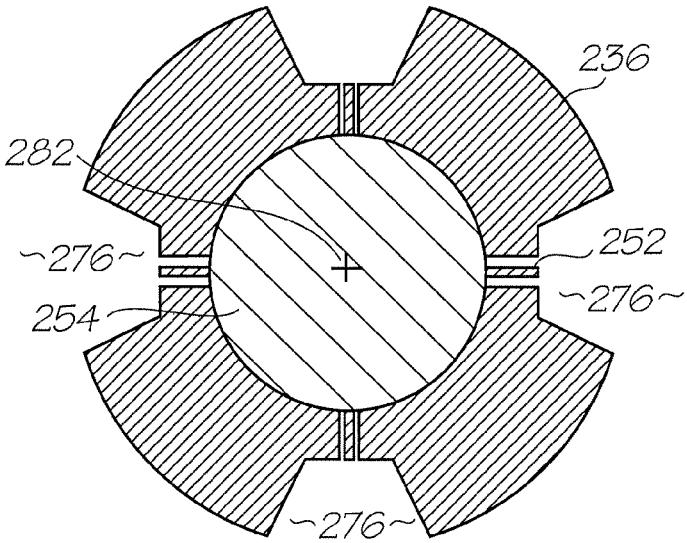
FIG. 27 is a section view of the injection molded core used in the second embodiment of the maintenance carousel.

FIG. 27 shows the injection molded chassis 236 in isolation. The chassis is symmetrical about two planes extending through the central longitudinal axis 282. This symmetry is important because an injection molded chassis extending the length of pagewidth printhead, is prone to deform and bend as it cools if the cross section is not symmetrical. With a symmetrical cross-section, the shrinkage of the chassis is it cools is also symmetrical.

The chassis 236 has four maintenance station mounting sockets 276 formed in its exterior surface. The sockets 276 are identical so that they can receive any one of the various maintenance stations (206, 266, 262, 272). In this way the maintenance stations become interchangeable modules and the order which the maintenance stations are presented to the printhead can be changed to suit different printers. Furthermore, if the maintenance stations themselves are modified, their standard sockets ensure they are easily incorporated into the existing production line with a minimum of retooling. The maintenance stations are secured in the sockets with adhesive but other methods such as an ultra sonic spot weld or mechanical interengagement would also be suitable.

Figure 28:
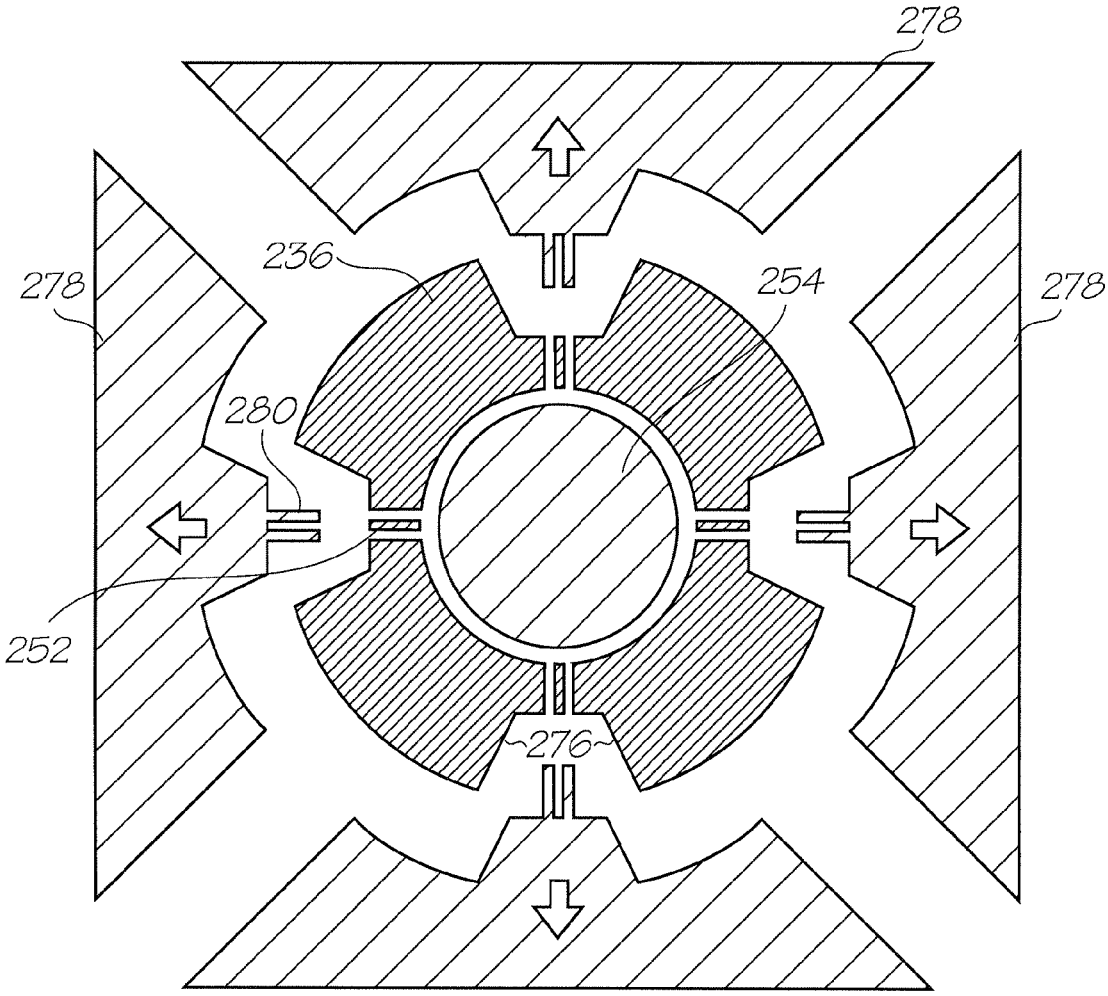
FIG. 28 is a schematic view of the injection molding forms being removed from the core of the second embodiment of maintenance carousel.

As shown in FIG. 28, the mold has four sliders 278 and a central core 288. Each of the sliders 278 has columnar features 280 to form the conduits connecting the fibrous wicking pads to the porous material 219 in the central cavity. The line of draw for each slider is radially outwards from the chassis 236 while the core 288 is withdrawn longitudinally (it will be appreciated that the core is not a precisely a cylinder, but a truncated cone to provide the necessary draft). Injection molding of polymer components is very well suited to high-volume, low-cost production. Furthermore, the symmetrical structure of the chassis and uniform shrinkage maintain good tolerances to keep the maintenance stations extending parallel to the printhead ICs. However, other fabrication techniques are possible; for example, shock wave compressed polymer powder or similar. Furthermore, a surface treatment to increase hydrophillicity can assist the flow of ink to the capillary tubes 252 and ultimately the porous material 210 within the chassis 236. In some printer designs, the chassis is configured for connection to a vacuum source to periodically drain ink from the porous material 210.

Five Maintenance Station Embodiment

Figure 33:
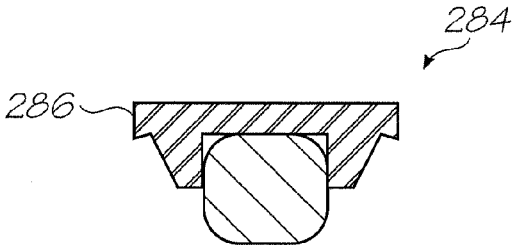
FIG. 33 is a section view of a blotting station shown in isolation.
Figure 34:
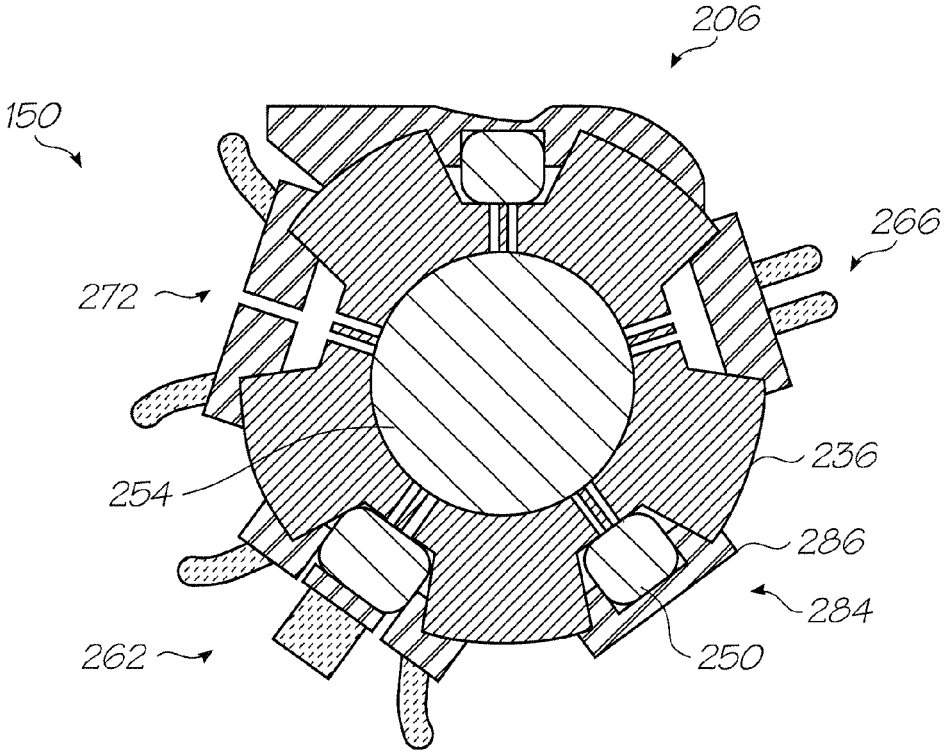
FIG. 34 is a schematic section view of a third embodiment of the maintenance carousel.

FIG. 34 shows an embodiment of the printhead maintenance carousel 150 with five different maintenance stations: a print platen 206, a printhead wiper 266, a printhead capper 272, a priming station 262 and a spittoon 284. The spittoon 284 (shown in isolation in FIG. 33) has a relatively simple structure—the spittoon face 284 presents flat to the printhead and has apertures (not shown) for fluid communication with the fibrous element 250 retained in its hard plastic base.

The five station maintenance carousel 150 adds a spittoon 284 to allow the printer to use major ink purges as part of the maintenance regime. The four station carousel of FIGS. 22-25, will accommodate minor ink purges or 'spitting cycles' using the print platen 206 and or the capper 272. A minor spitting cycle is used after a nozzle face wipe or as an inter-page spit during a print job to keep the nozzles wet. However, in the event that the printhead needs to be recovered from deprime, gross color mixing, large-scale nozzle drying and so on, it is likely that a major spitting cycle will be required—one which is beyond the capacity of the platen or the capper.

The spittoon 284 has large apertures in its face 286 or a series of retaining ribs to hold the fibrous wicking material 250 in the hard plastic base. This keeps the fibrous element 250 very open to a potentially dense spray of ink. One face of the fibrous element 250 presses against the capillary tubes 252 to enhance the flow to the porous material 254 in the central cavity of the chassis 236.

The five socket chassis 236 is injection molded using five sliders configured at 72 degrees to each other, or six sliders at 60 degrees to each other. Similarly, a maintenance carousel with more than five stations is also possible. If the nozzle face is prone to collecting dried ink, it can be difficult to remove with a wiper alone. In these situations, the printer may require a station (not shown) for jetting ink solvent or other cleaning fluid onto the nozzle face. This can be incorporated instead of, or in addition to the spittoon.

Wiper Variants

FIG. 35 to 46 show a range of different structures that the wiper can take. Wiping the nozzle face of printhead is an effective way of removing paper dust, ink floods, dried ink or other contaminants. The ordinary worker will appreciate that countless different wiper configurations are possible, of which, the majority will be unsuitable for any particular printer. The functional effectiveness of wiper (in terms of cleaning the printhead) must be weighed against the production costs, the intended operational life, the size and weight constraints and other considerations.

Single Contact Blade

Figure 35:
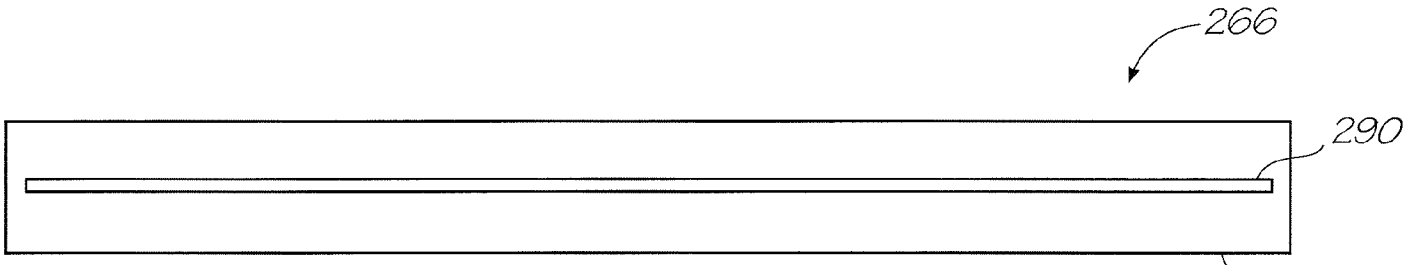
FIG. 35 is a sketch of a first embodiment of the wiper member.

FIG. 35 shows a wiper maintenance station 266 with a single elastomeric blade 290 mounted in the hard plastic base 270 such that it extends normal to the media feed direction. A single wiper blade extending the length of the nozzle array is a simple wiping arrangement with low production and assembly costs. In light of this, a single blade wiper is suited to printers and the lower end of the price range. The higher production volumes favor cost efficient manufacturing techniques and straightforward assembly of the printer components. This may entail some compromise in terms of the operational life of the unit, or the speed and efficiency with which the wiper cleans the printhead. However the single blade design is compact and if it does not effectively clean the nozzle face in a single traverse, the maintenance drive can simply repeat the wiping operation until the printhead is clean.

Multiple Contact Blades

Figure 36:
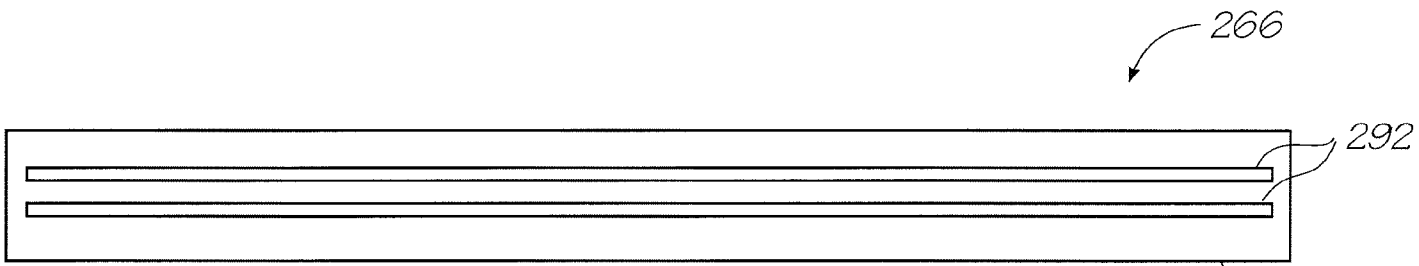
FIG. 36 is a sketch of a second embodiment of the wiper member.
Figure 46:
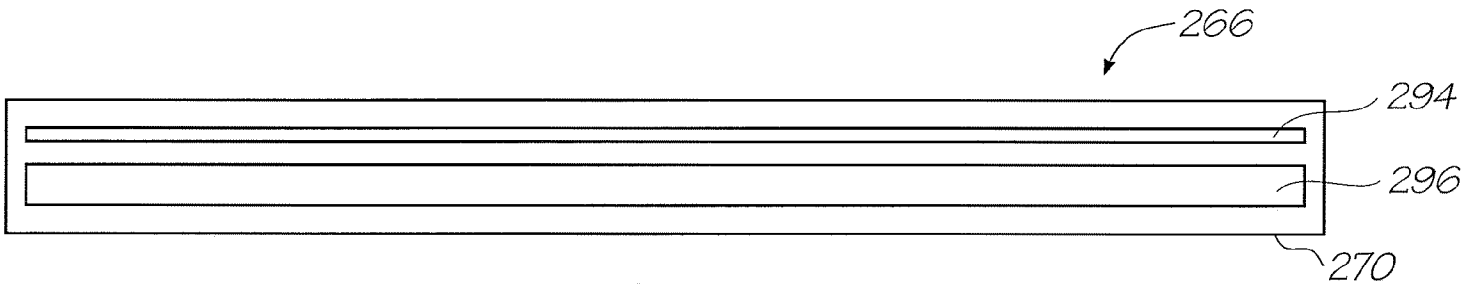
FIG. 46 is sketch of a 12 embodiment of the wiper member.

FIGS. 36, 43A, 43 and 46 show wiper maintenance stations 266 with multiple, parallel blades. In FIG. 36, the twin parallel blades 292 are identical and extend normal to the media feed direction. Both blades 292 are separately mounted to the hard plastic base 270 so as to operate independently. In FIG. 46, the blades are non-identical. The first and second blades (294 and 296 respectively) are different widths (or otherwise different cross sectional profiles) and durometer values (hardness and viscoelasticity). Each blade may be optimised to remove particular types of contaminant. However, they are separately mounted in the hard plastic base 270 for independent operation. In contrast, the multiple blade element of FIGS. 43A and 43B has smaller, shorter blades 300 all mounted to a common elastomeric base 298, which is in turn secured to the hard plastic base 270. This is a generally more compliant structure that has a relatively large surface area in contact with the nozzle face with each wipe. However, the thin soft blades wear and perish at a greater rate than the larger and more robust blades.

With multiple parallel blades wiping across the nozzle face, a single traverse by the wiper member will collect more of the dust and contaminants. While a multiple blade design is less compact than a single blade, each wiping operation is quicker and more effective. Hence the printhead can be wiped between pages during the print job and any preliminary maintenance regime performed prior to a print job is completed in a short time.

Single Skew Blade

Figure 37:
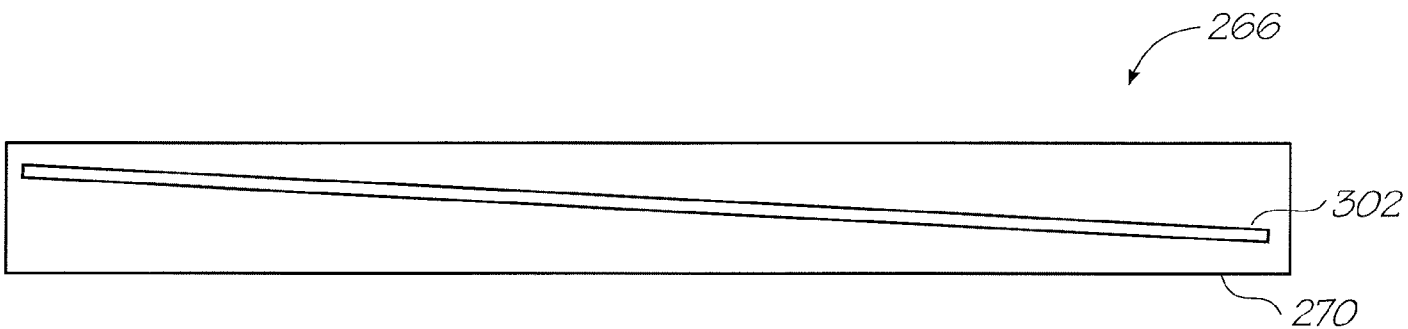
FIG. 37 is a sketch of a third embodiment of the wiper member.

FIG. 37 shows a wiper maintenance station 266 with a single blade 302 mounted in the hard plastic base 270 such that it is skew to the wiping direction. It will be appreciated that the wiping direction is normal to the longitudinal extent of the plastic base 270.

A single wiper blade is a simple wiping arrangement with low production and assembly costs. Furthermore, by mounting the blade so that it is skew to the wiping direction, the nozzle face will be in contact with only one section of blade and any time during the traverse of the wiper member. With only one section in contact with the nozzle face, the blade does not buckle or curl because of inconsistent contact pressure along its full length. This ensures sufficient contact pressure between the wiper blade and all of the nozzle face without needing to precisely line the blade so that it is completely parallel to the nozzle face. This allows the manufacturing tolerances to be relaxed so that higher volume low-cost production techniques can be employed. This may entail some compromise in terms of increasing the distance that the wiper member must travel in order to clean the printhead, and therefore increasing the time required from each wiping operation. However the reduced manufacturing costs outweigh these potential disadvantages.

Independent Contact Blades

Figure 38:
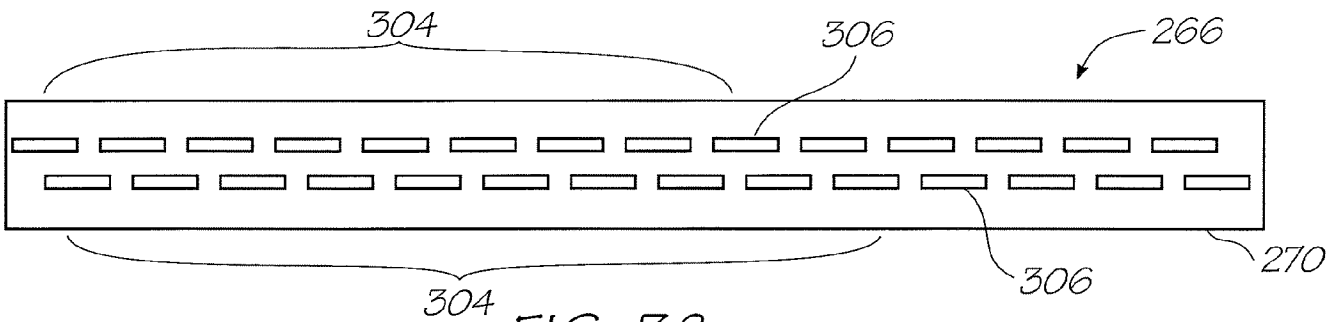
FIG. 38 is a sketch of the fourth moment of the wiper member.

FIG. 38 shows a wiper maintenance station 266 with two sectioned blades 304 mounted in the hard plastic base 270. Each of the individual blade sections 306 that make up the complete blades 304 mounted in the hard plastic base 270 for independent movement relative to each other. The individual blade sections 306 in each blade 304 are positioned so that they are out of registration with each other with respect to the wiping direction. In this way, the nozzles that are not wiped by the first blade 304 because they are positioned in a gap between two blade sections 306, will be wiped by a blade section 306 in the second blade 304.

Wiping the nozzle face of pagewidth printhead with a single long blade can be ineffective. Inconsistent contact pressure between the blade and the nozzle face can cause the blade to buckle or curl at certain sections along its length. In these sections the contact pressure can be insufficient or there maybe no contact between the blade and the nozzle face. A wiper blade divided into individual blade sections can address this problem. Each section is capable of moving relative to its adjacent sections so any inconsistencies in the contact force, will not cause buckling or curling in other sections of blade. In this may contact pressure is maintained at the nozzle face is clean effectively.

Nozzle Face Wiper Having Multiple Skew Blades

Figure 39:
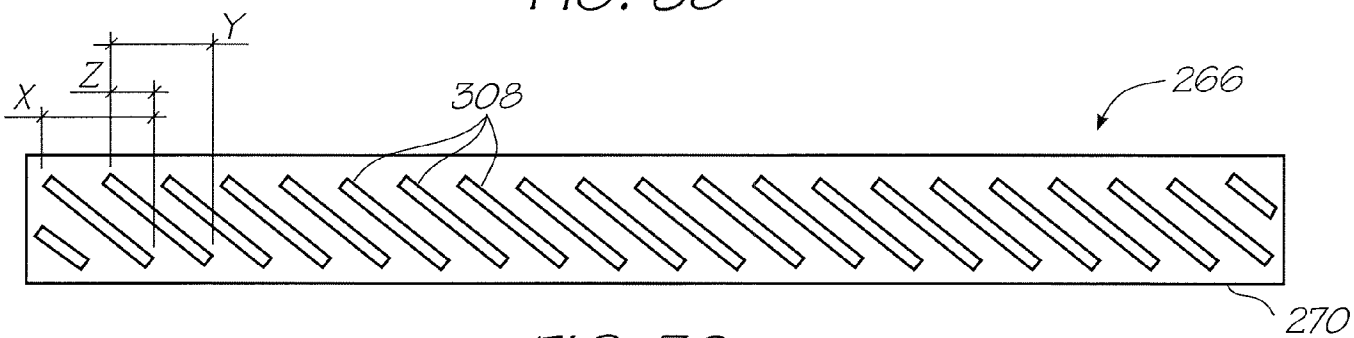
FIG. 39 is a sketch of the fifth embodiment of the wiper member.

In FIG. 39, the wiper maintenance station 266 has a series of independent blades 308 mounted in the hard plastic base 270 such that they are skew to the wiping direction. The blades 308 are positioned so that the lateral extent (with respect the wiping direction) of each blade (X) has some overlap (Z) with the lateral extent of its adjacent blades (Y). By mounting the wiper blade so that it is skew to the wiping direction, the nozzle face will be in contact with only one section of blade and any time during the traverse of the wiper member. With only one section in contact with the nozzle face, the blade does not buckle or curl because of inconsistent contact pressure along its full length. This ensures sufficient contact pressure between the wiper blade and all of the nozzle face without needing to align the blade so that it is precisely parallel to the nozzle face. This allows the manufacturing tolerances to be relaxed so that high volume low-cost production techniques can be employed. A single skew blade will achieve this but it will increase the distance that the wiper member must travel in order to clean the printhead, and therefore increasing the time required from each wiping operation. In light of this, the invention uses a series of adjacent skew blades, each individual blade wiping a corresponding portion of the nozzle array. Multiple blades involve higher manufacturing costs than a single blade but in certain applications, the compact design and quicker operation outweigh these potential disadvantages.

Wiper with Array of Pads

Figure 40:
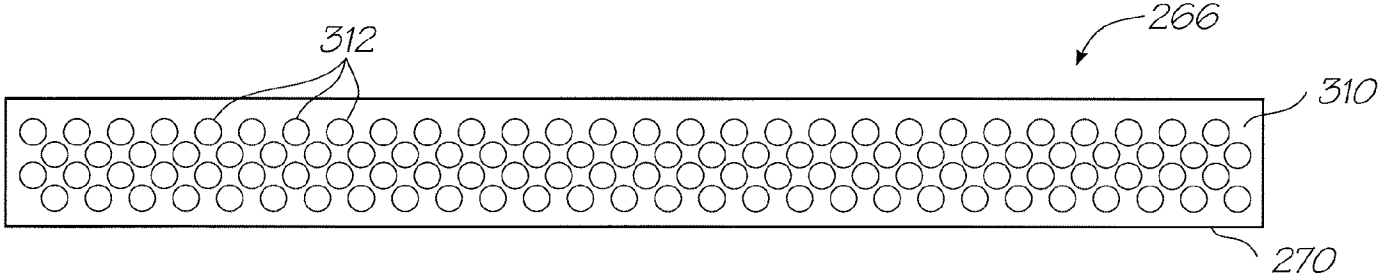
FIG. 40 is a sketch of the sixth embodiment of the wiper member.
Figure 44:
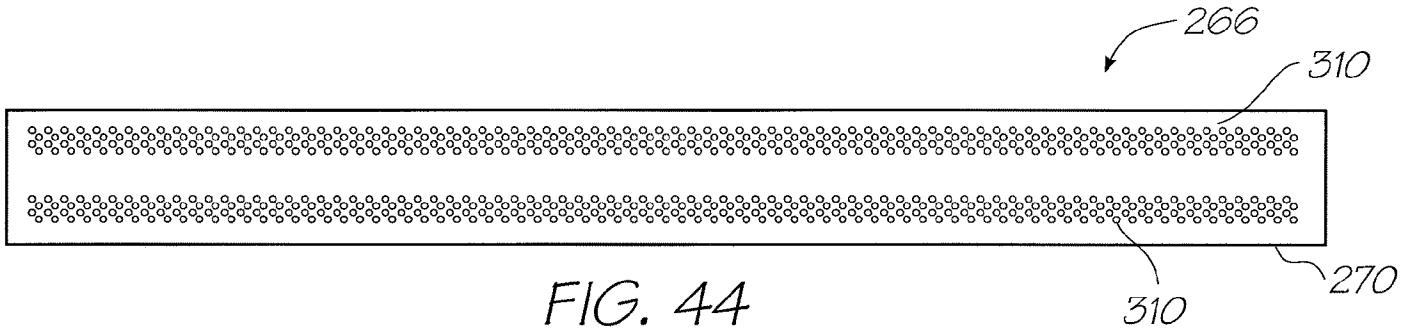
FIG. 44 is a sketch of a 10th embodiment of the wiper member.

In FIGS. 40 and 44 the wiping maintenance stations 266 use an array of contact pads 310 instead of any blade configurations. The individual pads 312 maybe short squad cylinders of an elastomeric material individually mounted into the hard plastic base 270 or a cylindrical soft fibre brush similar to the format often used for silicon wafer cleaning. As discussed above, wiping the nozzle face of pagewidth printhead with a single long contact surface can be ineffective. Inconsistent contact pressure between the wiping surface and the nozzle face can cause the contact pressure to be insufficient or non-existent in some areas.

Using a wiping surface that has been divided into an array 310 of individual contact pads allows each pad to move relative to its adjacent pads so any inconsistencies in the contact force will vary the amount each pad compresses and deforms individually. Relatively high compression of one pad will not necessarily transfer compressive forces to its adjacent pad. In this way, uniform contact pressure is maintained at the nozzle face is cleaned more effectively.

Sinusoidal Blade

Figure 41:
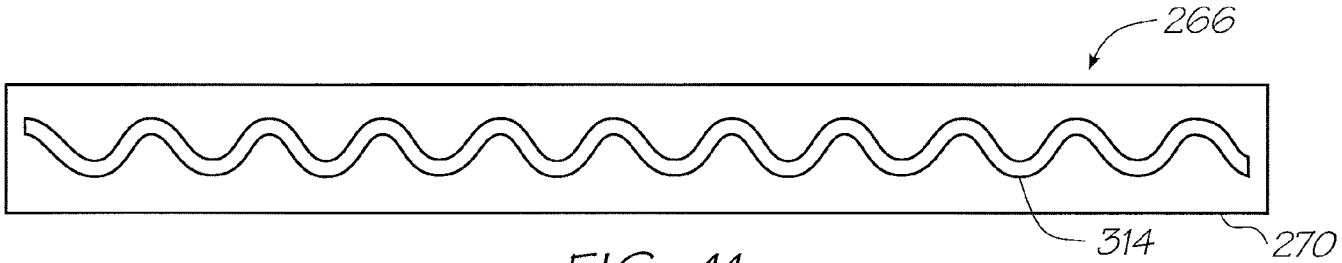
FIG. 41 is a sketch of the seventh embodiment of the wiper member.

In the wiping maintenance station 266 shown in FIG. 41, the single blade 314 is mounted into the hard plastic base 270 such that it follows a sinusoidal path. As previously discussed, wiping the nozzle face of pagewidth printhead with a single long contact surface can be ineffective. Inconsistent contact pressure between the wiping surface and the nozzle face can cause the contact pressure to be insufficient or non-existent in some areas. One of the reasons that the contact pressure will vary is inaccurate movement of the wiper surface relative to the nozzle face. If the support structure for the wiping surface is not completely parallel to the nozzle face over the entire length of travel during the wiping operation, there will be areas of low contact pressure which may not be properly cleaned. As explained in relation to the skew mounted blades, it is possible to avoid this by positioning the wiper blade so that it is angled relative to feed wiping direction and the printhead nozzle face. In this way, only one portion of the wiper blade contacts the nozzle face at any time during the wiping operation. Also, a small angle between the blade and the wiping direction improves the cleaning and effectiveness of the wipe. When the blade moves over the nozzle face at an incline, more contact points between the blade and the nozzle face give better contaminant removal. This ameliorates any problems caused by inconsistent contact pressure but it requires the wiper blade to travel further for each wiping operation. As discussed above, inaccuracies in the movement of wiper surface relative to the nozzle face is a source of insufficient contact pressure. Increasing the length of wiper travel is also counter to compact design.

Using a wiping blade that has a zigzag or sinusoidal shape wipes the nozzle face with a number wiper sections that are inclined to the media feed direction. This configuration also keeps the length of travel of the wiper member relative to the printhead small enough to remain accurate and compact.

Single Blade with Non-Linear Contact Surface

Figure 42:
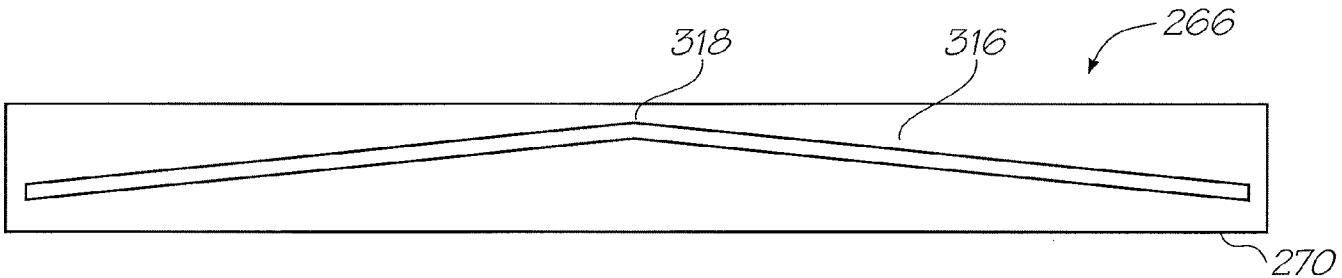
FIG. 42 is a sketch of the eighth embodiment of the wiper member.
Figure 43A:
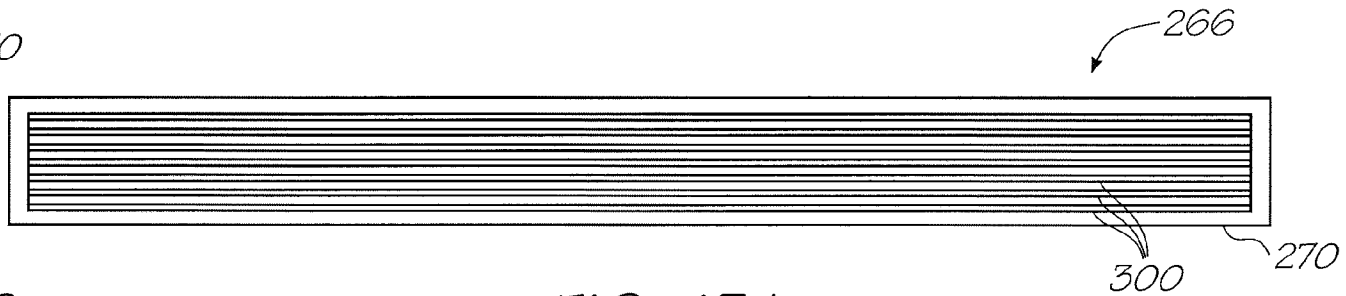
FIGS. 43A and 43B sketches of a nine embodiment of the wiper member.
Figure 43B:
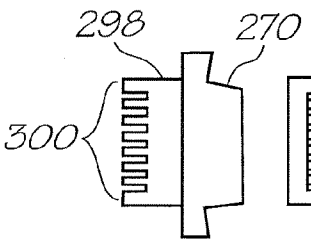

FIG. 42 shows the wiping maintenance station 266 with a single blade 316 having two linear sections mounted on the hard plastic base 270 at an angle to each other, and skew to the wiping direction. As previously discussed, wiping the nozzle face of pagewidth printhead with a single long contact surface can cause the contact pressure to be insufficient or non-existent in some areas. Angling the blade relative to the wiping direction and the printhead nozzle face means that only one portion of the wiper blade contacts the nozzle face at any time during the wiping operation. This keeps the contact pressure more uniform but it requires the wiper blade to travel further for each wiping operation. As discussed above, inaccuracies in the movement of wiper surface relative to the nozzle face source of insufficient contact pressure. Increasing the length of wiper travel only increases the risk of such inaccuracies.

By using a wiping surface that has an angled or curved shape so that the majority of the nozzle face is wiped with a wiper section that is inclined to the media feed direction while reducing the length of travel of the wiper member relative to the printhead. The ordinary worker will understand that the contact blade can have a shallow V-shape or U-shape. Furthermore if the leading edge of the blade 318 is the intersection of the two linear sections (or the curved section of the U-shaped blade), the Applicant has found that there is less blade wear because of the additional support provided to the initial point of contact with the nozzle face.

Fibrous Pad

Figure 45:
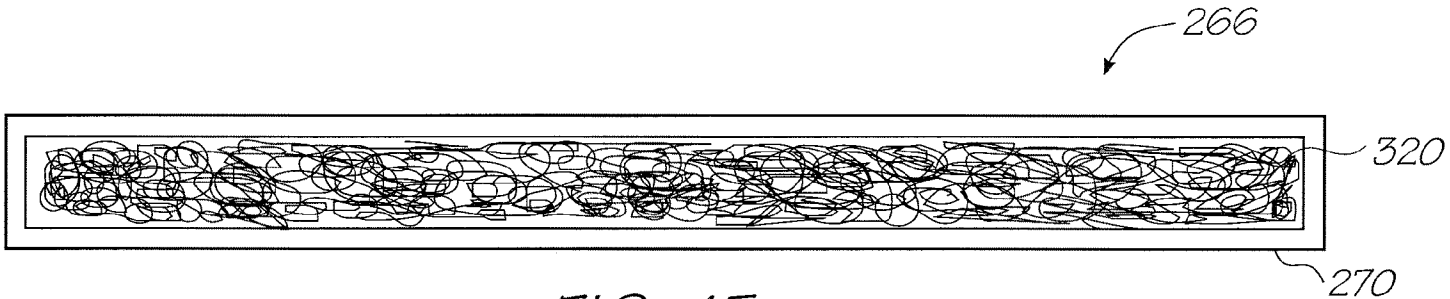
FIG. 45 is sketch of an 11th embodiment of the wiper member.

FIG. 45 shows a printhead wiper maintenance station 266 with a fibrous pad 320 mounted to the hard plastic base 270. A fibrous pad 320 is particularly effective for wiping the nozzle face. The pad presents many points of contact with the nozzle face so that the fibres can mechanically engage with solid contaminants and will wick away liquid contaminants like ink floods and so on. However, once the fibrous pad has cleaned the nozzle face, it is difficult to remove the contaminants from the fibrous pad. After a large number of wiping operations, the fibrous pad can be heavily laden with contaminants and may no longer clean the nozzle face effectively. However, printers intended to have a short operational life, or printers that allow the wiper to be replaced, a fibrous pad will offer the most effective wiper.

Combination Wiper Maintenance Stations

It will be appreciated that some printhead designs will be most effectively cleaned by a wiper that has a combination of the above wiping structures. For example a single blade in combination with a series of skew blades, or a series of parallel blades with a fibrous pad in between. The combination wiper maintenance station can be derived by choosing the specific wiping structures on the basis of their individual merits and strength.

Printhead Maintenance Facility Drive System

Figure 47:
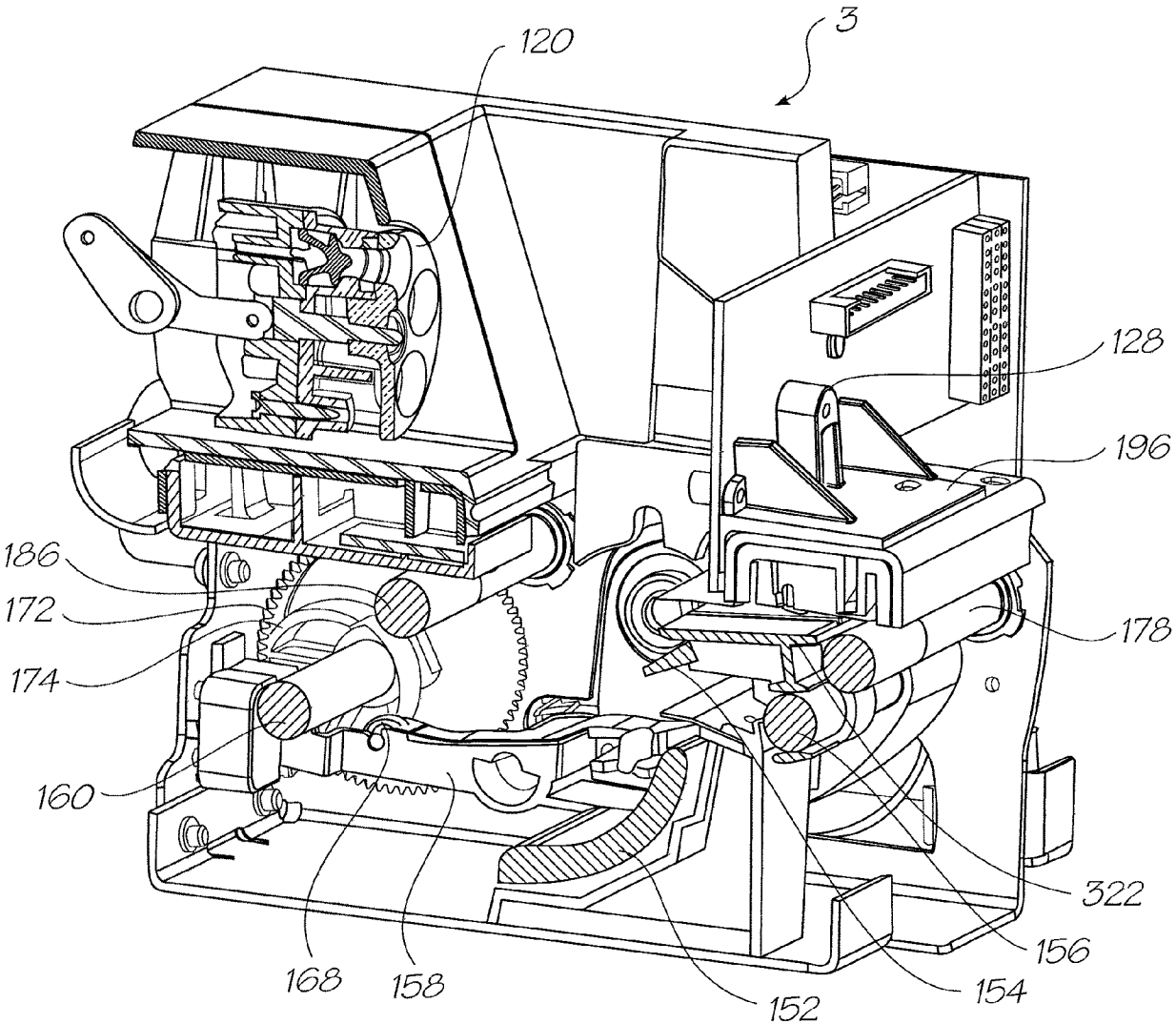
FIG. 47 is the sectional perspective of the print engine without the printhead cartridge for the maintenance carousel.
Figure 48:
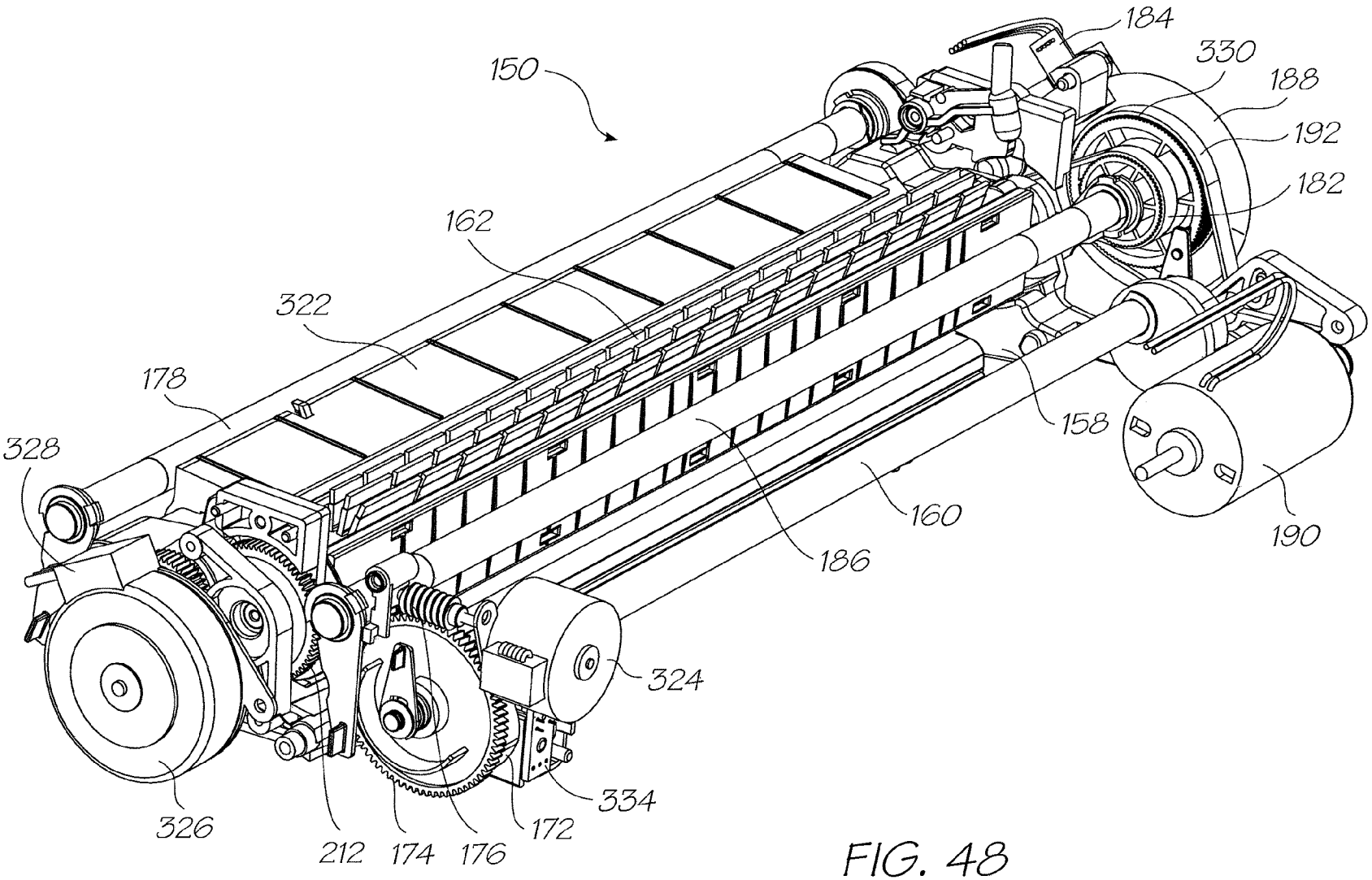
FIG. 48 is a perspective showing the independent drive assemblies used by the print engine.

FIGS. 47 to 50 show the media feed drive and the printhead maintenance drive in greater detail. FIG. 48 shows the printhead maintenance carousel 150 and the drive systems in isolation. The maintenance carousel 150 is shown with the wiper blades 162 presented to the printhead (not shown). The perspective shown in FIG. 48 reveals the paper exit guide 322 leading to the exit drive roller 178. On the other side of the wiper blades 162 the main drive roller shaft 186 is shown extending from the main drive roller pulley 330. This pulley is driven by the main drive roller belt 192 which engages the media feed motor 190. The media feed drive belt 182 synchronises the rotation of the main drive roller 186 and the exit roller 178.

Figure 49:
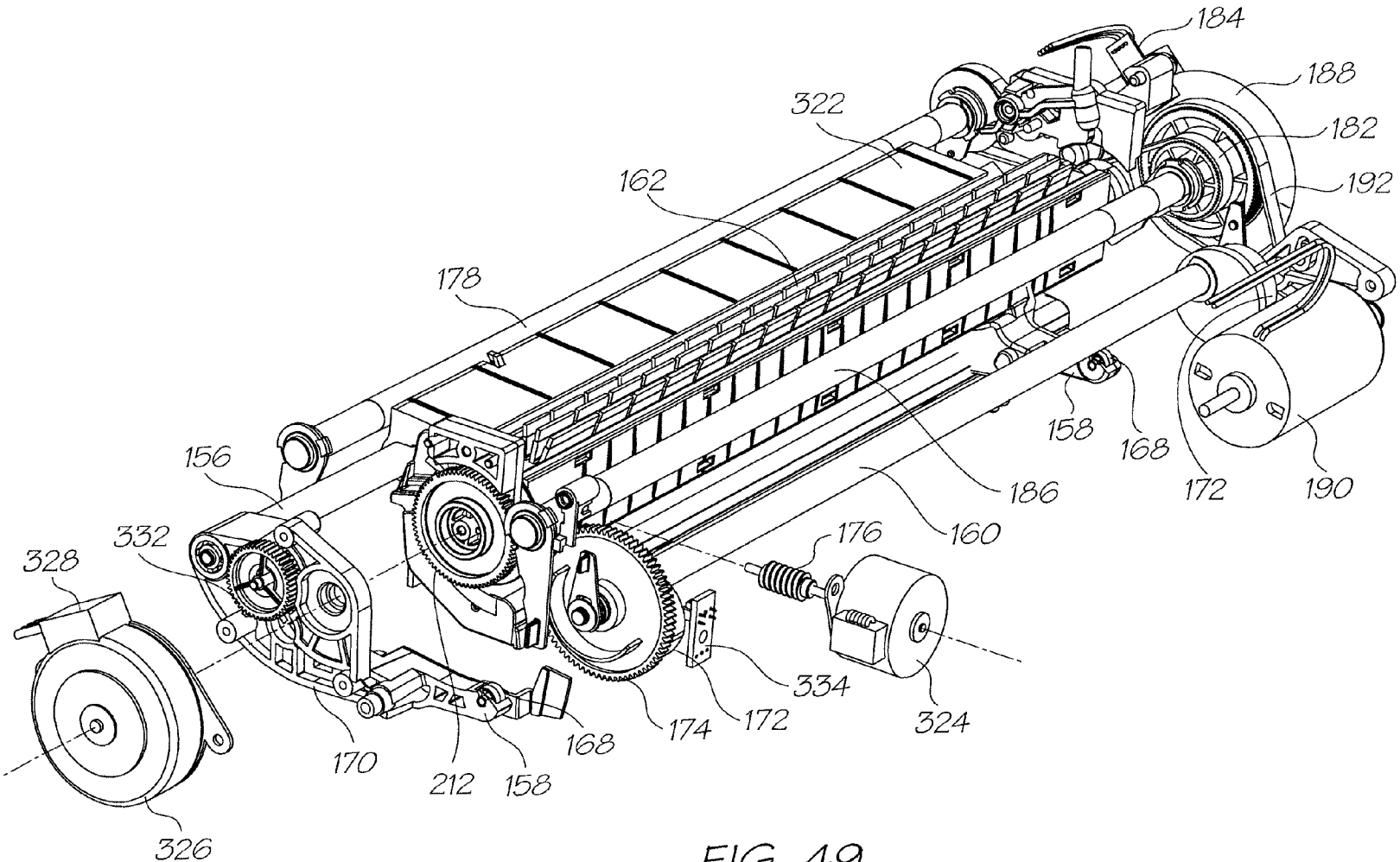
FIG. 49 is an exploded perspective of the independent drive assemblies shown in FIG. 48; and, FIG. 50 is an enlarged view of the left end of the exploded perspective showing in FIG. 49.

The exploded perspective in FIG. 49 shows the individual components in greater detail. In particular, this perspective best illustrates the balanced carousel lift mechanism. The carousel lift drive shaft 160 extends between two identical carousel lift cams 172. One end of the carousel lift shaft 160 is keyed to the carousel lift spur gear 174. The spur gear 174 meshes with the worm gear 176 driven by the carousel lift motor 324. The carousel lift rotation sensor 334 provides feedback to the print engine controller (not shown) which can determine the displacement of the carousel from the printhead by the angular displacement of the cams 172.

The carousel lift cams 172 contact respective carousel lift arms 158 via the cam engaging rollers 168 (it will be appreciated that the cam engaging rollers could equally be a surface of low friction material such as high density polyethylene-HDPE). As the cams 172 are identical and identically mounted to the carousel lift shaft 160 the displacement of the carousel lift arms 158 is likewise identical. FIG. 47 is a section view taken along line 7-7 of FIG. 2A with the printhead cartridge 2 removed and the printhead maintenance carousel 150 also removed. This figure provides a clear view of the carousel lift spur gear 174, its adjacent lift cam 172 and the corresponding carousel lift arm 158. As the lift arms 158 are equidistant from the midpoint of the carousel 150, the carousel lift drive is completely balanced and symmetrical when lifting and lowering the carousel. This serves to keep the various printhead maintenance stations parallel to the longitudinal extent of the printhead ICs.

Figure 50:
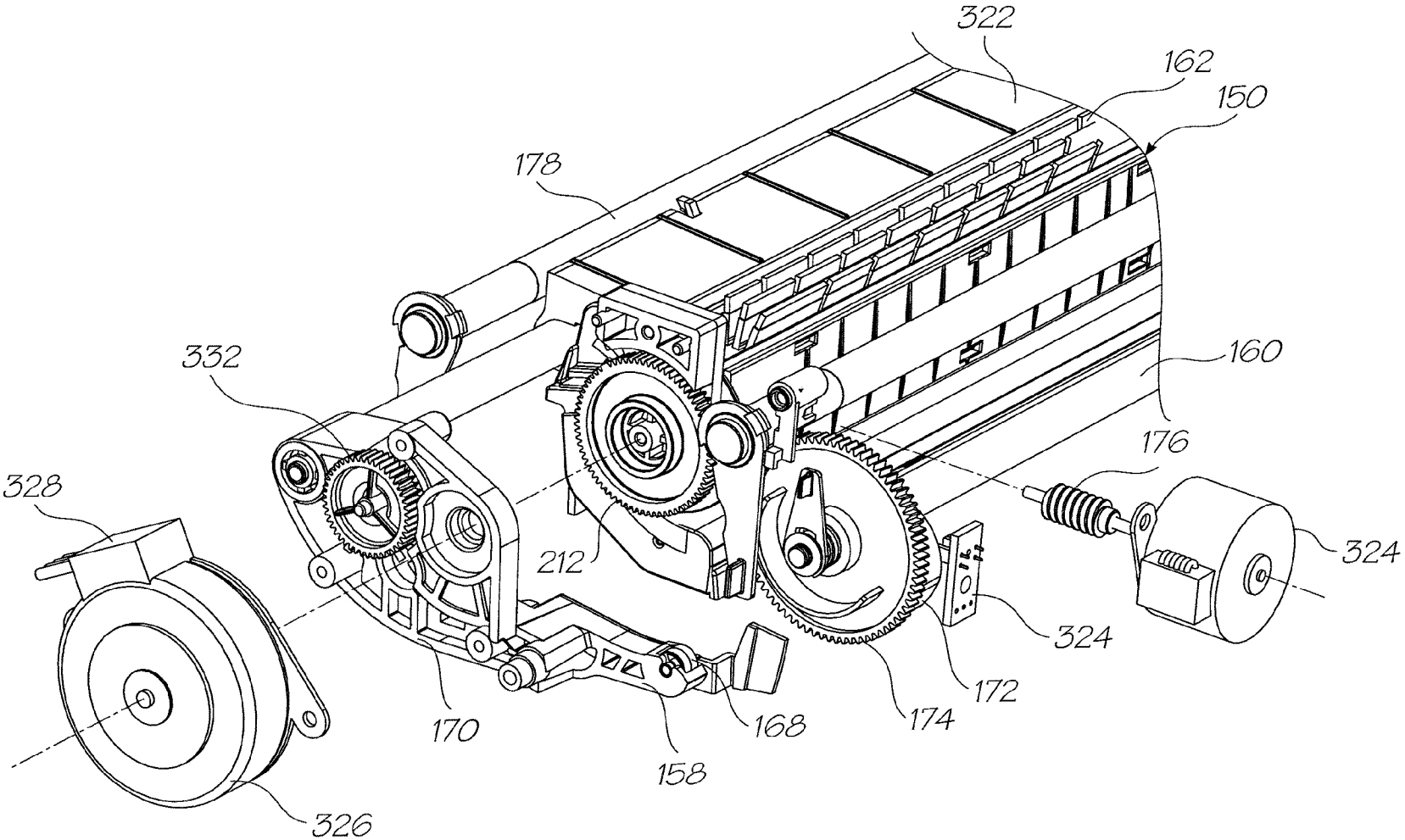

The carousel rotation drive is best illustrated in the enlarged exploded partial perspective of FIG. 50. The carousel rotation motor 326 is mounted to the side of the carousel lift structure 170. The stepper motor sensor 328 provides feedback to the print engine controller (PEC) regarding the speed and rotation of the motor 326. The carousel rotation motor 326 drives the idler gear 332 which in turn, drives the reduction gear (not shown) on the obscured side of the carousel lift structure 170. The reduction gear meshes with the carousel spur gear 212 which is keyed to the carousel chassis for rotation therewith.

As the carousel rotation and the carousel lift the controlled by a separate independent drives, each drive powered by a stepper motor that provides the PEC with feedback as to motor speed and rotation, the printer has a broad range of maintenance procedures from which to choose. The carousel rotation motor 326 can be driven in either direction and at the variable speeds. Accordingly the nozzle face can be wiped in either direction and the wiper blades can be cleaned against the absorbent pad 152 in both directions. This is particularly useful if paper dust or other contaminants passed to the nozzle face because of a mechanical engagement with the surface irregularity on the nozzle face. Wiping in the opposite direction will often dislodge such mechanical engagements. It is also useful to reduce the speed of the wiper blades 162 as they come into contact with the nozzle face and then increase speed once the blades have disengaged the nozzle face. Indeed the wiper blades 162 can slow down for initial contact with the nozzle face and subsequently increase speed while wiping.

Similarly, the wiper blades 162 can be moved past the doctor blade 154 at a greater speed than the blades are moved over the cleaning pad 152. The blades 162 can be wiped in both directions with any number of revolutions in either direction. Furthermore the order in which the various maintenance stations are presented to the printhead can be easily programmed into the PEC and or left to the discretion of the user.

The present invention has been described herein by way of example only. The ordinary worker will readily recognise many variations and modifications which do not depart from the spirit and scope of the broad inventive concept.

The invention claimed is:

1. A printhead maintenance facility for an inkjet printer having a pagewidth printhead and a media path for feeding sheets of media substrate in a media feed direction, the pagewidth printhead having a nozzle face defining an elongate array of nozzles extending the printing width of the media substrate, the printhead maintenance facility comprising:

a wiper member extending the length of the nozzle array;

a chassis for supporting the wiper member; and, a maintenance drive has a first actuator for moving the wiper member towards or away from the nozzle face, and a second actuator for rotating wiper member about an axis extending transverse to the media feed direction; wherein, the first actuator and the second actuator are independently operable.

2. A printhead maintenance facility according to claim 1 wherein the second actuator is configured to selectively rotate the wiper member in either direction about the axis extending transverse to the media feed direction.

3. A printhead maintenance facility according to claim 2 wherein the second actuator is configured to selectively vary the speed with which the wiper member is rotated about the axis extending transverse to the media feed direction.

4. A printhead maintenance facility according to claim 1 wherein the first actuator and the second actuator are both electric motors with encoder disks providing feedback to a print engine controller in the inkjet printer.

5. A printhead maintenance facility according to claim 1 wherein the first actuator is configured to apply a force to the chassis at a first bearing point proximate one end of the wiper member, and configured to apply an equal force to the chassis at a second bearing point proximate the other end of the wiper member wherein, the first bearing point and the second bearing point being equidistant from a longitudinal mid-point of the wiper member.

6. A printhead maintenance facility according to claim 5 wherein the maintenance drive has a first arm engaging the first bearing point and a second arm engaging the second bearing point, the maintenance drive also having a first cam and a second cam, the first cam engaging the first arm and the second cam engaging the second arm, the first and second cam being mounted for rotation on a common shaft.

7. A printhead maintenance facility according to claim 1 wherein the wiper member has a plurality of resilient blades extending the width of media substrate.

8. A printhead maintenance facility according to claim 7 wherein the plurality of blades are arranged in parallel rows, each of the rows extending the width of media substrate.

9. A printhead maintenance facility according to claim 8 wherein the blades in one of the parallel rows positioned such that they are not in registration with the blades an adjacent one of the parallel rows.

10. A printhead maintenance facility according to claim 9 wherein the blades in each of the parallel rows are spaced from their adjacent blades by a gap allowing independent movement of adjacent blades.

11. A printhead maintenance facility according to claim 1 wherein the maintenance drive is configured to selectively move the wiper member past the printhead in the media feed direction or opposite the media feed direction.

12. A printhead maintenance facility according to claim 1 wherein the chassis is a tubular chassis, the wiper member being mounted to the tubular chassis exterior.

13. A printhead maintenance facility according to claim 12 wherein further comprising a blotter, a capper and print platen mounted to the tubular chassis exterior.

14. A printhead maintenance facility according to claim 13 wherein the tubular chassis has porous material in its central cavity and apertures to establish fluid communication between the wiper member and the porous material.

15. A printhead maintenance facility according to claim 1 wherein the wiper member is a molded elastomeric element.

16. A printhead maintenance facility according to claim 1 further comprising an absorbent pad extending the length of the wiper member such that the maintenance drive moves the wiper member across the absorbent pad after the wiper member has wiped the nozzle face.

17. A printhead maintenance facility according to claim 16 wherein the second actuator moves the wiper member across the absorbent pad repeatedly while the first actuator holds the chassis away from the nozzle face so as not contact wiper member.

18. A printhead maintenance facility according to claim 17 wherein the absorbent pad has a cleaning surface which contacts the wiper member, the contact surface being covered with a woven material having stranded less than two deniers.

19. A printhead maintenance facility according to claim 18 wherein the woven material is microfibre.

20. A printhead maintenance facility according to claim 1 further comprising a doctor blade extending transverse to the media feed direction, wherein during use the maintenance drive moves the wiper member over the nozzle face, then across the absorbent pad and then past the doctor blade such that the resilient blade flexes in order to pass the doctor blade and upon disengagement of the resilient blade and the doctor blade, the resilient blade springs back to its quiescent shape thereby projecting contaminants from its surface.

* * * * *